US006470163B1

(12) United States Patent
Minagawa

(10) Patent No.: US 6,470,163 B1
(45) Date of Patent: Oct. 22, 2002

(54) DEVELOPER STIRRING MEMBER, ASSEMBLY METHOD AND RECYCLING METHOD FOR THE SAME

(75) Inventor: Hironori Minagawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/694,506

(22) Filed: Oct. 24, 2000

(30) Foreign Application Priority Data

Oct. 27, 1999 (JP) ..... 11-305796
Feb. 29, 2000 (JP) ..... 2000-054039

(51) Int. Cl.[7] ..... G03G 15/08
(52) U.S. Cl. ..... 399/256; 29/889.1; 399/109
(58) Field of Search ..... 399/254, 256, 399/263, 107, 109; 29/889.1; 366/275, 279, 309, 326.1, 330.2, 331, 343

(56) References Cited

U.S. PATENT DOCUMENTS

| | | | | |
|---|---|---|---|---|
| 2,991,051 | * | 7/1961 | Jones | |
| 3,066,831 | * | 12/1962 | Thompson | |
| 4,199,269 | * | 4/1980 | Neumann et al. | 366/343 |
| 4,610,068 | * | 9/1986 | Schultz | 29/418 |
| 5,835,827 | * | 11/1998 | Kishimoto | 399/254 |
| 5,870,652 | * | 2/1999 | Kanamori et al. | 399/106 |

FOREIGN PATENT DOCUMENTS

| | | | |
|---|---|---|---|
| EP | 0661609 A2 | | 7/1995 |
| JP | 58-147766 | | 8/1983 |
| JP | 58-171066 | * | 10/1983 |
| JP | 07-099617 | * | 8/1995 |
| JP | 11-24401 | | 1/1999 |

* cited by examiner

*Primary Examiner*—Robert Beatty
(74) *Attorney, Agent, or Firm*—Fitzpatrick, Cella, Harper & Scinto

(57) ABSTRACT

A developer stirring member, provided in a developer container for accommodating a developer, for stirring the developer, the developer stirring member includes a stirring blade stirring the developer; a rotatable supporting member for supporting the stirring blade, the supporting member being provided with a plurality of projections; wherein stirring blade is provided with a plurality of openings for engagement with the projections, respectively. This provides for easy assembly and recycling.

39 Claims, 38 Drawing Sheets

$B > A + 2C > D$、 $d > A$、 $2h > D - A$、 $2h > d - A$

DEVELOPER STIRRING MEMBER, ASSEMBLY METHOD AND RECYCLING METHOD FOR THE SAME

FIELD OF THE INVENTION AND RELATED ART

The present invention relates to a stirring member for stirring a developer in a developer container and a recycling or refreshing method for the stirring member. The developer container is used as a toner supply container for supplying powdery toner to an image forming apparatus, for example.

In an image forming apparatus such as a copying machine, a laser beam printer or the like using an electrophotographic process, a photosensitive drum is uniformly charged and is selectively exposed to light so that electrostatic latent image is formed thereon. The latent image is developed with a developer in the form of powdery toner into a developed image, which is transferred onto a recording material.

The electrophotographic image forming apparatus forms an image on a recording material through an electrophotographic image formation type process. Examples of the electrophotographic image forming apparatus include an electrophotographic copying machine, an electrophotographic printer (a laser beam-printer or LED printer mountable), a facsimile machine, a word processor and the like. With such an apparatus, the powdery toner has to be replenished each time it is used up. Some toner supply containers for doing this are provided with a toner stirring member for stirring or feeding the toner.

The toner stirring member comprises a rigid stirring shaft (supporting member) and a flexible stirring blade, and they are fastened together by heat crimping, ultrasonic crimping, riveting, screwing or the like.

On the other hand, a toner cartridge as a toner supply container for supplying the toner into the image forming apparatus is generally classified into two groups. The first group includes a so-called replenishing type cartridge with which the toner contained therein is supplied into a toner receiving container of the main assembly of the image forming apparatus all at once. The second group includes a so-called stationary type cartridge which is placed in the main assembly of the image forming apparatus, and the toner is gradually supplied into the developing device until the toner therein is used up.

Recently, the stationary type tends to be used more from the standpoint of downsizing the image forming apparatus. In order to supply the toner to maintain a constant level of toner amount in the developing device, many types of toner cartridges are provided with the stirring member (feeding member) described above.

Since the stirring blade is flexible, it relatively easily creeps, and recycling thereof is difficult, whereas the stirring shaft can be reused. However, the conventional fastening of the stirring blade to the stirring shaft does not permit demounting of the stirring blade. If the stirring blade is damaged when it is assembled into the main assembly of the toner supply container, the whole stirring shaft is exchanged.

In the case of the heat crimping or ultrasonic crimping, there is a possibility that fuzz or other foreign matter is introduced, with the result that an additional step of cleaning is required. Furthermore, a particular device is required for fastening the stirring blade to the stirring shaft, and the assembling steps are complicated with the result of increase of manufacturing cost. When the toner supply container is collected back and is reused, the stirring shaft and the stirring blade are not separable from each other.

SUMMARY OF THE INVENTION

Accordingly, it is a principal object of the present invention to provide a developer stirring member and a recycling method for the stirring member wherein the manufacturing steps are simplified, and the manufacturing cost is reduced, and in addition, reuse of parts is accomplished.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
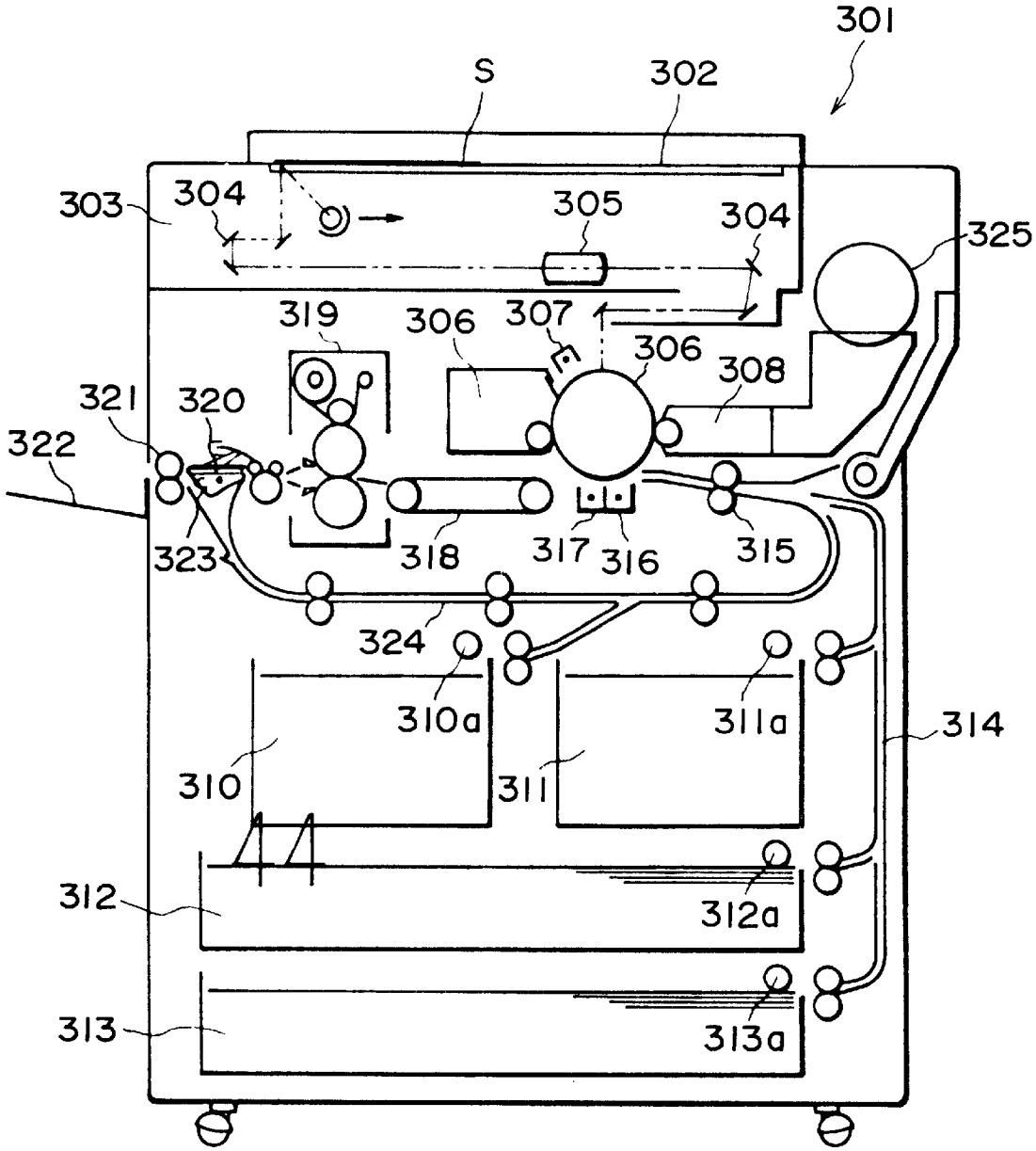
FIG. 1 is a general arrangement of an image forming apparatus having a toner stirring member and a toner supply container according to one embodiment of the present invention.
Figure 2:
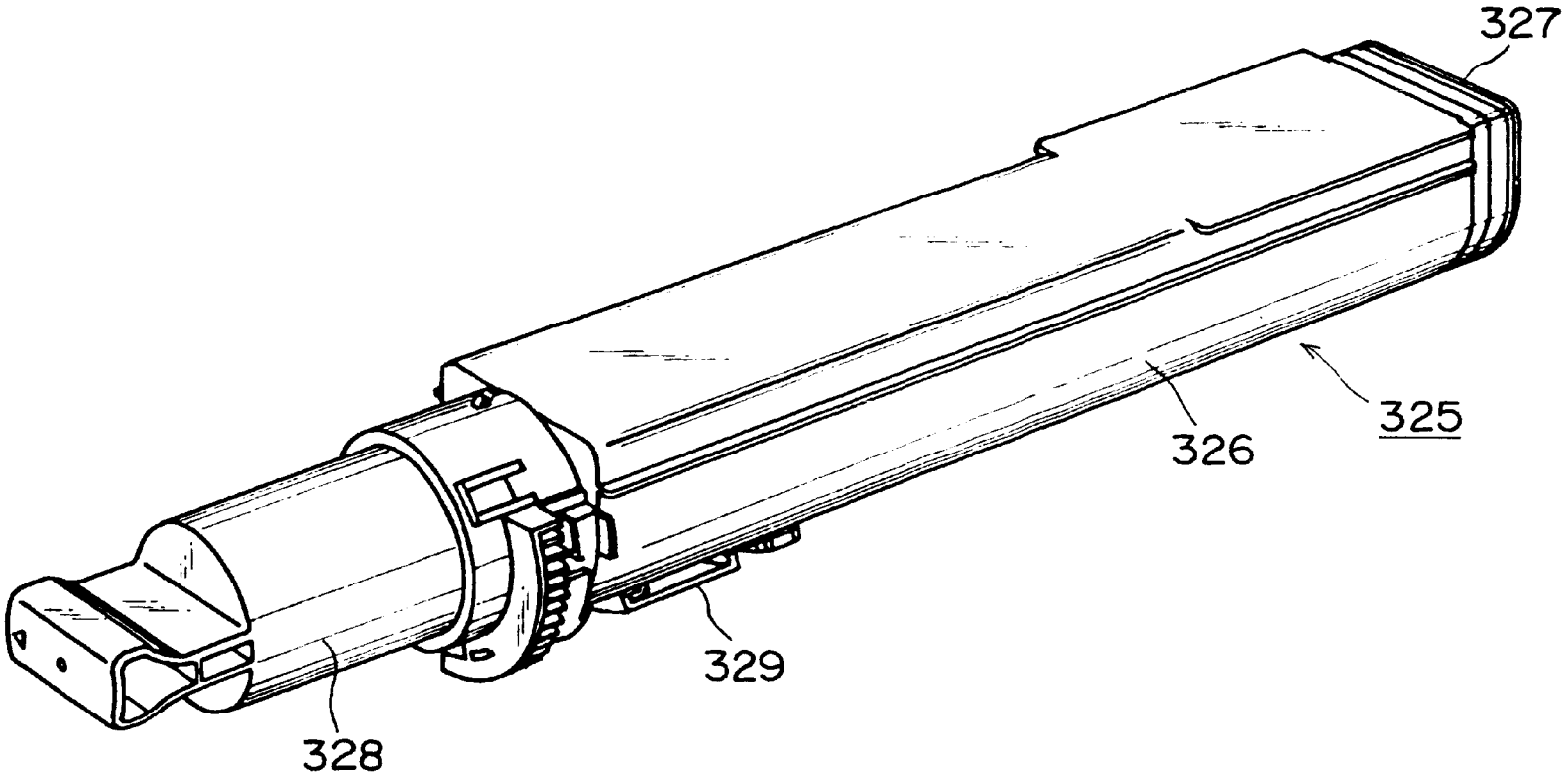
FIG. 2 is a perspective view of another appearance of a toner supply container.
Figure 3:
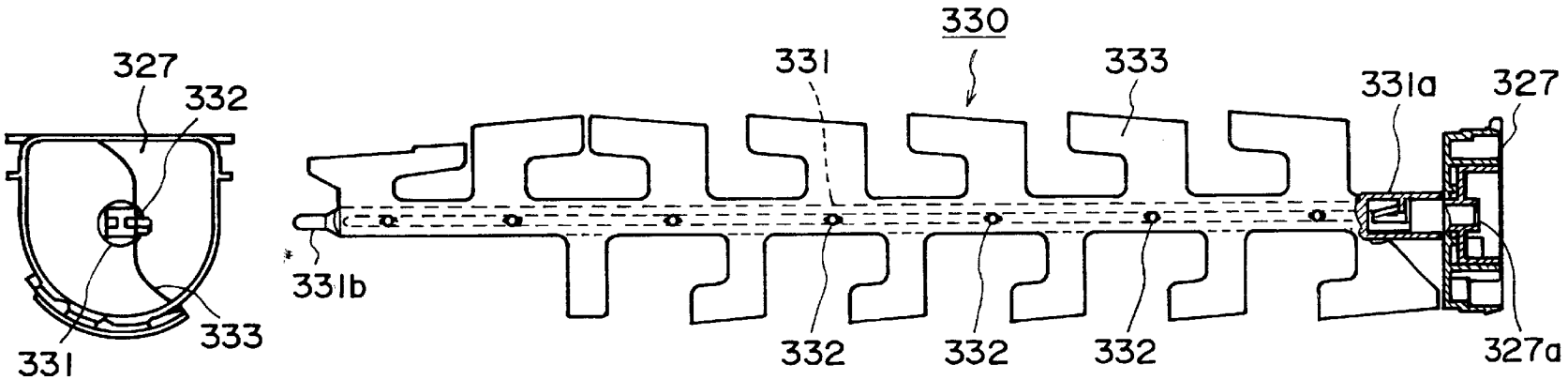
FIG. 3 is a front view and a side view of a toner stirring member.
Figure 4:
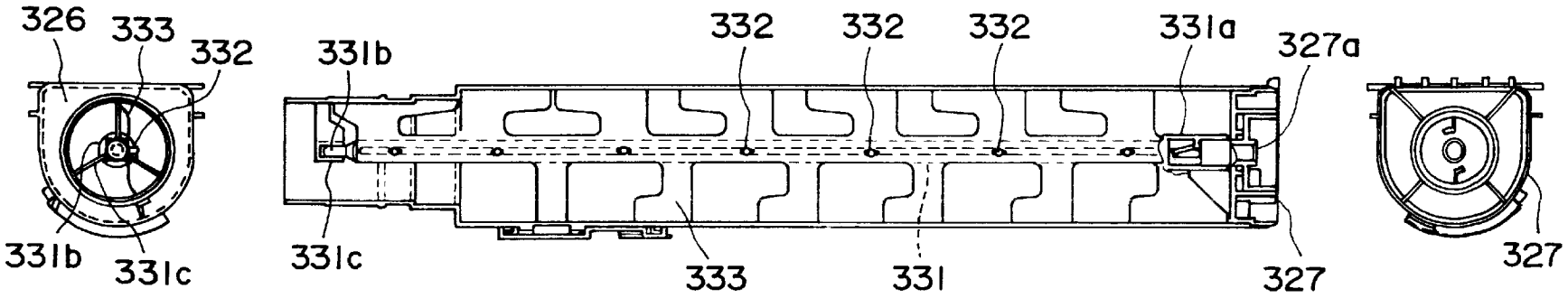
FIG. 4 is a sectional view and a side view of a toner supply container.
Figure 5:
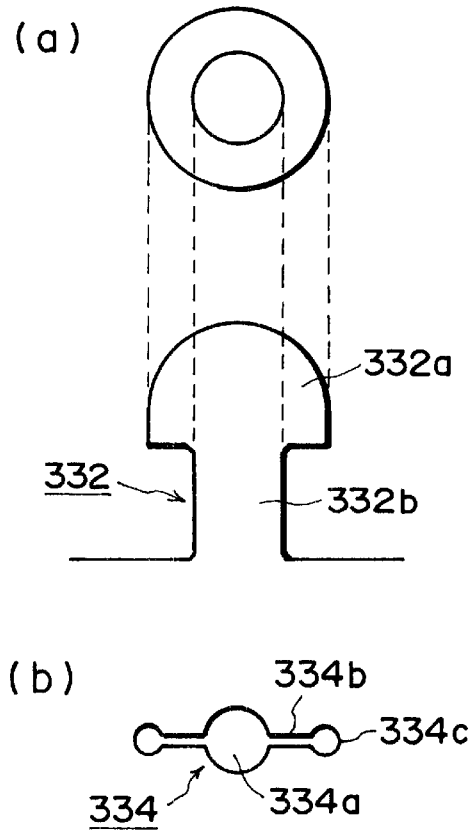
FIGS. 5(*a*) and 5(*b*) are illustrations of a detail of a connecting portion of a toner stirring member.
Figure 6:
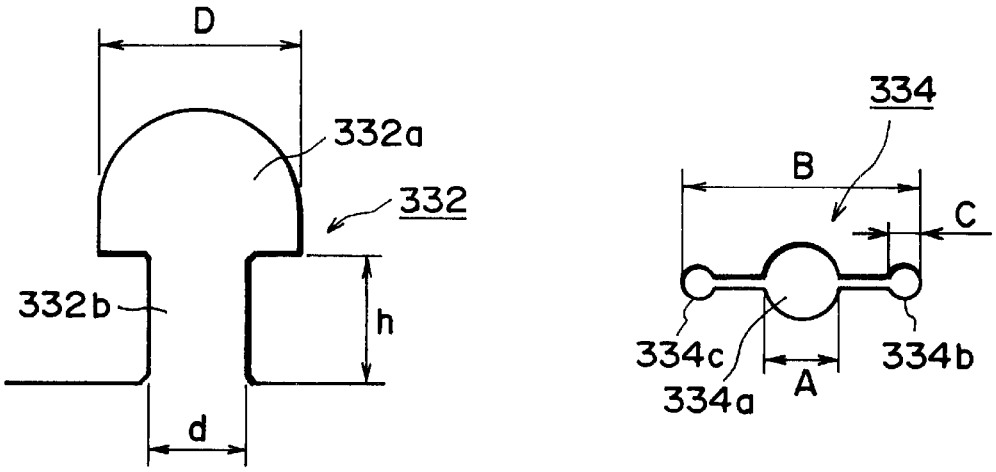
FIG. 6 shows a relationship among various dimensions of a boss.
Figure 7:
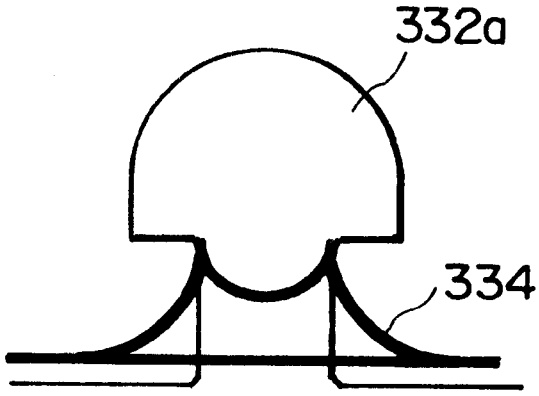
FIG. 7 shows a stirring blade mounted on a stirring shaft.
Figure 8:
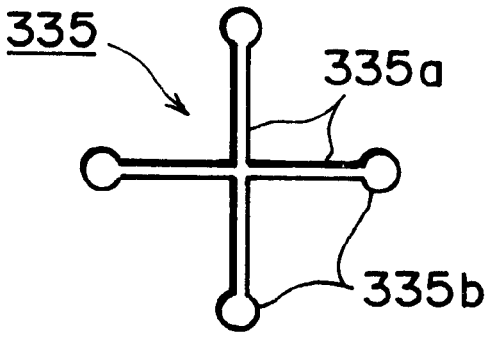
FIG. 8 is an illustration of a connecting portion according to another embodiment of the present invention.
Figure 9:
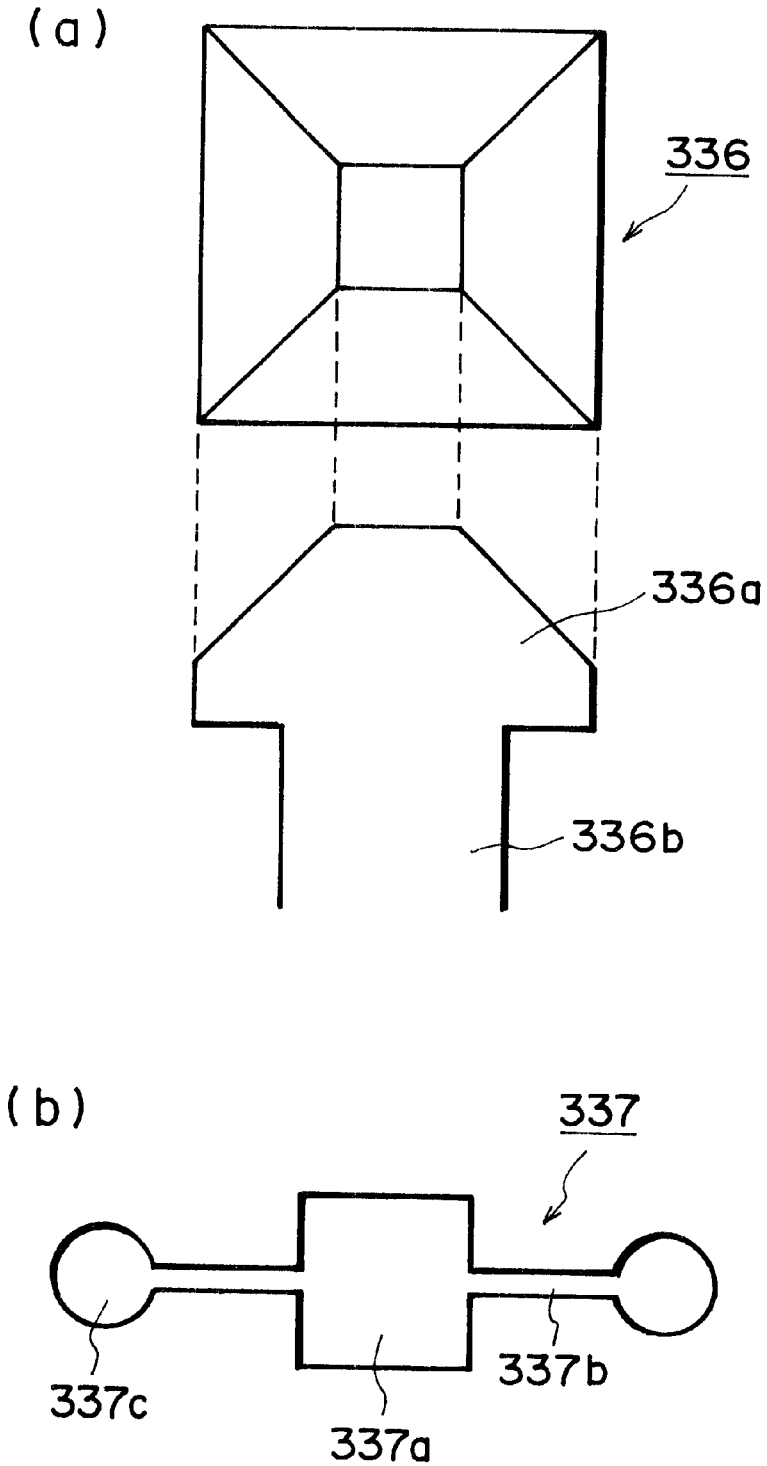
FIGS. 9(*a*) and 9(*b*) are illustrations of a connecting portion according to a further embodiment of the present invention.

A developer stirring member and a developer container according to the preferred embodiments of the present invention will be described in conjunction with the accompanying drawings. FIG. 1 is a general arrangement of an image forming apparatus having a toner stirring member and a toner supply container according to one embodiment of the present invention. FIG. 2 is a perspective view of another appearance of a toner supply container. FIG. 3 is a front view and a side view of a toner stirring member. FIG. 4 is a sectional view and a side view of a toner supply container. FIG. 5 is an illustration of a detail of a connecting portion of a toner stirring member. FIG. 6 shows a relationship among various dimensions of a boss. FIG. 7 shows a stirring blade mounted on a stirring shaft. FIG. 8 is an illustration of a connecting portion according to another embodiment of the present invention. FIG. 9 is an illustration of a connecting portion according to a further embodiment of the present invention.

(General Arrangement)

Referring to FIG. 1, the general arrangement of the image forming apparatus will be described. The main assembly 301 of the image forming apparatus shown in this Figure is a copying machine of an electrophotographic type. In the image forming apparatus 301, an original S placed on an original supporting platen glass 302 at the top of the apparatus is scanned by an optical system 303, and the reflected light from the original is projected onto the image bearing member 306 through mirrors 304 and lenses 305. The image bearing member 306 is uniformly charged electrically by charging means 307, and the projection of the reflected light forms a latent image on the photosensitive member. The latent image is visualized with toner by developing means 308 into a toner image. The developing means 308 is supplied with powdery toner (toner) from a toner supply container 325 which is a developer container which will be described hereinafter.

At a lower part of the main assembly 301 of the apparatus, cassettes 310, 311, 312, 313 containing different kinds of sheets P are provided, and a proper sheet is selected in response to information inputted by an operator at an operating portion not shown or in response to a size of the original S. By feeding means 310*a*, 311*a*, 312*a*, 313*a*, a single sheet P is fed out or a plurality of sheets are fed out in seriatim, and fed to registration rollers 315 through a feeding path 14. The sheet P is abutted to the nip of the registration rollers 315, the inclination thereof is corrected, and is refed in synchronism with the rotation f the image bearing member 306.

The sheet P is separated from the image bearing member 306 by a separation charger 317 after the transfer of the toner image from the image bearing member 306 by the transfer charger 316, and the sheet P is fed to the fixing portion 319 by the feeding means 318 where the toner image is fixed by heat and pressure. The image bearing member, after the toner image has been transferred, is cleaned by cleaning means 309 so that the untransferred toner is removed, and is prepared for the next image formation.

The sheet P on which the toner image has been fixed is passed through a discharging/reversing portion 320 and is discharged onto a discharging tray 322 by discharging rollers 321. In the case of a both-side recording mode, the sheet is fed to the re-feeding path 324 by controlling a flapper 323 in the discharging/reversing portion 320, and is reversed in its facing orientation and is refed to the registration rollers 315, and then discharged onto the discharging tray 322 similarly to the above described one surface recording.

In the case of a superposition recording mode, the sheet P is passed through the discharging/reversing portion 320, and a part of the sheet is discharged temporarily to the outside of the apparatus by the discharging rollers 321. When the terminal end of the sheet P has passed by the flapper 323 and the sheet is still nipped by the discharging rollers 321, the flapper 323 is controlled, and the discharging rollers 321 are rotated in the opposite direction so that the sheet is refed into the apparatus. The sheet is refed to the registration rollers 315 without reversing its facing orientation through the re-feeding path 324, and is discharged onto the discharging tray 322 similarly to the case of the one surface recording mode.

(Toner Supply Container)

Referring to FIG. 2, a toner supply container 325 is shown which is provided at the opposite ends of the main assembly 326 of the container with flanges 327 and gripping members 328, and which is provided at a lower position with an opening 329 for supplying the toner, and which is further provided in the main assembly 326 of the container with a toner stirring member 330 which is a developer stirring member. The toner supply container 325 functions to supply the toner into the developing means 308 as described hereinbefore, and the user detachably mounts it to the main assembly 301 while handling it by the gripping member 328.

(Toner Stirring Member)

The toner stirring member 330, as shown in FIG. 3, comprises a stirring shaft 331 (supporting member) and a stirring blade 333 fastened thereto, and as shown in FIG. 4, it is disposed inside the main assembly 26 of the container. The stirring shaft 331 is a rod-like member, and at one end thereof, an engaging portion 331*a* for engagement with a coupling 327*a* through a flange 327 is formed, the coupling 327*a* being effective to transmit a driving force from the main assembly of the apparatus to the toner stirring member 330. The other end thereof is inserted into the rib 331*c* provided inside the main assembly 326 of the container.

A plurality of projections or bosses 332 are formed on the peripheral portion of the stirring shaft 331.

The boss 332 comprises a large diameter portion 332*a* at a position remote from the stirring shaft 331 and a small diameter portion 332*b* near to the stirring shaft 331, as shown in FIG. 5(*a*), and therefore, it is in the form of a projection having a larger diameter at the free end side. In the embodiment, the large diameter portion 332*a* and the small diameter portion 332*b* both have circular cross-sections in this embodiment.

The stirring blade 332 is produced from a flat flexible member, as shown in FIG. 3, and the blade portions are provided alternately on the lateral sides of connecting portion along the stirring shaft 331. The stirring blade 333 is provided at a position corresponding to the boss 332 with a locking portion 334.

As shown in FIG. 5(*b*), the locking portion 334 comprises a center hole 334*a*, two slits 334*b* extended diametrically outwardly in the opposite directions and an expansion-prevention hole 334*c* at the outermost ends of the slits 334*b*. These three holes 334*a*, 334*c* are arranged along the axial direction of the stirring shaft 331 with the central hole 334*a* at the position corresponding to the boss 332. The prevention holes 334*c* at the opposite ends of the slits 334*b* function to prevent the slits 334*b* from expanding when the boss 332 is inserted. The material of the stirring blade 333 may be the one having a proper elasticity and a creep resistance, and examples include a polyacetal sheet, a polyurethane rubber sheet, rubber coated fabric and the like, but is preferably polyester (PET) film. The thickness of the polyester (PET) film is preferably approximately 50 μm–500 μm, and more preferably approximately 150 μm–300 μm.

If the thickness is smaller than 50 μm, the elasticity is so low that the toner feeding force and the fastening force relative to the boss are low. If, on the other hand, the thickness is larger than 500 μm, the elasticity is too low for the stirring blade 333 to rub the inner wall of the main assembly 326 of the container with a result of large rotational torque required. Additionally, the difficulty in the formation leads to the difficulty in the assembling operation, and in the disassembling operation, and the damage or deformation of the boss 332 might occur. In this embodiment, the thickness of the stirring blade 333 is 188 μm. As for the manufacturing of the stirring blade 333, it is preferable to punch from the standpoint of low-cost and sufficient accuracy.

Referring to FIG. 6, the description will be made as to the preferable relationship of dimensions of the boss 332 and locking portion 334. A width D of the large diameter portion 332*a* of the boss 332 is larger than a width d of the small diameter portion 332*b*. By this, the locking portion 334 of the stirring blade 333 is deformed and can be hooked on the large diameter portion 332*a*, so that stirring blade 333 is fastened. Since the width d of the small diameter portion 332*b* is larger than the width A of the hole 334*a* (d>A), a pressure is produced in the engagement therebetween, thus preventing occurrence of play and disengagement.

The height h of the small diameter portion 332*b* is preferably larger than one half the difference between the width D of the large diameter portion 332*a* and the width A of the hole 334*a*, that is, 2h>D−A. The width B of the entirety of the locking portion 334 is desirably equal to or larger than the total of the hole 334*a* and the prevention hole 334*c*, and when inserted into the mounting, it is desirably larger than the width D of the large diameter portion 332*a*, that is, B>A+2C>D. By doing so, the hole 334*a* is prevented from tearing by expansion upon the mounting, and the mounting and demounting are easy and reliable. Furthermore, the play or rise of the stirring blade 333 from the stirring shaft 331 can be minimized.

It is desirable that height h of the small diameter portion 332*b* is larger than one half of the difference between the width of the small diameter portion and the width A of the hole 334*a*, that is, 2h>d−A. By doing so, the stirring blade 333 can be fixed to the stirring shaft 331 without difficulty, and the play can be avoided, and in addition, the stirring blade 333 does not easily fall from the stirring shaft.

In this embodiment, the dimensions are: A=1.5 mm, B=5.0 mm, C=1.0 mm, D=3.0 mm, d=2.0 mm and h=2.0 mm.

(Assembling of Toner Stirring Member)

When the toner stirring member 330 is assembled, the locking portion 334 of the stirring blade 333 is inserted into the boss 332 of the stirring shaft 331, and this is enough. FIG. 7 illustrates the boss 332 and the locking portion 34 after the insertion. The locking portion 334 is expanded by the large diameter portion 332*a* of the boss 332 upon insertion, but by the provision of the prevention hole 334*c* at the end of the slit 334*b,* the stress concentration is eased so that liability of tearing is prevented. After it is passed, the elastic restoring force clamps the small diameter portion 332*b* of the boss 332, so that stirring blade 333 is fastened. The stirring blade 333 is correctly positioned by the clamping force, so that there remains no play. As shown in FIG. 7, the large diameter portion 332*a* has a width larger than the small diameter portion 332*b,* so that locking portion 334 is hooked with the large diameter portion 332*a,* thus preventing the blade from falling out. The toner stirring member 330 thus assembled is inserted into the main assembly 326, and is rotatably supported by a flange 327.

(Other Embodiment)

In the foregoing embodiment, two slits 334*b* and prevention holes 334*c* are extended from the hole 334*a* of the locking portion 334. This is not inevitable, and three or more slits 334*b* and prevention holes 334*c* may be formed.

The locking portion 334 of the stirring blade 333 receives a weight in the rotational moving direction, and therefore, the slit 334*b* extending in the axial direction of the stirring shaft 331 is preferable since then they are not disconnected during the rotation, and the stirring blade 333 can be relatively easily dismounted by peeling in the axial direction.

As shown in FIG. 8, the locking portion 335 may not be provided with the center hole, and may be provided with two or more slits 335*a* and prevention holes 334*c* at their ends. In this Figure, the slits 335*a* extend in four directions, but they may extend in three or five or more directions.

As shown in FIG. 9, the cross-sections of the boss 336 and locking portion 337 may be non-circular.

As shown in FIGS. 9(*a*) and 9(*b*), for example, the boss 336 shown at FIG. 9(*a*) includes a large diameter portion 336*a* and a small diameter portion 336*b* which have rectangular cross-section, and the locking portion 37 shown at FIG. 9(*b*) has a rectangular center hole 337*a* and slits 337*b* and prevention holes 337*c*. The recycling of the developer stirring member and the developer container provided therewith according to an embodiment of the present invention will be described. The description will be made as to the general arrangement of the copying machine using the developing device to which the developer container in the form of a toner cartridge is mounted, the structure of the toner cartridge, various members constituting the toner cartridge and dismounting of the toner cartridge, and then the recycling of the toner cartridge.

Presented below are the embodiments of the present invention. First, a preferable embodiment of the present invention will be described, followed by the others.

The embodiments of the present invention, which will be described below, relates to a toner supply container used for supplying the main assembly of an electrophotographic image forming apparatus with toner. This toner supply container comprises a toner containing portion, a toner outlet for discharging the toner contained in the toner containing portion, a shutter for opening or closing the toner outlet, and a driving force receiving portion for receiving the driving force for moving the shutter to open the toner outlet.

(Electrophotographic Image Forming Apparatus)

Figure 31:
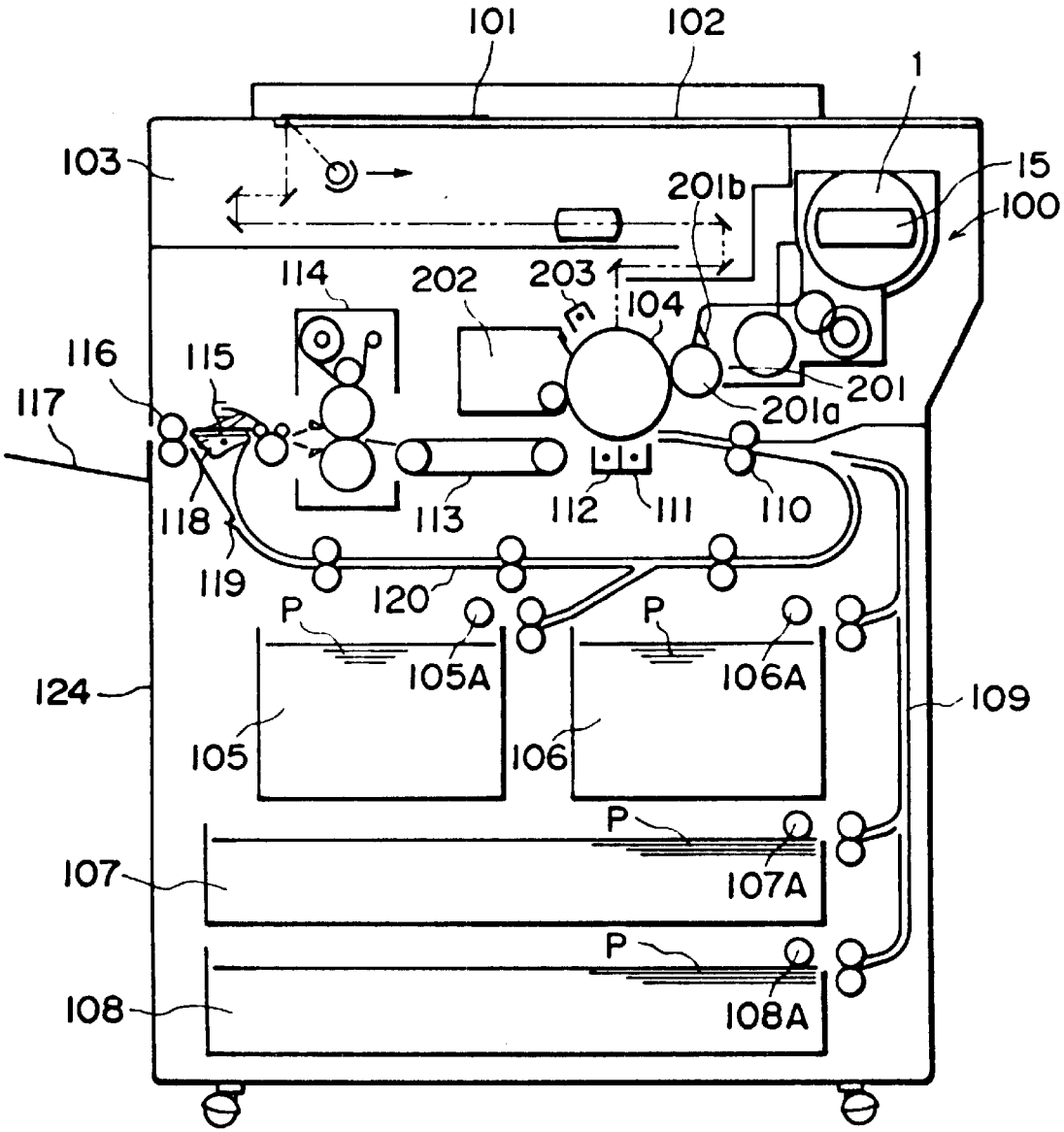
FIG. 31 is a vertical sectional view of an electrophotographic image forming apparatus.

FIG. 31 is a vertical sectional view of an electrophotographic image forming apparatus in which there is a toner supply container (toner container) in accordance with the present invention.

An original 101 is placed on a glass plate 102 for an original, by an operator. As a result, an optical image of the original 101 is formed on a photosensitive drum 104 as an image bearing member by the plurality of mirrors and lenses which an optical portion 103 comprises. Meanwhile, one of the feeder cassettes 105–108 in which recording media P (for example, paper, OHP sheet, or the like; hereinafter, "sheet") are stored in layers is selected on the basis of the sheet size information inputted through a control panel (unillustrated) by the operator. Then, among the feeder rollers 105A–108A, the roller of the selected feeder cassette is rotated to feed out a single sheet of recording medium P. After being fed out of the feeder cassette, the recording sheet P is conveyed to a registration roller 110 through a conveyance path 109. The registration roller 110 conveys the recording sheet P to the photosensitive drum 104 in synchronism with the rotational timing for the photosensitive drum 104 and the scanning timing for the optical portion 103. To this recording sheet P, the toner image on the photosensitive drum 104 is transferred by a transferring means 111. Thereafter, the recording sheet P is separated from the photosensitive drum 104 by a separating means 112. Then, the recording sheet P is conveyed to a fixing portion 114 by a conveying portion 113. In the fixing portion 114, the toner image on the recording sheet P is fixed to the recording sheet P with the application of heat and pressure.

Next,

1) In the single side copy mode, the recording sheet P is discharged into a delivery tray 117 by a discharge roller pair 16 through a reversing path 115.
2) In the multiple layer copy mode, the recording sheet P is directed toward conveying portions 119 and 120 by a flapper 118 of the reversing path 115, and is conveyed to the registration roller 110. Thereafter, the recording sheet P is passed through the image forming portion, conveying portion, and fixing portion as it was in the immediately preceding image formation cycle, and then, is discharged into the delivery tray 117.
3) In the two sided copy mode, the recording sheet P is passed through the reversing path 115, and is partially extended outward of the apparatus by the discharge roller pair 16 until its trailing edge passes the flapper 118. Then, as soon as the trailing edge of the recording sheet P passes the flapper 118, the discharge roller pair 116 is rotated in reverse to convey the recording sheet P back into the apparatus. Thereafter, the recording sheet P is conveyed to the conveying portions 119 and 120, and to the registration roller 110. Then, it is passed through the image forming portion, conveying portion, and fixing portion as it was in the immediately preceding image forming cycle, and is discharged into the delivery tray 117.

In an electrophotographic image forming apparatus structured as described above, a developing apparatus 201, a cleaning means 202, and a primary charging means 203 are disposed around the photosensitive drum 104. The developing apparatus 201 develops, with the use of toner, an electrostatic latent image formed on the photosensitive drum 104. A toner supplying apparatus 100 for supplying the developing apparatus 201 with toner is removably installed in the apparatus main assembly 124.

The developing apparatus 201 comprises a development roller 201*a* which maintains a microscopic gap (approximately 300 $\mu$m) from the photosensitive drum 104. During development, a thin layer of toner is formed on the peripheral surface of the development roller 201*a* by the development blade 201*b*. Then, as development bias is applied to the development roller 201*a,* the electrostatic latent image which has been formed on the photosensitive drum 104 is developed.

The charging means 203 is a means for charging the photosensitive drum 104. The cleaning means 202 is a means for removing the toner which remains on the photosensitive drum 104. The reduction in the amount of the toner in the developing apparatus 201 caused by development is compensated for by a fresh supply of toner gradually delivered by a toner supplying apparatus 100.

Here, the exchanging of the toner supply container 301 will be described.

Figure 32:
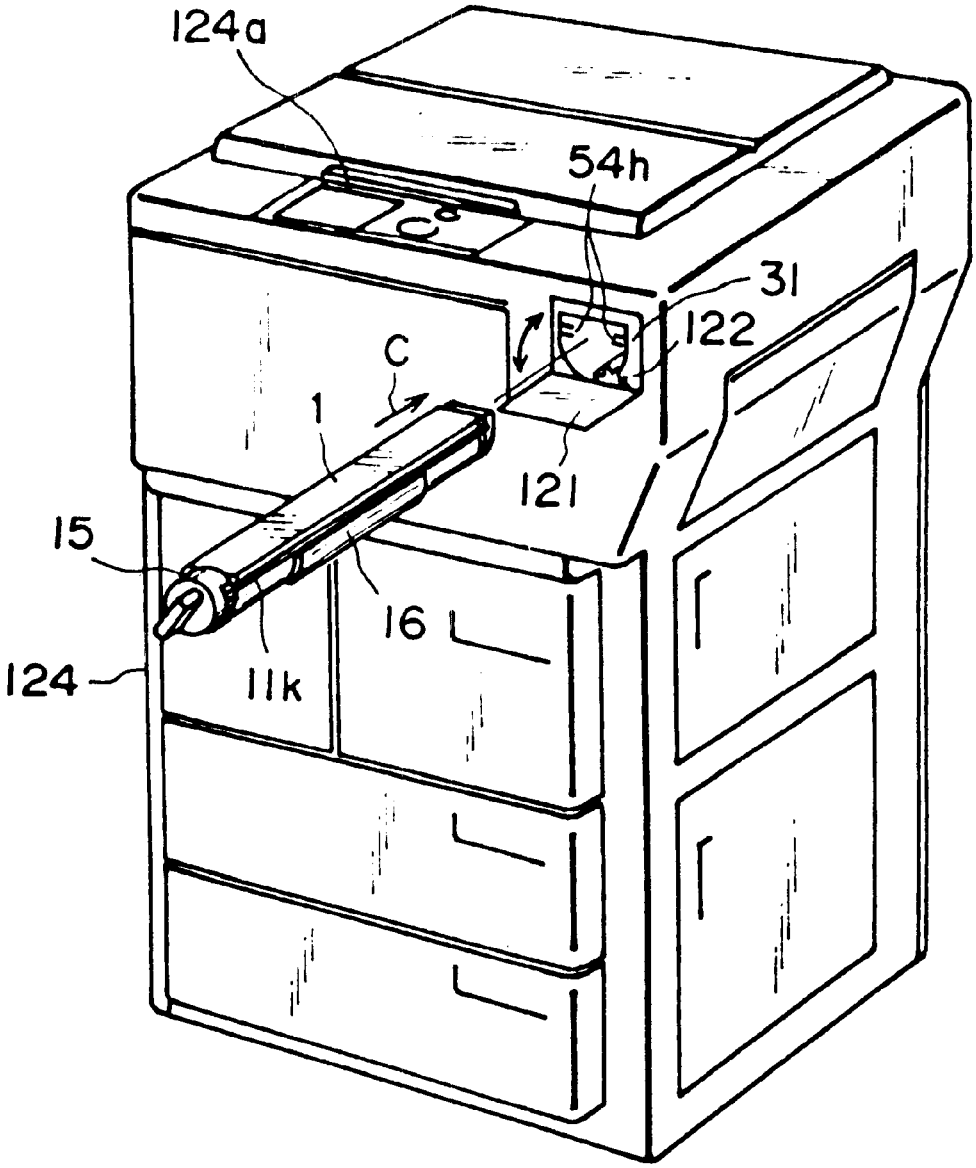
FIG. 32 is a perspective view of the electrophotographic image forming apparatus.

As the toner within the toner supplying apparatus 100 is depleted, the depletion of the toner is reported to a warning section 124*a* shown in FIG. 32. Then, an operator opens the lid 121, which covers the opening 122 with which the main assembly 124 is provided, as shown in FIG. 32. Inside the opening 122, a holder 31 (installing means, more specifically, main assembly 54 of toner supplying apparatus, FIG. 33, for example) in which the toner supply container 1 is removably installable is provided. Into this holder 31, the toner supply container 1 is inserted in its longitudinal direction. During this operation, the toner supply container 1 is guided in its longitudinal direction by a guide, with which the holder 31 is provided, and which extends in the longitudinal direction of the holder 31, until the leading end of the toner supply container 1 reaches a predetermined point. Then, as the operator rotates the handle 15 of the toner supply container 1 after the leading end of the toner supply container 1 reaches the predetermined point, the toner within the toner supply container 1 is supplied to the developing apparatus 201. Then, as the operator closes the lid 121, the power switch is turned on, readying the image forming apparatus for image formation.

Figure 21:
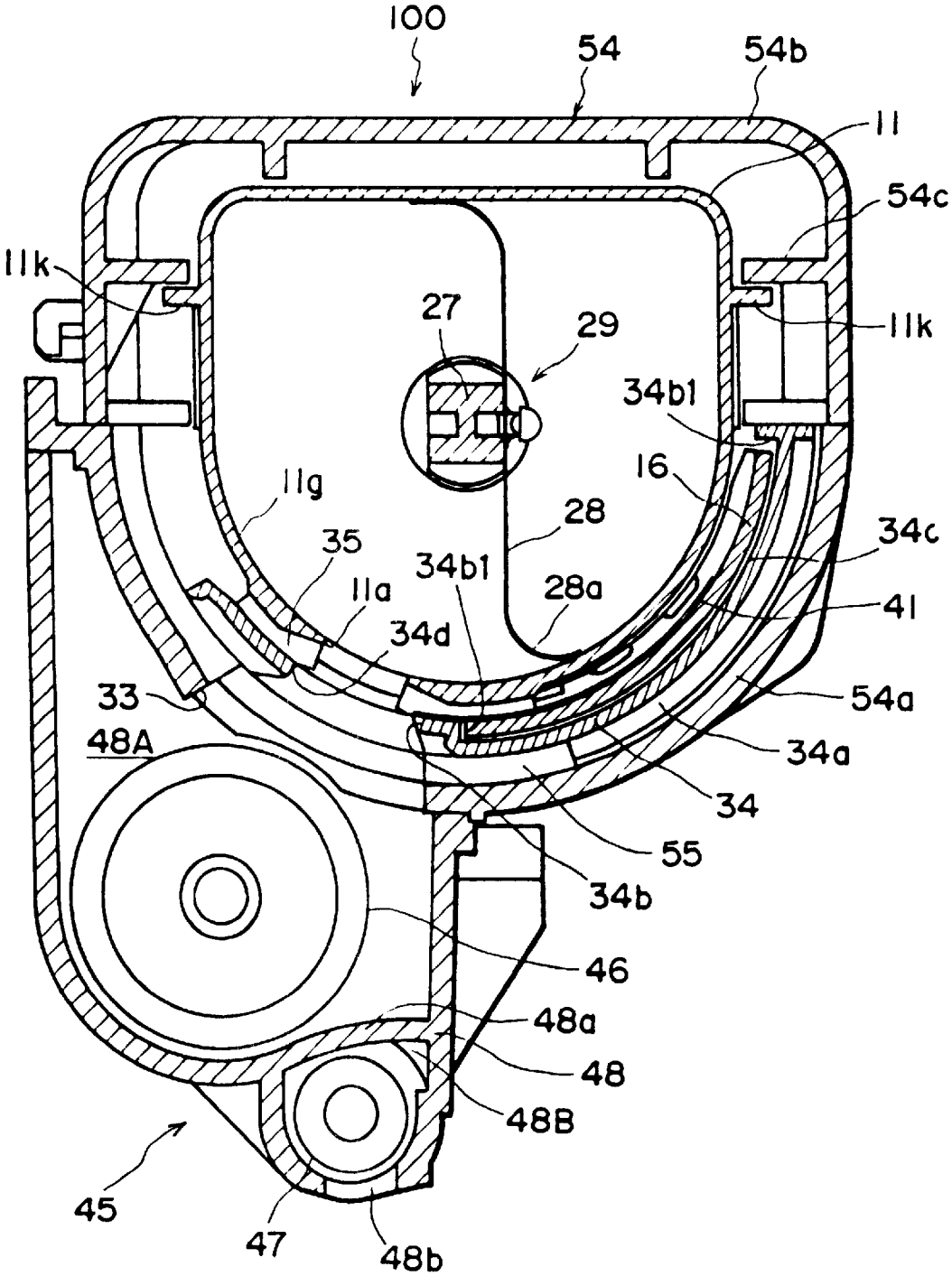
FIG. 21 is a vertical sectional view of the toner supplying apparatus, at the plane perpendicular to the longitudinal direction of the toner supplying apparatus (shutter is closed).

More specifically, as a signal which indicates that the amount of the toner in the developing apparatus 201 has become too small is sent out by a sensor (unillustrated) in the developing apparatus 201, toner conveying screws 46 and 47, illustrated in FIG. 21, rotate. As a result, the toner within a case 48 is gradually supplied to the developing apparatus 201. Then, as the amount of the toner within the developing apparatus 201 reaches a predetermined level, the toner conveying screws 46 and 47 stop. This process is repeated. Eventually, the amount of the toner within the case 48 becomes too small. Then, a signal which indicates that the amount of the toner within the case 48 has become too small is sent out by a sensor (unillustrated) within the case 48. As a result, a conveying member 29 (which will be described later) within the toner supply container 1 rotates to send the toner into the case 48. Then, as the amount of the toner within the case 48 reaches a predetermined level, the conveying member 29 stops. The process is repeated. If the toner is not supplied even though the sensor within the case 48 sends out the aforementioned signal, a message which suggests the exchange of the toner supply container 1 is displayed by the warning section 124*a*.

(Toner Supply Container)

Figure 10:
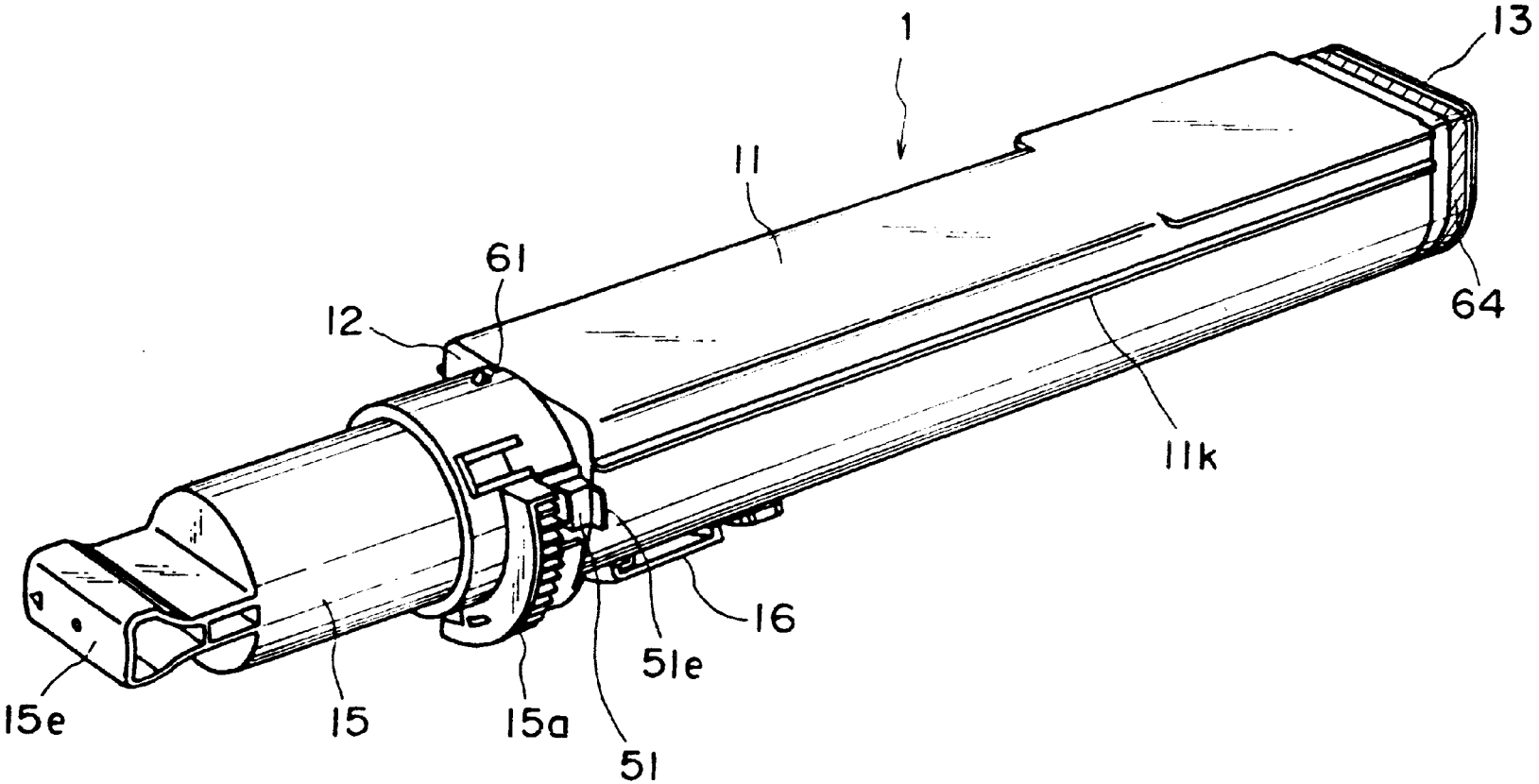
FIG. 10 is a perspective view of a toner supply container as seen from a front side in a mounting direction.

The toner supply container 1 in this embodiment (FIGS. 10–12) is installed in the toner supplying apparatus 100 in an image forming apparatus, and is left there so that the toner within the toner supply container 1 is gradually supplied to the development station until the toner within the toner supply container 1 is depleted. In other words, it is of the so-called built-in type. However, the present invention does not require that the type of the toner supply container 1 is limited to the one described above; the present invention is also applicable to, for example, a toner supply container of the so-called integral type, which not only holds toner but also supplies it to the development station.

Figure 13:
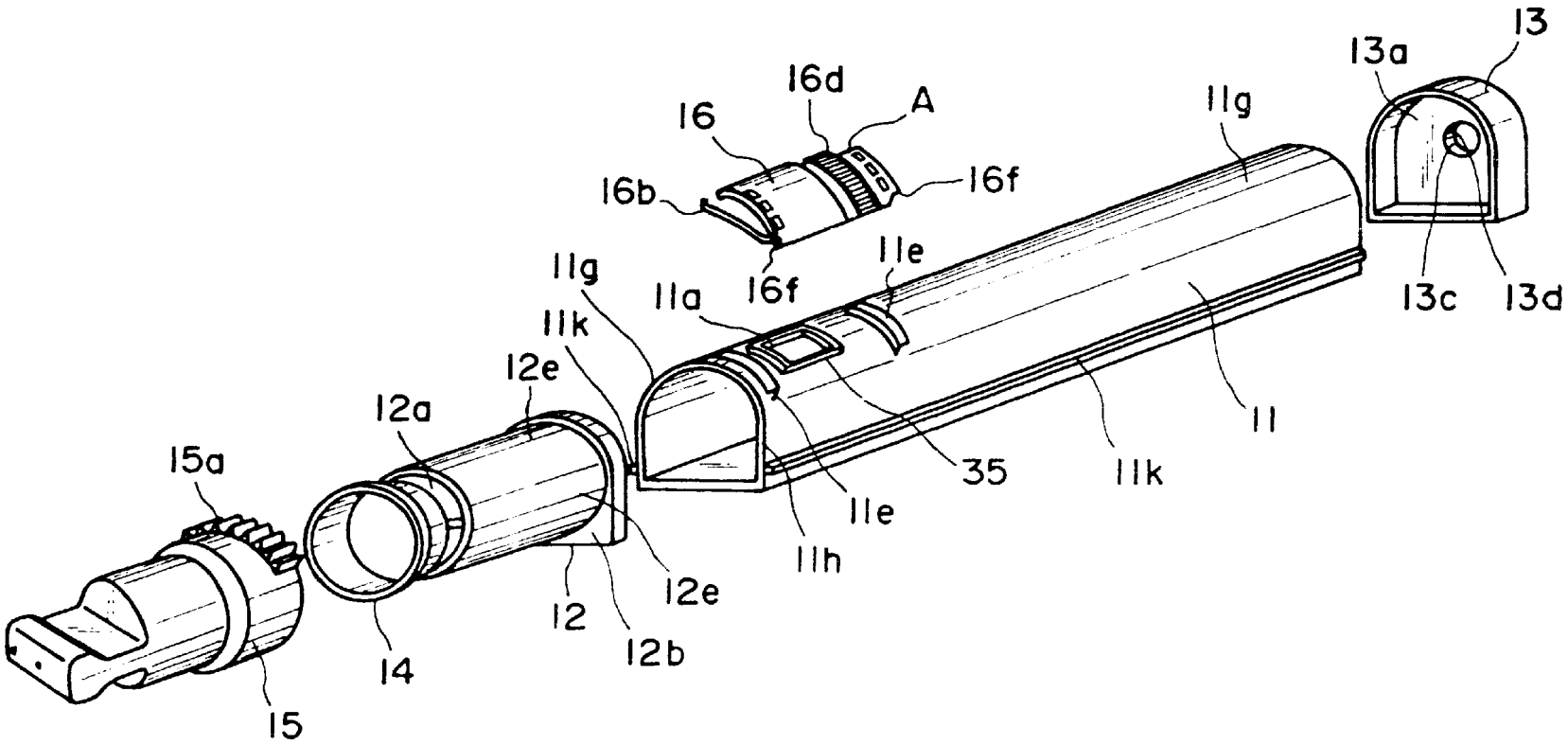
FIG. 13 is an exploded perspective view of the toner supply container.
Figure 14:
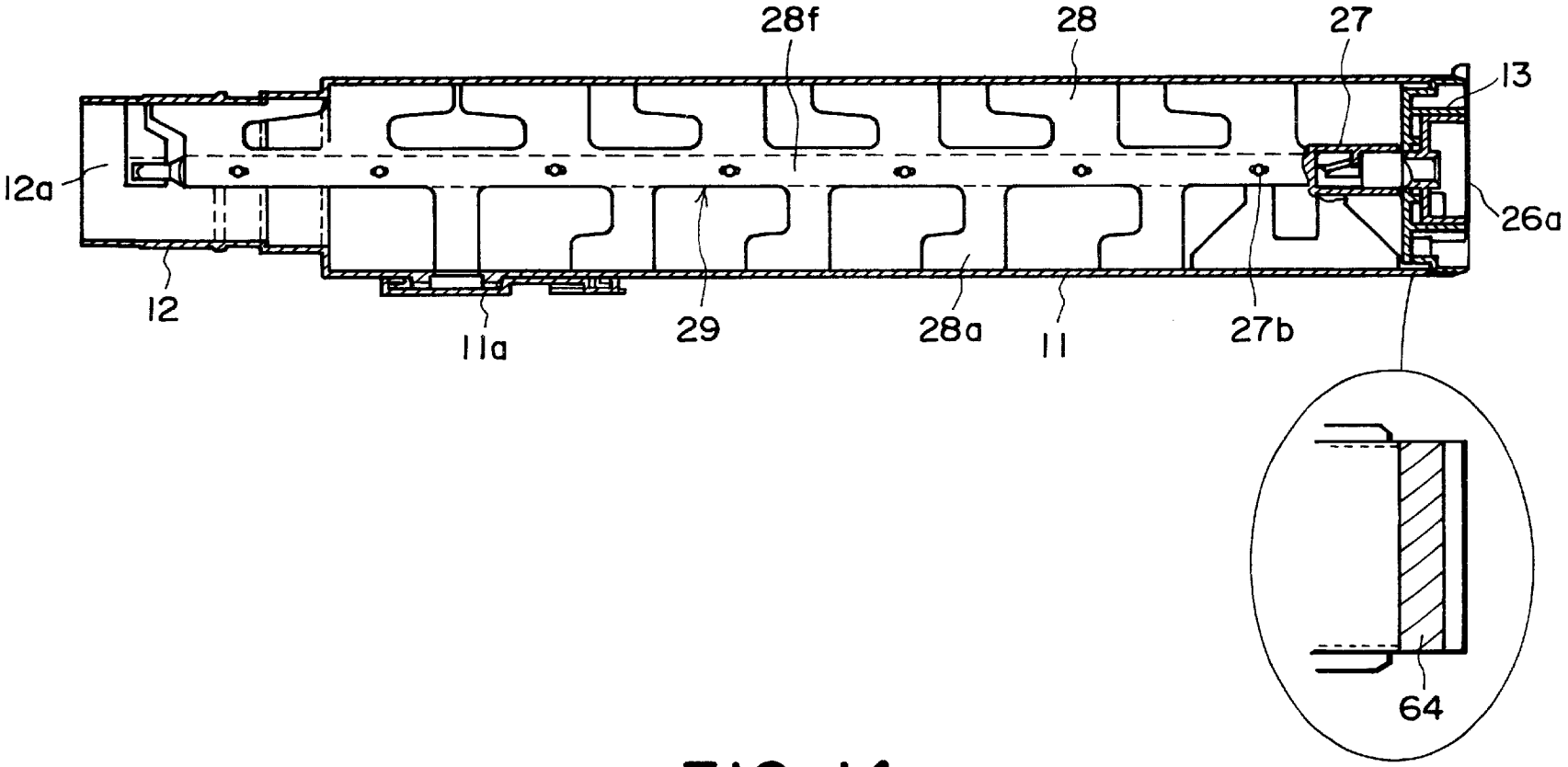
FIG. 14 is a longitudinal sectional view of the toner supply container.

Referring to FIG. 13, a schematic exploded view of the aforementioned toner supply container 1, the toner supply container 1 has a toner containing portion 11, and first and second flanges 12 and 13, respectively, which are attached to the corresponding longitudinal ends of the toner containing portion 11. It also has a cap 14 which is inserted into the first flange 12, and a handle 15, a rotational member, which is rotationally fitted around the first flange 12. Further, it has a container shutter 16 which exposes or covers the toner outlet 11*a* of the toner containing portion 11. Within the toner containing portion 11, a toner conveying member 29 is disposed as a toner conveying means (FIG. 14).

(Toner Container)

Referring to FIG. 13, the toner containing portion 11 is shaped so that its cross section perpendicular to its longitudinal direction becomes a combination of an approximately semi-circular portion 11*g* and a rectangular portion 11*h*. It is in the form of a hollow tube with the above described cross section, and the toner is stored within this toner containing portion 11. The toner containing portion 11 is provided with a toner outlet 11*a*, which is in the curved wall portion of the toner containing portion 11. The toner containing portion 11 is also provided with a pair of shutter supporting members 11*e*, which are located on the curved wall portion of the toner containing portion 11, one on the front side of the toner outlet 11*a* and the other on the rear side, in terms of the longitudinal direction of the toner containing portion 11, and extend in the circumferential direction of the toner containing portion 11. The container shutter 16 is supported by the supporting members 11*e* so that the container shutter 16 can take a closing position (FIG. 20) at which the container shutter 16 seals the toner outlet 11*a*, or an exposing position (FIG. 21) to which the container shutter 11 retreats to expose the toner outlet 11*a*.

Further, the toner containing portion 11 is provided with a pair of guiding portions 11*k*, which run in the longitudinal direction of the toner containing portion 11 along the lateral longitudinal edges of the toner containing portion 11. These guiding portions 11*k* are members which regulate the toner supply container 1 so that the toner supply container 1 moves in a straight line when the toner supply container 1 is installed into, or removed from, the toner supplying apparatus 100.

As described above, in this embodiment, the toner containing portion 11 is in the form of a tube, the cross section of which is such that its top half is semicircular and its bottom half is rectangular. However, the shape of the toner containing portion 11 does not need to be limited to the above described one. For example, the toner containing portion 11 may be shaped so that its cross section perpendicular to its longitudinal direction is circular, elliptical, or square. Further, there is no specific restriction regarding the structure and component count of the toner containing portion 11.

The toner containing portion 11 is filled with toner in the powder form (hereinafter, all toners are in the powder form). There are various classifications of toner: black toner, color toner, single component magnetic toner, single component nonmagnetic toner, and the like. From among these various classifications of toners, toner is selected as appropriate.

(Structures of First and Second Flanges 12 and 13)

The first and second flanges 12 and 13 are in the form of a hollow tube, which exactly fits into the corresponding longitudinal ends of the toner containing portion 11. After being exactly fitted into the corresponding longitudinal ends of the toner containing portion 11, they are fixed to the toner containing portion 11 with the use of adhesive to seal the toner containing portion 11. The first flange 12 comprises an end plate 12*b* and a cylindrical portion 12*e*. The axial line of the cylindrical portion 12*e* coincides with the longitudinal center line of the semicylindrical portion 11*g* of the toner containing portion 11. The first flange 12 comprises a toner inlet 12*a,* which runs within the cylindrical portion 12*e*. The second flange 13 comprises an end plate 13*a*.

The second flange 13 is detachably mountably engaged to the inner surface at the rear end edge of the toner container 11. As shown in FIG. 14, an adhesive tape 64 is stuck on the toner container 11 and the second flange 13 in the circumferential direction so as to seal the entire circumference of the circumferential seam between the toner container 11 and the second flange 13 engaged with the toner container 11 at the outside. By doing so, the second flange 13 is demountably fastened to the toner container 11, and the toner leakage through the engaging portion between the toner container 11 and the second flange 13 is prevented.

The first and second flanges 12 and 13 may be integral with the toner containing portion 11, or a part of the toner containing portion 11. In other words, the main section of the toner containing portion 11 may be a single piece component.

Figure 35:
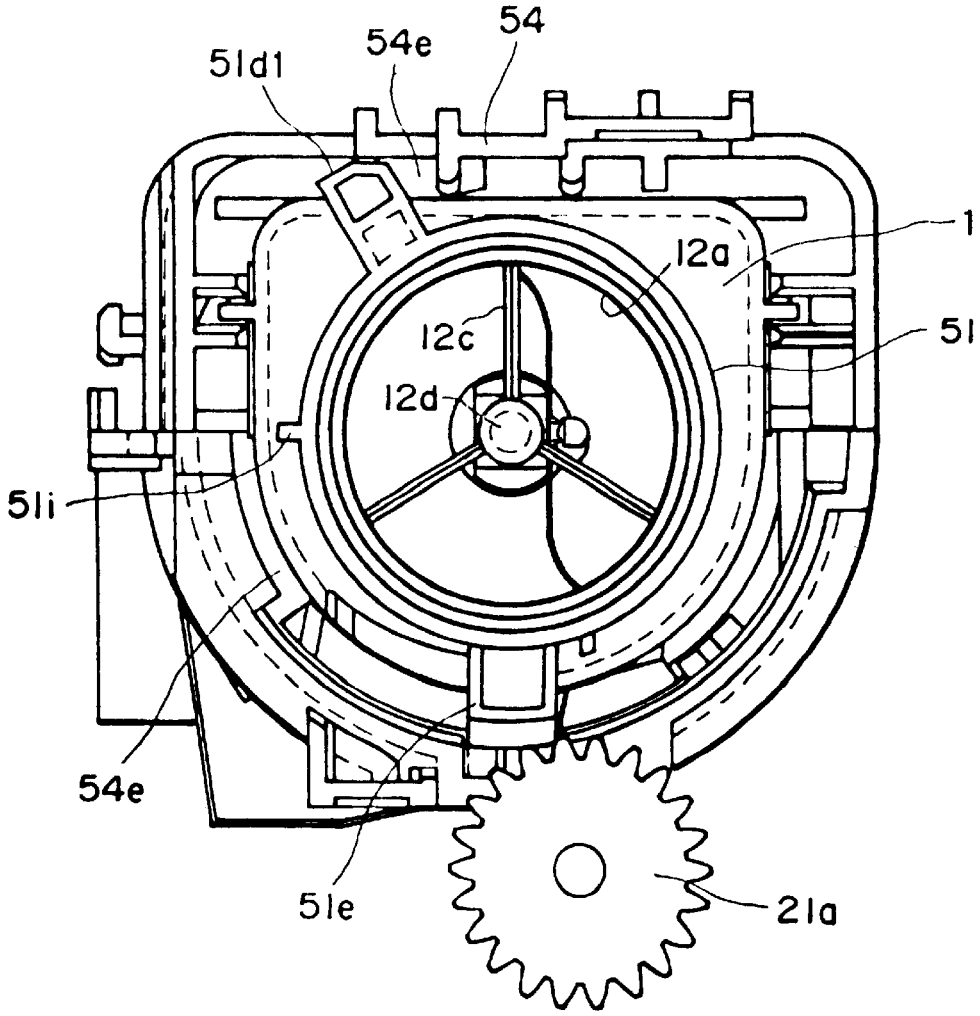
FIG. 35 is a front view of the toner supplying apparatus in which there is the toner supply container, the handle of the toner supply container being unillustrated.
Figure 36:
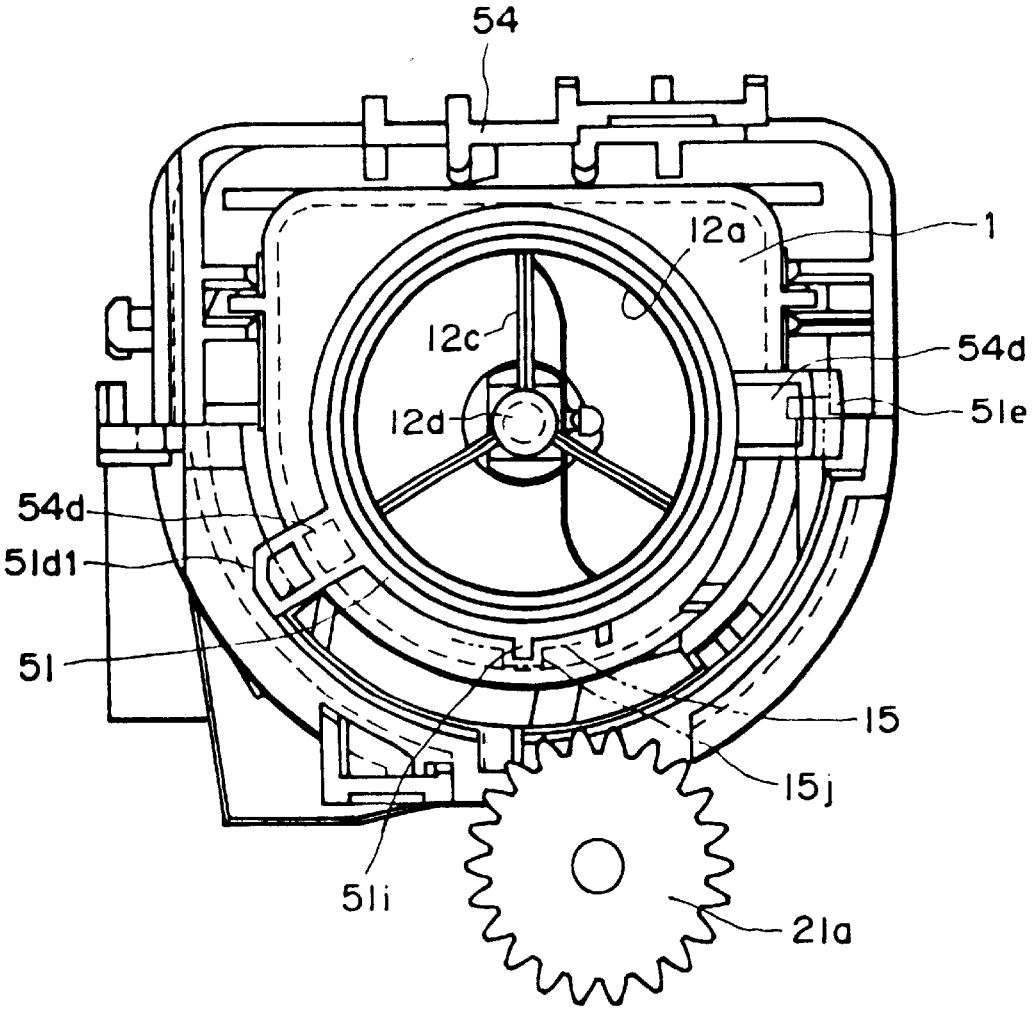
FIG. 36 is a front view of the toner supplying apparatus, which is containing the toner supply container, the handle of the toner supply container being unillustrated.

As described above, the first flange 12 is provided with the toner inlet 12*a,* the opening of which is located at the longitudinal end, on the upstream side in terms of the direction in which the toner containing portion 11 is inserted. The toner inlet 12*a* is provided with internal ribs 12*c,* which radially fit within the toner inlet 12*a* (FIGS. 35 and 36). Also, the toner inlet 12*a* is provided with a cylindrical hollow shaft, the axial line of which coincides with that of the toner inlet 12*a,* and which supports the axle of the toner conveying member which will be described later. Around the cylindrical portion 12*e,* i.e., the cylindrical wall of the toner outlet 12*a,* a handle 15, which will be described later, is fitted. After the toner is filled, the toner inlet 12*a* is sealed by fitting a cap 14 into the toner inlet 12*a*. Then, the first flange 12 is unitized with the toner containing portion 11 by an appropriate joining means.

The end plate 13*a* of the second flange 13 is provided with a hole 13*c,* into which a driving force transmitting bearing (for example, coupling) for bearing the axle of the toner conveying member 29 and also transmitting the driving force, is fitted from outside the toner containing portion 11. Further, the end plate 13*a* is provided with a cylindrical portion 13*d* (FIGS. 13 and 14), which projects outward from the outer edge of the hole 13*c* and supports the peripheral surface of the aforementioned coupling.

(Handle)

Figure 16:
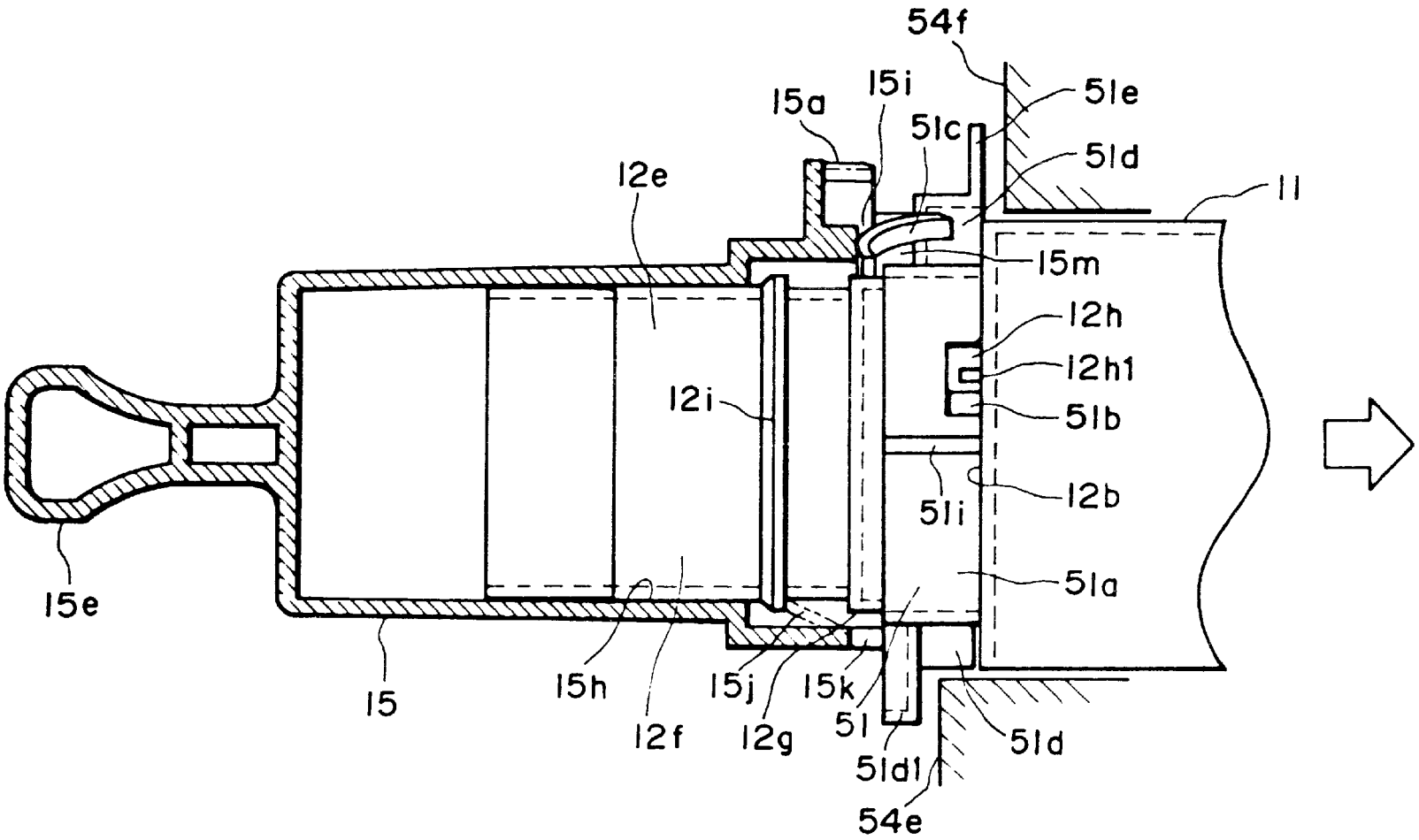
FIG. 16 is a vertical sectional view of the handle lock (in the locked state).
Figure 17:
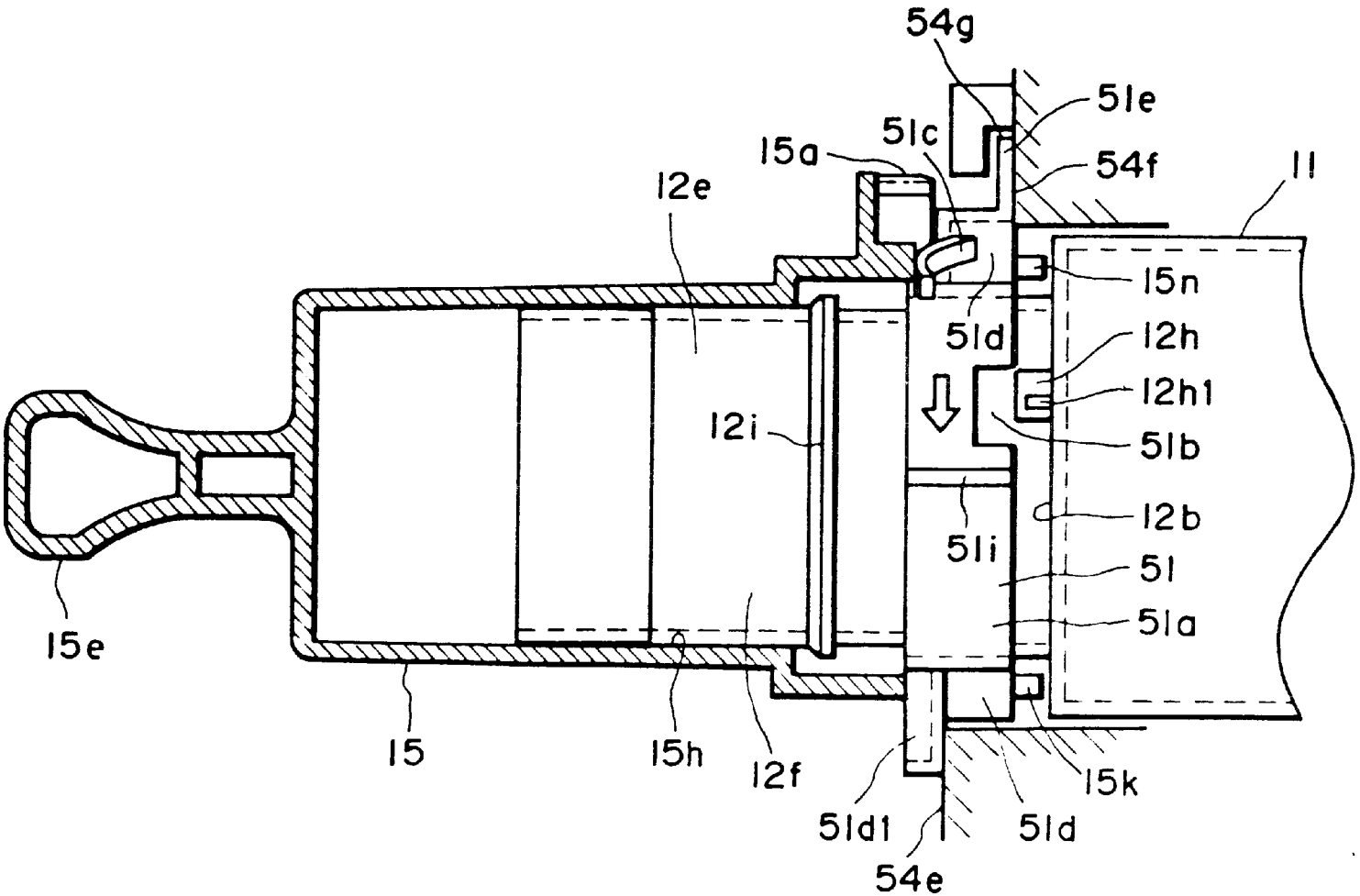
FIG. 17 is a vertical sectional view of the handle lock (in the unlocked state).

The handle 15, a rotational member, basically comprises three sections: a knob section 15*e,* a cylindrical hollow section 15*h* (middle section) with a smaller diameter, and a cylindrical hollow section with a larger diameter. The knob section 15*e* is the outward end of the handle 15, and is in the form of a thick plate with a thicker end. The cylindrical hollow section with a larger diameter is the inward end of the handle 15, and is open on the inward side. The handle 15 is rotationally attached to the toner containing portion 11 by manually fitting the middle section 15*h* around a handle supporting portion 12*f,* which is a part of the cylindrical portion 12*e* located at one of the longitudinal ends of the toner containing portion 11 (FIGS. 16 and 17). The handle 15 also comprises an engaging portion 15*a,* which is a driving force transmitting portion, for transmitting the driving force. The engaging portion 15*a* is on the outward facing surface of the handle 15.

Figure 15:
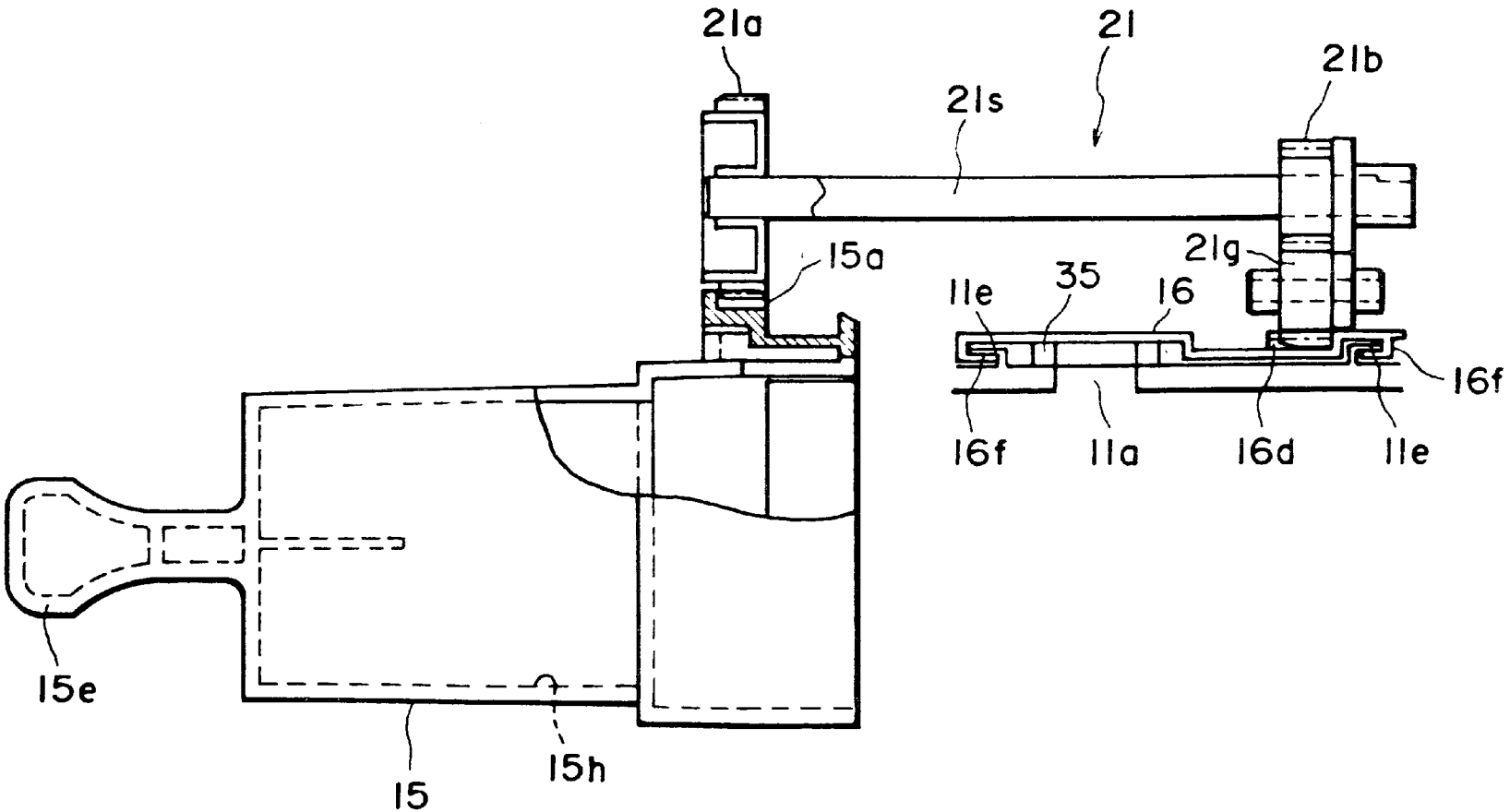
FIG. 15 is a vertical sectional view of the driving system of the toner supply container shutter.
Figure 19:
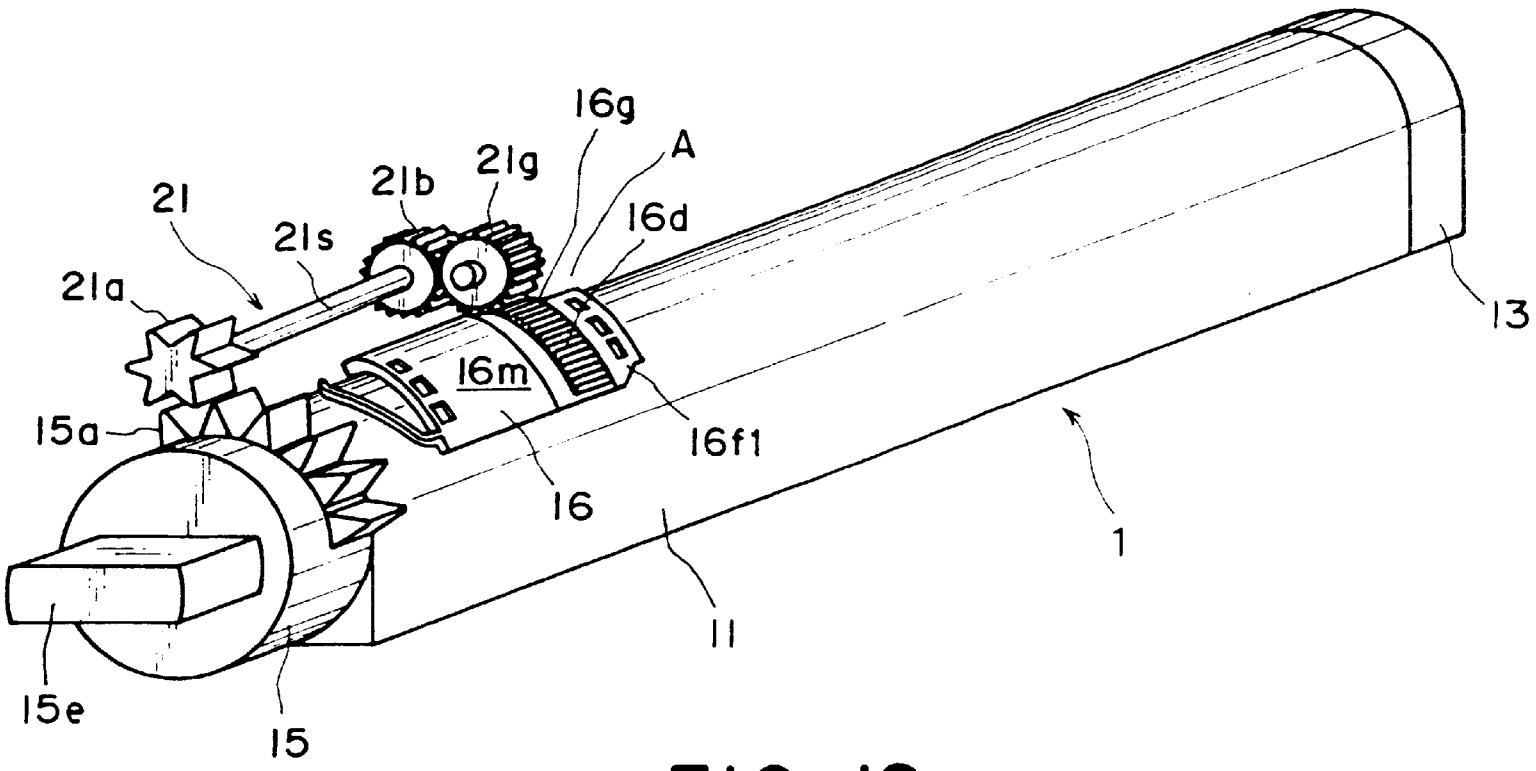
FIG. 19 is a perspective view of a toner supply container, as seen from diagonally above the upstream side in terms of its installation direction.

Referring to FIGS. 15 and 19, the engaging portion 15*a* is in the form of a segment gear so that when the toner supply container 1 is inserted into the toner supplying apparatus 100, the engaging portion la can engage with the engaging portion 21*a* of a driving force transmitting member 21 with which the toner supplying apparatus 100 is provided. The engaging portion 15*a* is engageable with the engaging portion 21*a* through a sequential operation for inserting the toner supply container 1.

Also referring to FIGS. 15 and 19, the diving force transmitting member 21 as a rotational force transmitting means comprises a shaft 21*s,* the engaging portion 21*a* for receiving the driving force, and an engaging portion 21*b* for transmitting the driving force. The shaft 21*s* is fitted with the engaging portions 21*a* an 21*b,* one for one at its longitudinal ends, and is rotationally supported by the toner supplying apparatus 100. The engaging portions 21*a* and 21*b* comprise gears with multiple teeth. The engaging portion 21*a* on the driving force reception side in this embodiment comprises a single gear. However, there is no specific restriction regarding the structure or gear count of the engaging portion 21*a* as long as it is structured to function as a mechanism for receiving the driving force. The engaging portion 21*b* on the driving force transmission side is meshed with the engaging portion 21*g* on the driving force transmission side as an idler gear which is meshed with the engaging portion 16*d,* a segment gear, on the driving force reception side. In this embodiment, the driving force transmitting member 21, a member comprising the shaft 21*s,* and engaging portions 21*a,* 21*b* and 21*g,* is provided on the apparatus main assembly 124 side of the image forming apparatus.

(Toner Conveying Member)

Referring to FIG. 14, one end of a shaft 27 (supporting member) for supporting the toner conveying member 29 (stirring member) is rotationally borne by the hole 12*d* (FIG. 37), and the other end of the shaft is borne by the bearing 13*d* fitted in the shaft hole 12*d* so that the rotational driving force is transmitted through the coupling 26*a* fixed to this end of the shaft 27. Further, the toner conveying member 29 comprises a toner conveying wing 28 (stirring blade), which is a flexible member fixed to the shaft 27. The coupling 26*a* is rotationally supported by the toner containing portion 11.

Figure 20:
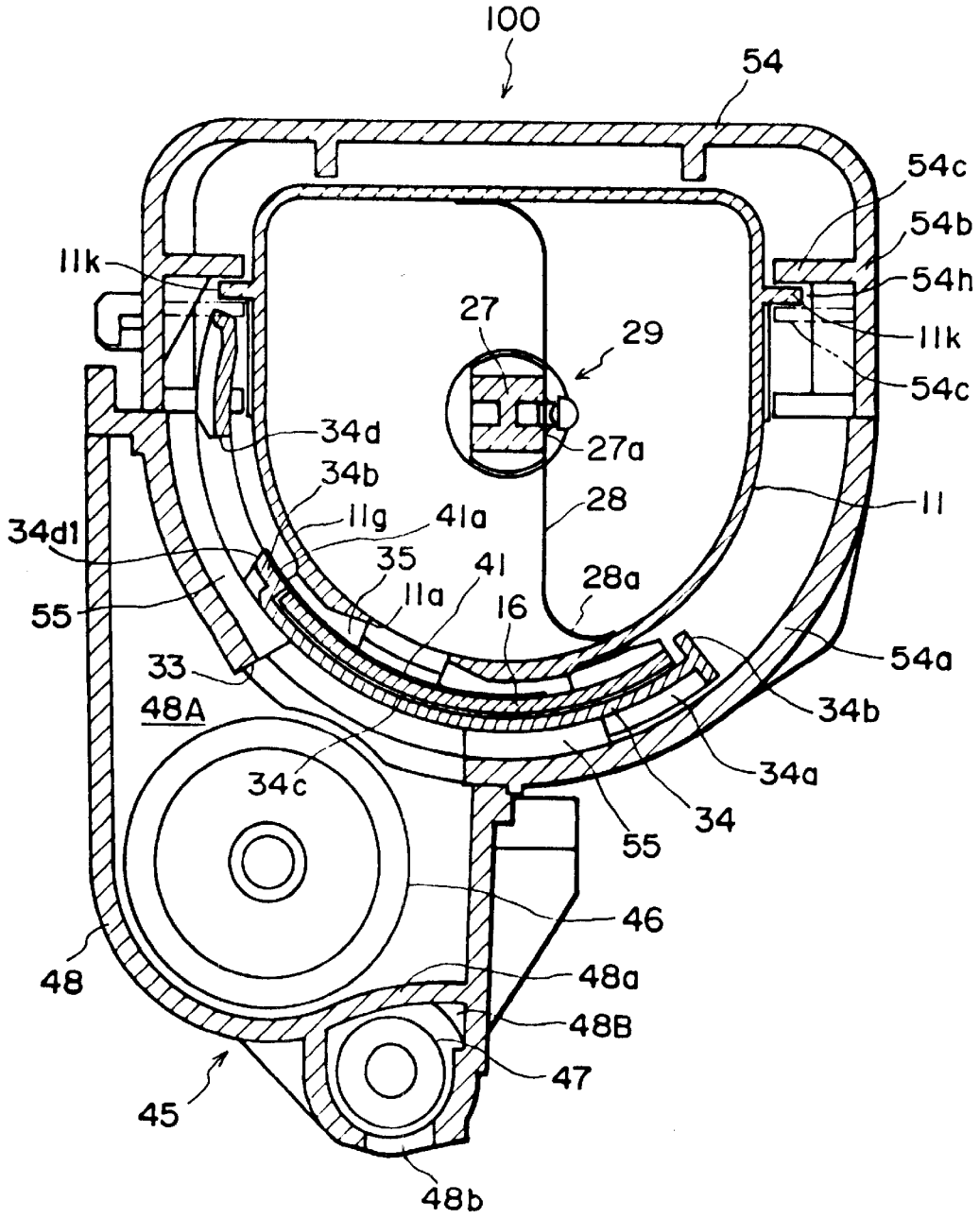
FIG. 20 is a vertical sectional view of a toner supplying apparatus, at a plane perpendicular to the longitudinal direction of the toner supplying apparatus (shutter is open).

As shown in FIG. 14, the feeding blade 28 comprises a flexible sheet having integral claw portion 28*a* and mounting portion 28*f*. The claw portion 28*a* is projected toward the toner discharging opening 11*a* and is slidable against the inner surface of the toner container 11. When feeding blade 28 is not assembled into the device, it is in the form of a flat plate. The mounting portion 28*f* is elongated along the feeding shaft 27 and has surface which is parallel with a flat surface portion 27*a* (FIG. 20) which is parallel with the axis of the feeding shaft 27. A plurality of claw portions 28*a* are provided at both sides of the mounting portion 28*c* with inclination with clearances, and the claw portions 28*a* at one side of the mounting portion 28*f* are alternate with the claw portions 28*a* at the other side. The base portion of the claw portions 28*a* and the mounting portion 28*f* is parallel with the surface of the drawing of FIG. 14. The claw portion 28*a,* when it is not used, as shown in FIG. 20, is so curved that when the feeding blade 28 is rotated in the clockwise direction, the free end side moves with delay. When the feeding blade 28 rotates, the free end sides of the claw portions 28*a* are inclined relative to the axial direction of the feeding shaft 27 as will be described hereinafter.

Figure 44:
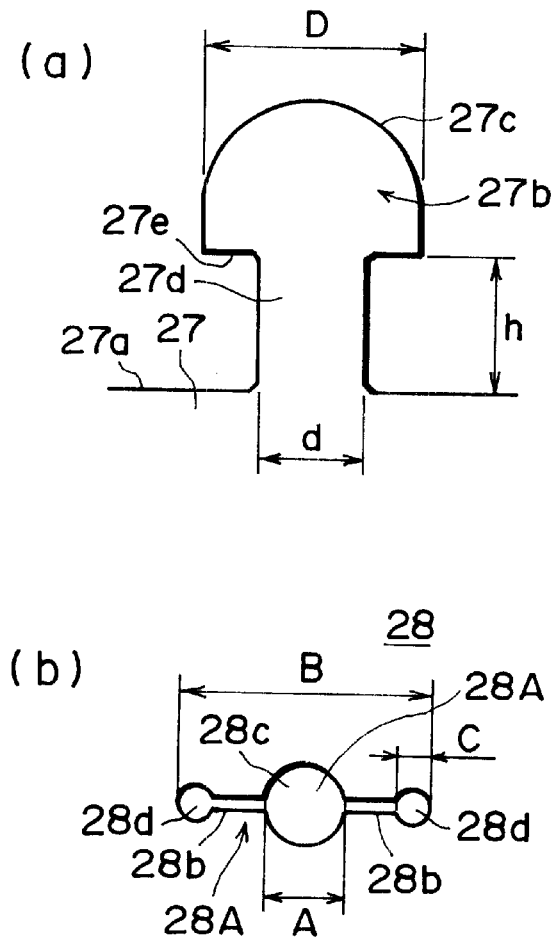
FIGS. 44(*a*) and 44(*b*) are schematic illustrations of a locking portion between a toner feeding shaft and a toner feeding blade, wherein FIG. 44(*a*) is a cross-section taken along a plane including the axis, and FIG. 44(*b*) is a side view of a toner feeding blade.

The feeding blade 28 is locked to the feeding shaft 27, as shown in FIGS. 44(*a*), 44(*b*), 45. More particularly, the feeding shaft 27 is provided with a plurality of bosses 27*b* for fastening the feeding blades 28, the bosses 27*b* being arranged in the axial direction. The feeding blade 28 is provided with openings having holes 28*c,* 28*d* at the position corresponding to the bosses 27*b* and a slit 28*b* connecting them. By penetrating the bosses 27*b* through the holes 28*c*, 28*d* and the slits 28*b*, the feeding blade 28 is fixed to the feeding shaft 27. The boss 27*b* is provided with a large diameter portion 27*c* at a position remote from the shaft portion of the feeding shaft 27 and with a small diameter portion 27*d* at a position near the shaft portion. By such a structure, the feeding blade 28 can be easily demounted from the feeding shaft 27.

The boss 27*b* is integrally molded with the feeding shaft 27. The feeding shaft 27 is made of synthetic resin material, aluminum die-cast or the like. The large diameter portion 27*c* of the boss 27*b* is at the free end, and the small diameter portion 27*d* is at the base side, and the boss 27*b* is erected from the flat surface portion 27*a* of the feeding shaft 27. Therefore, the boss 27*b* extends away from the center of rotation of the feeding shaft 27. As shown in FIG. 14, the bosses 27*b* are provided correspondingly to the claw portions 28*a*, respectively.

The boss 27*b* has a configuration having a large diameter portion 27*c* which is semi-spherical at the free end and cylindrical contacting to the sphere at the base side. A stepped portion 27*e* is provided between the small diameter portion 27*d* and the large diameter portion 27*c*. The small diameter portion 27*d* is cylindrical. In this example, large diameter portion 27*c* and the small diameter portion 27*d* have a common center line on a plane perpendicular to the center of rotation of the feeding shaft 27.

On the other hand, the feeding blade 28 is provided with a slit or hole portion 28A as shown in FIG. 44. The hole portion 28A is provided in the mounting portion 28*f*. The hole portion 28A has slits 28*b*, an engaging hole 28*c* and end holes 28*d*. The slit 28*b* is elongated in the same direction as the axis of the stirring shaft 27. The slit 28*b* connects the engaging hole 28*c* and the end hole 28*d*. The engaging hole 28*c* and the end hole 28*d* are on a straight line parallel with the axial direction of the feeding shaft 27. The engaging hole 28*c* is engaged with the small diameter portion 27*d* of the boss 27*b*.

Here,

A: the diameter of the engaging hole 28*c* of the feeding blade,

B: the total width of the hole portion 28A of the feeding blade,

C: the diameter of the end hole 28*d* of the feeding blade,

D: the diameter of the large diameter portion 27*c* of the boss, d: the diameter of the small diameter portion 27*d* of the boss (the smallest diameter of the small diameter portion 27*d*), and h: the height of the small diameter portion 27*d* of the boss, satisfy:

$$B>A+2C>D,\ d>A,\ 2h>D-A,\ 2h>d-A \quad (1).$$

The advantageous effects are as follows.

The toner feeding member 29 comprises the feeding shaft 27 and flexible feeding blades 28; the feeding shaft 27 is provided with bosses 27*b* for fixing the feeding blade 28 thereto; the feeding blade 28 is provided with holes 28*c*, 28*d* and slits 28*b* connecting them at the positions corresponding to the bosses 27*b*; and the feeding blade 28 is fixed to the feeding shaft 27 by penetrating the bosses 27*b* through the holes 28*c* and slits 28*b*.

With such a structure, when the feeding shaft is rotated, the feeding blade is retained on the feeding shaft, and when the feeding blade is to be exchanged, it can be easily dismounted from the feeding blade.

Figure 45:
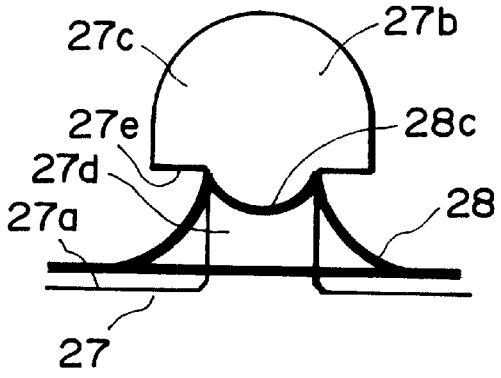
FIG. 45 is a schematic side view illustrating locking between a toner feeding shaft and a toner feeding blade.

When a fresh feeding blade 28 is mounted to the feeding shaft 27, the engaging holes 28*c* of the feeding blade 28 are aligned with the large diameter portions 27*c* of the bosses 27*b*, and the portions of the feeding blade 28 slightly away from the engaging hole 28*c* are pushed by the fingertips toward the flat surface portion of the feeding shaft 27, by which the engaging hole 28*c* is expanded to A+Fair A=D and is engaged into the small diameter portion 27*d* of the boss. Since d>A, the periphery of the engaging hole 28*c* deforms upwardly as shown in FIG. 45. Since the bosses 27*b* and the hole portions 28A are positioned in alignment with each other, the feeding blade 28 is fixed on the feeding shaft 27 in place by engaging the bosses 27*b* and the hole portions 28A.

It is preferable that portion 28*f* of the mounting is press-contacted to the flat surface portion 27*a* of the feeding shaft 27 such that inequations (1) are satisfied. The periphery of the engaging hole 28*c* of the feeding blade 28 is press-contacted to a corner of the stepped portion 28*e* of the small diameter portion 27*d*.

In the process of exchanging only the feeding blade 28, one axial end portion of the feeding blade 28 is gripped and pulled in the axial direction, by which the feeding blade 28 is removed from the feeding shaft 27, since the holes 28*c*, 28*d* and the slits 28*b* are arranged in the axial direction.

At this time, the small diameter portion 27*d* of the boss 27 enters the slit 28*b* from the engaging hole 28*c* of the hole portion 28A, by which the slit 28*b* is expanded in the width, and the engaging hole 28*c* is expanded in the diameter. Then, the mounting portion 28*f* of the feeding blade 28 is bended away from the feeding shaft 27 at the engaging hole 28*c* side, the bosses 27*b* are sequentially removed from the hole portions 28A, starting at the end.

With this structure, the feeding blade does not fall out of the feeding shaft during rotation of the feeding shaft, and upon the exchange, the feeding blade can be easily dismounted from the feeding shaft.

The boss 27*b* of the feeding member 29 has such a configuration that large diameter portion 27*c* is at a position remote from the shaft portion and the small diameter portion 27*d* is near the shaft portion, and the boss is penetrated to such an extent that small diameter portion 27*d* reaches the slit 28*b* and the engaging hole 28*c* of the feeding blade 28, by which the feeding blade 28 is fastened to the shaft portion.

With this structure, the feeding blade does not fall out of the feeding shaft during rotation of the feeding shaft, and upon the exchange, the feeding blade can be easily dismounted from the feeding shaft.

With another structure, the diameter or the width (A) of the engaging hole 28*c* provided in the feeding blade 28 is smaller than the diameter or the width (d) of a thinnest portion of the boss 27*b* of the feeding shaft 27.

With this structure, the feeding blade does not fall out of the feeding shaft during rotation of the feeding shaft, and upon the exchange, the feeding blade can be easily dismounted from the feeding shaft.

In the feeding member 29, the total width (B) of the hole portion engaged with the boss 27*b* is larger than the diameter or the width (D) of the large diameter portion 27*c* of the boss 27*b*.

Here, the total width of the hole portion 28A is measured along the axial direction of the stirring shaft 27. That is, B>A+2C>D.

With this structure, the feeding blade does not fall out of the feeding shaft during rotation of the feeding shaft, and upon the exchange, the feeding blade can be easily dismounted from the feeding shaft.

With another structure, one half of the difference between the diameter or width (d) of the small diameter portion 27*d* of the boss 27*b* and the diameter or the width (A) of the engaging hole 28*c* is smaller than the height (h) of the small diameter portion 27*d* of the boss 27*b,* in the feeding member 29. That is, 2h>D−A.

With this structure, the feeding blade does not fall out of the feeding shaft during rotation of the feeding shaft, and upon the exchange, the feeding blade can be easily dismounted from the feeding shaft.

With a further structure, one half of the difference between the diameter or the width (D) of the large diameter portion 27*c* of the boss 27*b* and the diameter or the width (A) of the engaging hole 28*c* is smaller than the height (h) of the high of the small diameter portion 27*d.*

With this structure, the feeding blade does not fall out of the feeding shaft during rotation of the feeding shaft, and upon the exchange, the feeding blade can be easily dismounted from the feeding shaft.

When the diameters of the engaging hole 28*c,* the large diameter portion 27*c* of the boss 27*b* and the small diameter portion 27*d* are selected in the relationships described above, the cross-sections thereof are circular. If the configuration is non-circular, the minimum width portions satisfy the above-described inequations (1).

The toner conveying wing 28 rubs against the inward surface of the toner containing portion 11. The toner conveying wing 28 comprises a plurality of segments with a winglet 28*a*. The toner outlet 11*a* side of the winglet 23*a* is bent away from the rotational direction of the toner conveying wing 28 so that the toner in the toner containing portion 11 can be conveyed toward the toner outlet 11*a*. The toner outlet 11*a* is located on the upstream side in terms of the direction in which the toner supply container 1 is inserted into the apparatus main assembly 124. Thus, all winglets 28*a* extend in the same direction. However, it is not mandatory that all winglets 28*a* extend in the same direction; the winglets 28*a* may be different in their extending direction, depending on the positioning of the toner outlet 11*a*. After the toner supply container 1 is inserted into the toner supplying apparatus 100, the aforementioned coupling 26*a* receives the driving force by meshing with the coupling 44 (FIG. 28) provided on the toner supplying apparatus 100 side, and rotates the toner conveying member 29.

Figure 18:
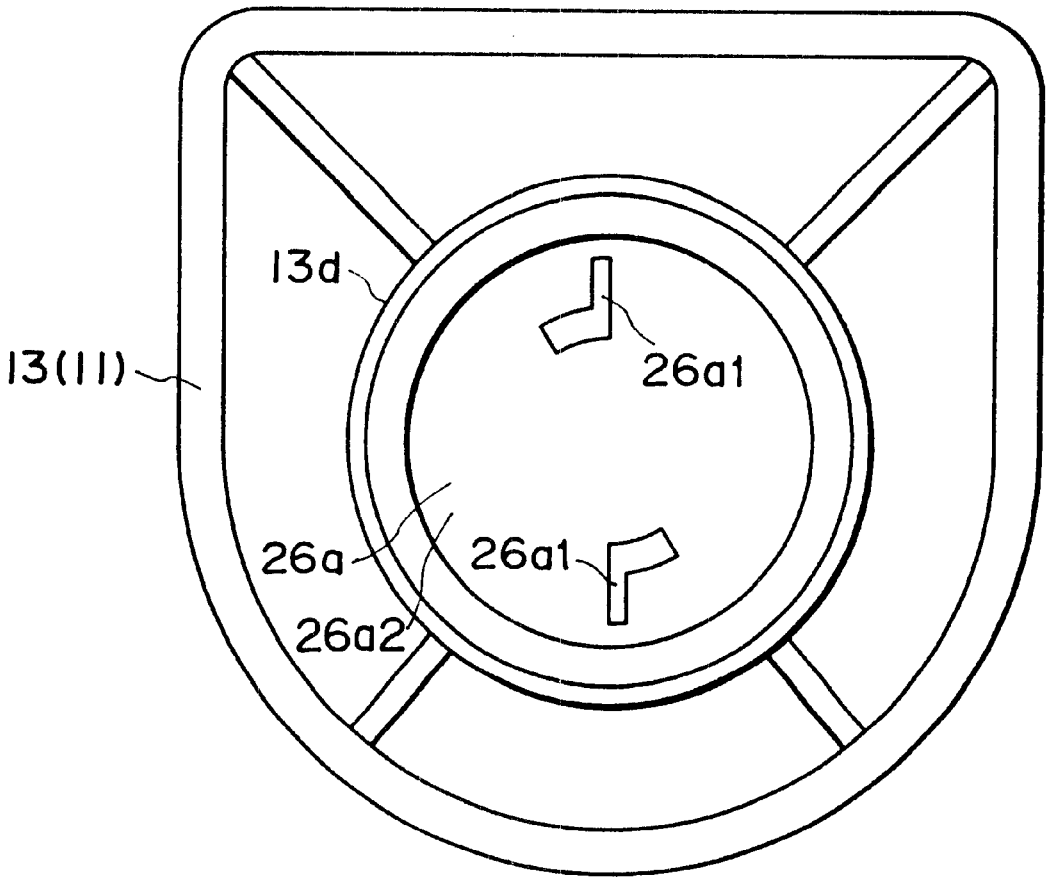
FIG. 18 is a rear view of the toner supply container.

Next, referring to FIG. 18 which depicts the driving force receiving end portion of the toner supply container 1, a coupling 26*a* as a driving force receiving member is rotationally supported by the end plate of the toner containing portion 11. Both ends of the coupling 26*a* in the axial direction are in the form of a shaft coupler. One end of the coupling 26*a* is positioned within the toner containing portion 11, and is coupled with one end of the shaft 27 of the toner conveying member 29, whereas the other end of the coupling 26*a,* which is positioned outside the toner containing portion 11, is provided with a rotational force receiving portion. As the toner supply container 1 is installed into the apparatus main assembly 124, this rotational force receiving portion couples with the coupling 44 provided on the toner supplying apparatus 100 side to transmit the rotational force. The rotational force receiving portion is in the form of a projection 26*a*1, a part of which extends in the radial direction of the coupling 26*a*. The couplings 26 and 44 couple with each other as the projections 44*a* of the coupling 44 fit into the two spaces 26*a*2 between the two projections 26*a*1, one for one.

(Container Shutter)

Referring to FIG. 15, the container shutter 16 is provided with a pair of sliding portions 16*f,* which are located at the longitudinal ends, in terms of inserting direction of the toner supply container 1, of the container shutter 16, one for one. The sliding portions 16*f* engage, one for one, with a pair of shutter supporting members 11*e* as guiding members which extend on the toner containing portion 11 in the circumferential direction of the toner containing portion 11 along the curved edges of the toner outlet 11*a,* one on the front side and the other on the back side of the outlet 11*a,* in terms of the inserting direction of the container 1. The container shutter 16 slides in the circumferential direction of the toner containing portion 11 to expose or seal the toner outlet 11*a*. More specifically, the cross section of the container shutter 16 perpendicular to the longitudinal direction of the toner supply container 1 is in the form of an arc, the curvature of which is such that the container shutter 16 perfectly fits along the outer surface of the cylindrical portion 11*g* of the toner containing portion 11. As for the sliding portions 16*f* and shutter supporting members 11*e,* their cross section at a plane which includes the axial line of the theoretical hollow cylinder to which the container shutter 16 belongs, are in the form of an interlocking hook (FIG. 15). The shape of the cross section of shutter supporting member 11*e,* i.e., the interlocking hook, is the same across the entire length of the member.

Figure 29:
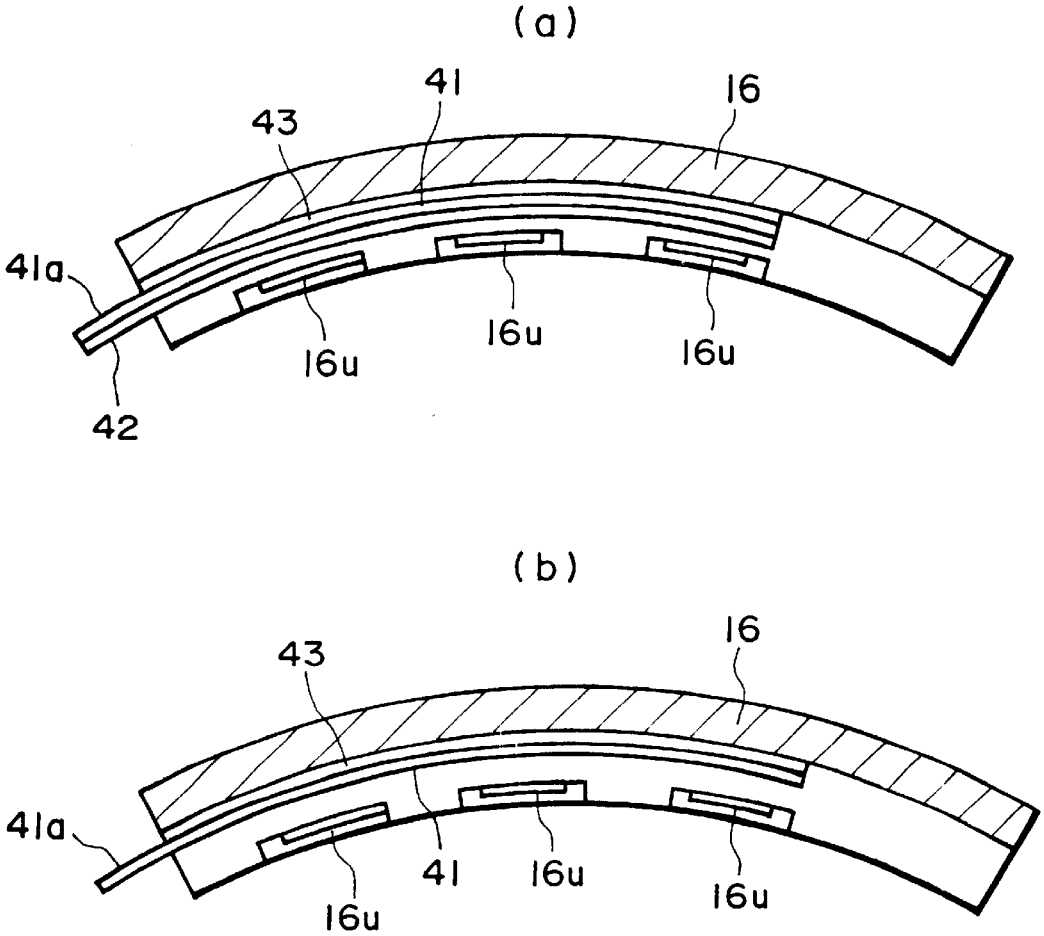
FIG. 29(*a*) and FIG. 29(*b*) are vertical sectional views of a toner supply container shutter, at a plane perpendicular to the longitudinal direction of the toner supply container.
Figure 30:
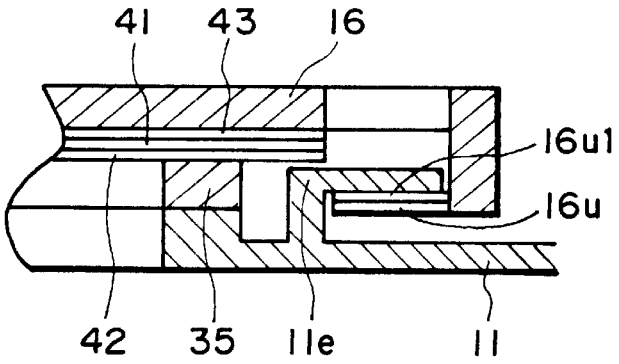
FIG. 30 is a vertical sectional view of an essential portion of the essential portion of the toner supply container shutter, at a plane perpendicular to the sectional plane of FIG. 29(*a*).
Figure 43:
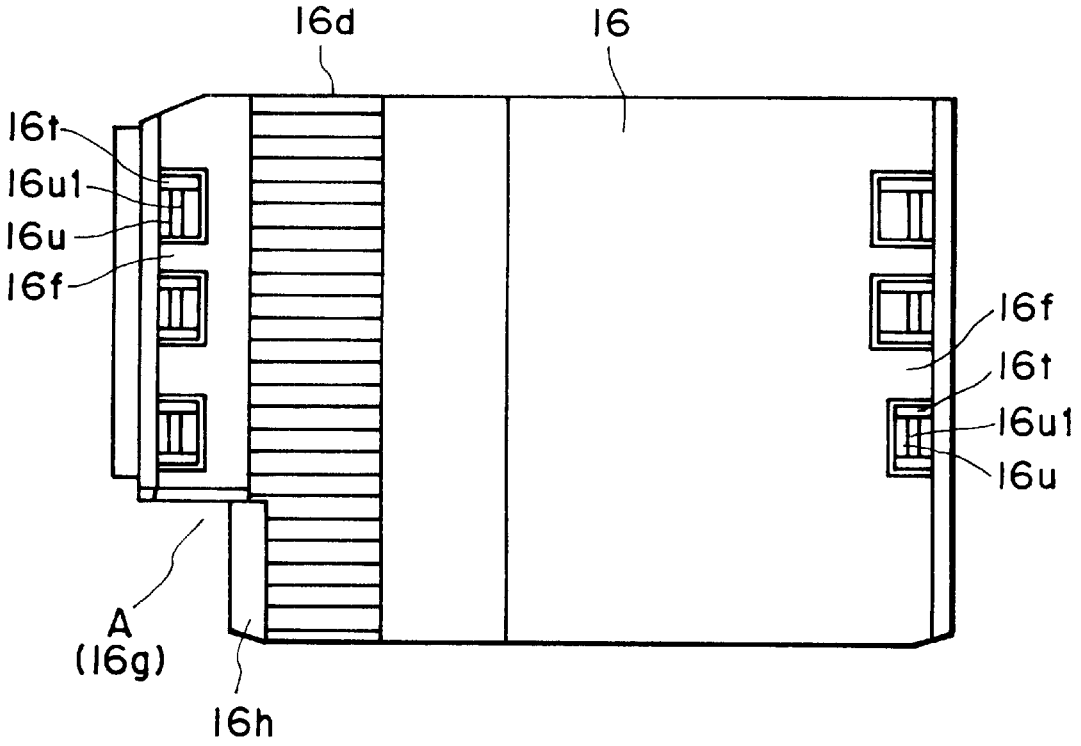
FIG. 43 is a plan view of the toner supply container shutter.

Referring to FIGS. 29(*a*), 29(*b*) 30, 38, 39 and 43, the sliding portion 16*f* is provided with a plurality of small hook-like horizontal projections 16*u* which extend inward, relative to the toner outlet 11*a,* from the upright base portion of the sliding portion 16*f.* The locations of these hook-like horizontal projections 16*u* correspond one for one with the locations of the plurality of through holes 16*t* cut through the container shutter 16 along its curved edges. Referring to FIG. 43, each of these horizontal hook-like projections 16*u* is provided with a tiny projection 16*u*1 in the form of a character H or T (projects toward the reader side of this page), which is located on the surface of the projection 16*u,* which faces the shutter supporting member 11*e*. Each projection 16*u* functions as an elastic member which generates a predetermined amount of pressure for keeping the container shutter 16 tightly in contact with the elastic packing 35. Therefore, even if the pressure which each projection 16*u* receives from the elastic packing 35 varies depending upon the location of the container shutter 16 during the opening or closing of the container shutter 16, the presence of the plurality of projections 16*u* averages out the amount of pressure which keeps the container shutter 16 in contact with the elastic packing 35 (FIG. 30).

Referring to FIG. 19, the container shutter 16 is provided with the aforementioned driving force receiving engaging portion 16*d* as a member for receiving the rotational force which is enabled to engage with a gear as the aforementioned driving force transmitting engaging portion 21*g* as the toner supply container 1 is installed into the toner supplying apparatus 100. This engaging portion 16*d* is provided with a plurality of teeth, and is enabled to engage with the driving force transmitting engaging portion 21*g* through a sequence of operations for inserting the toner supply container 1 into the toner supplying apparatus 100. The driving force receiving engaging portion 16*d* is cut in the outer surface 16 m of the container shutter 16. In other words, the diameter of the theoretical circle which includes the tooth tips of the segment gear, and the diameter of the theoretical circle which includes the outer surface of the container shutter 16 are rendered practically the same so that space can be saved in terms of the radial direction of the toner supply container 1. Since the engaging portion 16*d* must be engaged, or disengaged, with the driving force transmitting engaging portion 21*g,* it is cut in the outer surface of the container shutter 16, close to the curved edge on the coupling 26*a* side. With this arrangement, the engaging portion 16*d* engages with, or disengages from, the driving force transmitting engaging portion 21*g* when the container shutter 16 is in the closed state. As described before, the driving force transmitting engaging portion 21*g* with which the toner supplying apparatus 100 is provided, and the driving force receiving portion 16*d* with which the container shutter 16 is provided, are engaged through a sequence of operations for inserting the toner supply container 1 into the toner supplying apparatus 100. Therefore, the sliding portion 16*f* (16*f*1) of the container shutter 16, on the side where the coupling 26*a* is provided, is made shorter than the driving force receiving engaging portion 16*d* (portion designated by a referential character A in FIGS. 13, 19 and 43). In other words, the sliding portion 16*f*1 is desired to be configured so that the plane of the edge surface 16*h* of the container shutter 16, on the downstream side in terms of the longitudinal direction of the toner containing portion 11, which squarely faces the driving force transmitting engaging portion 21*g* when the toner supply container 1 is inserted into the toner supplying apparatus 100, coincides with the plane of the surfaces of the teeth of the driving force receiving engaging portion 16*d,* on the downstream side in terms of the inserting direction of the toner supply container 1. Therefore, in this embodiment, a portion 16*g* is removed to shorten the sliding portion 16*f*1. Of the two surfaces created by removing the portion 16*g,* the one perpendicular to the longitudinal direction of the toner containing portion 11 is the aforementioned edge surface 16*h.* With this arrangement, the driving force transmitting engaging portion 21*g* and the container shutter 16 do not interfere with each other.

When the container shutter 16 is thick, the sliding portion 16*f*1 is extended across the entire curved edge of the container shutter 16, and in order to prevent the driving force transmitting engaging portion 21*g* from colliding with the sliding portion 16*f*1, the sliding portion 16*f*1 is provided with an indentation as an equivalent of the aforementioned missing portion 16*g* to allow the driving force transmitting engaging portion 21*g* to pass.

Figure 11:
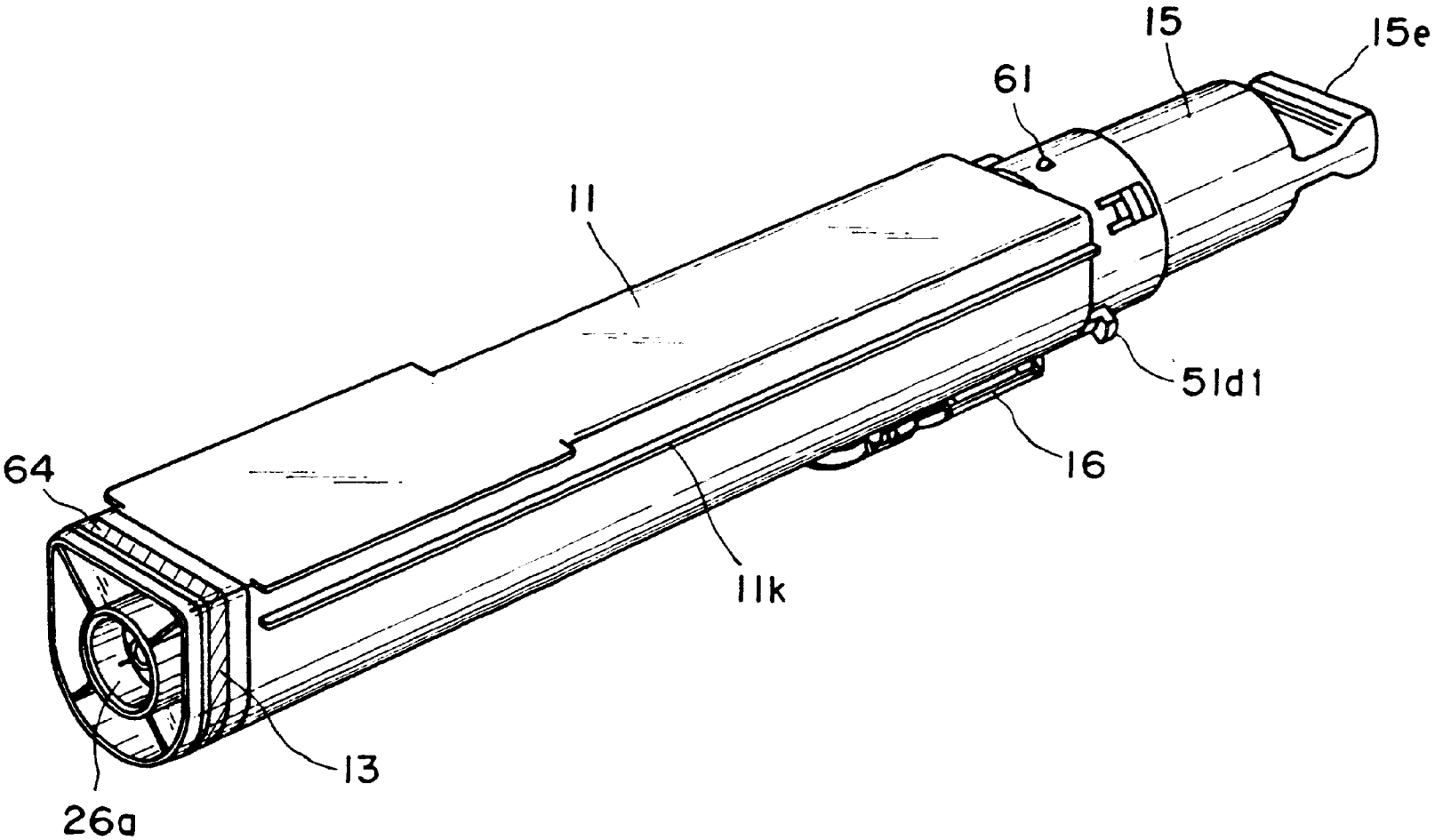
FIG. 11 is a perspective view of the toner supply container in the opposite direction.

Referring to FIG. 11, the container shutter 16 fits in an indented portion 34*c* formed between the surfaces 34*b*1 of the shutter 34 on the main apparatus side, which exposes or seals the toner inlet 33 with which the toner supplying apparatus 100 is provided. Being fitted in the indented portion 34*c,* the container shutter 16 can cause the shutter 34 on the main apparatus side to slide as the container shutter 16, which is on the side of the toner supply container 1, is slid.

Figure 12:
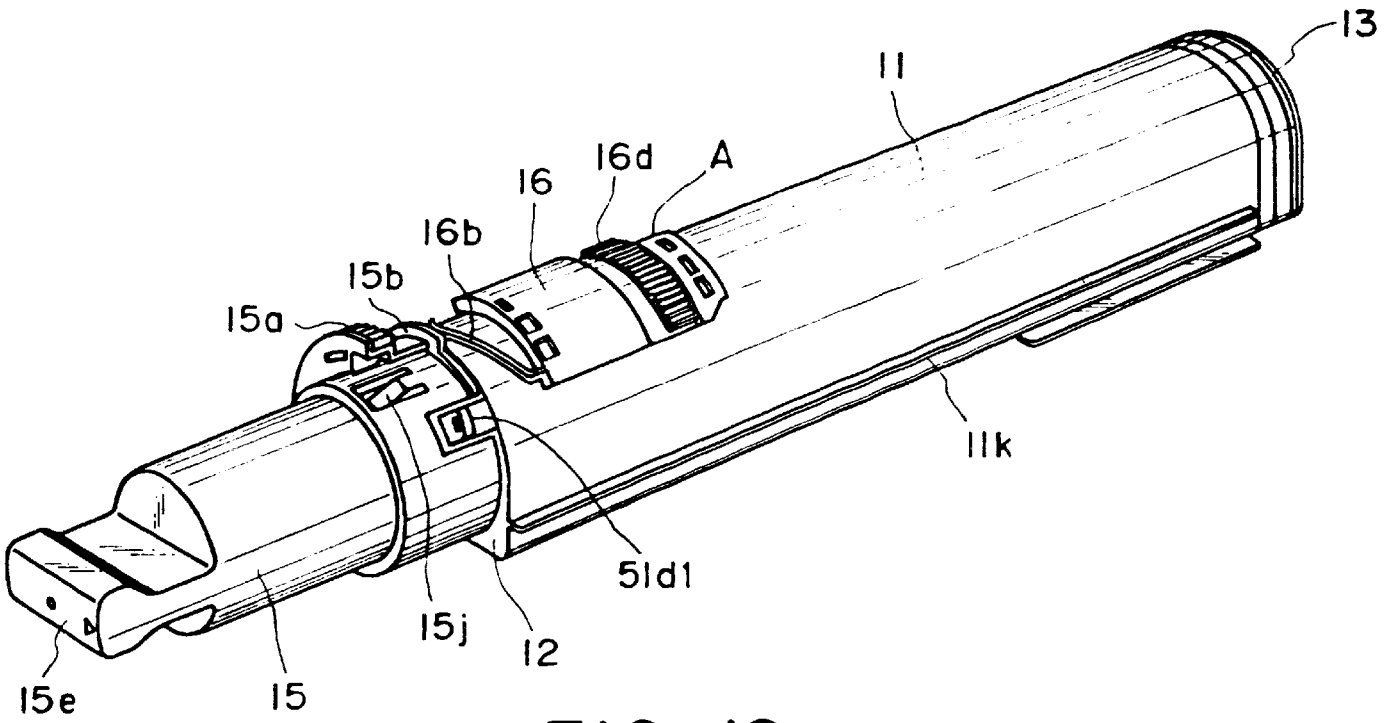
FIG. 12 is a perspective view of the toner supply container as seen from diagonally below the downstream side of its installation direction.

In this embodiment, the engaging portion 21*b* and 21*g* on the driving force transmitting side, with which the apparatus main assembly 124 is provided, comprise two gears as shown in FIG. 15. However, as long as a driving force transmitting mechanism is provided, there is no specific restriction regarding its structure, or the number of gears it comprises. Referring to FIG. 12, the container shutter 16 is provided with an elastic portion 16*b* in the form of an arm which generates such pressure that constantly applies to the handle 15 in the longitudinal direction of the toner containing portion 11. The tip of this elastic portion 16*b* is in contact with the flange 15*b* of the handle 15.

(Toner Supplying Apparatus)

Figure 22:
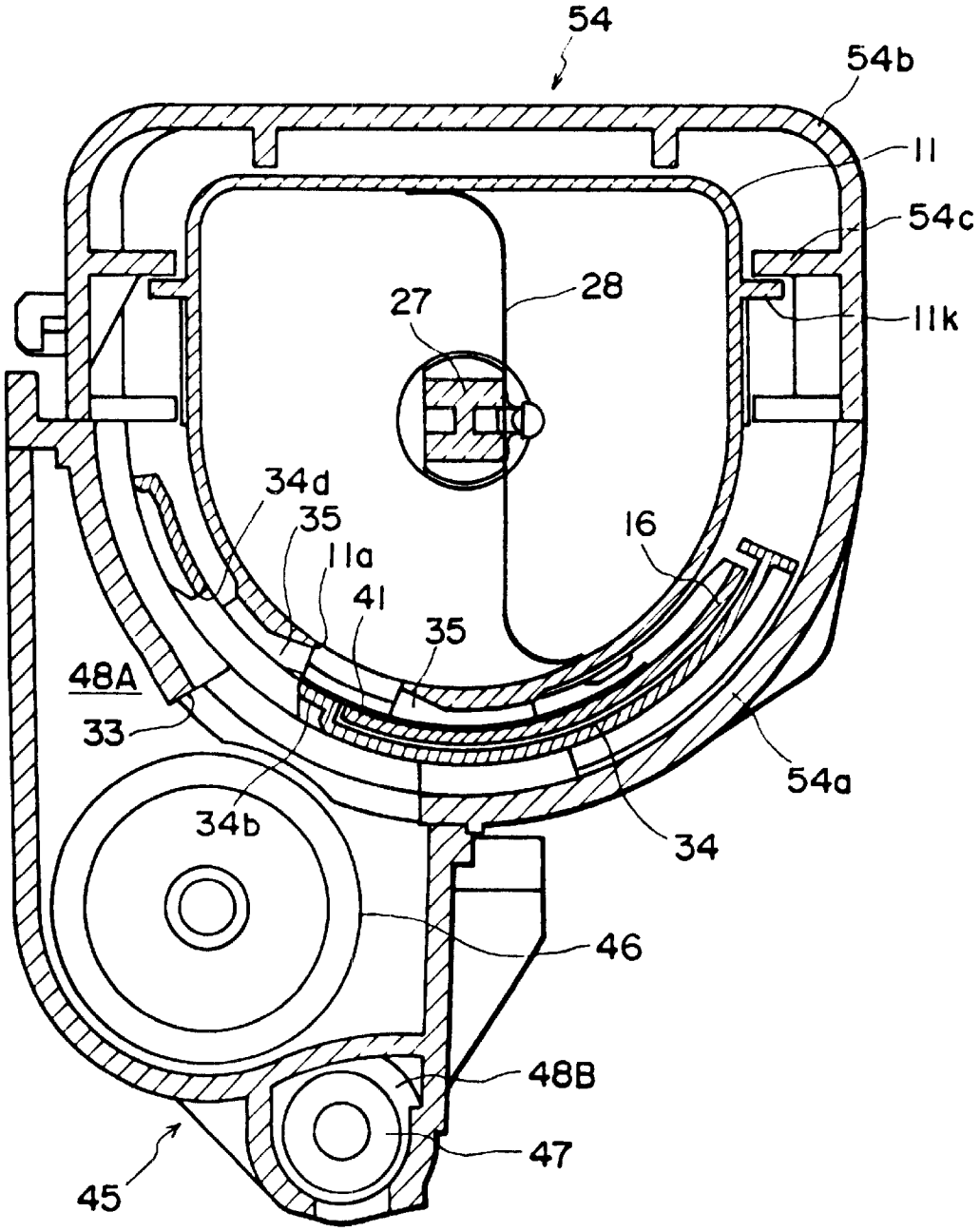
FIG. 22 is a vertical sectional view of the toner supplying apparatus, at the plane perpendicular to the longitudinal direction of the toner supplying apparatus (shutter is being opened or closed).

Referring to FIGS. 20–22, the toner supplying apparatus 100 is provided with a toner supplying apparatus main assembly 54, a cartridge receiving portion, which comprises a bottom portion 54*a* and a top portion 54*b,* the cross sections of which in the direction perpendicular to their lengthwise directions are semicircular and rectangular, respectively, to accommodate the toner containing portion 11. The top portion 54*b* is provided with a plurality of projections 54*c* for guiding a pair of guide portions 11*k* of the toner supply container 1. The projections 54*c* are on the inner surface of the top portion 54*b.* One pair of the projections 54*c* are at the entrance of the toner supplying apparatus main assembly 54, one for each side, and the other pairs are aligned inward of the toner supplying apparatus main assembly 54, one half the pairs being above the line correspondent to the position of the guide portion 11*k* and the other half being below the same line. The bottom portion 54*a* is provided with a pair of parallel guide rails 55, which are in the inwardly facing surface of the bottom portion 54*a* and extend in the circumferential direction of the bottom portion 54*a.* The guides 34*a* of the main assembly shutter 34 are engaged one for one in these guide rails 55. The guide rails 55 and the guide 34*a* are hook-like in their cross section, and interlock with each other. As is evident from the above description, there are two guide rails 55 and two guides 34*a,* which are parallel to each other. In other words, the main assembly shutter 34 is supported by the toner supplying apparatus main assembly 54. The radius of the inwardly facing surface of the projection 34*b* of the main assembly shutter 34 is exactly or approximately the same as that of the inwardly facing surface of the container shutter 16. The main assembly shutter 34 is provided with a pair of projections 34*b,* which are located at both edges, one for one, perpendicular to the moving direction of the main assembly shutter 34. The main assembly shutter 34 is provided with a main assembly shutter opening 34*d.* This opening 34*d* has only to be able to expose or seal the toner supply inlet 33; there may be only one cross section, i.e., a section 34*d*1. The width of inwardly facing surface of the main assembly shutter 34, between the two projections 34*b,* in the circumferential direction of the main assembly 54, is approximately the same as the width of the inwardly facing surface of the container shutter 16 in the circumferential direction of the main assembly 54. Therefore, as the toner supply container 1 is inserted into the toner supplying apparatus 100, it perfectly fits into the space 34*c* between the two projections 34*b* of the main assembly shutter 34, which project inward in the radial direction of the toner supply container 1; the two edges of the container shutter 16, which extend in the longitudinal direction of the main assembly 54, come virtually in contact with the corresponding inwardly facing surfaces 34*b*1 of the projections 34*b.* Therefore, as the container shutter 16 is opened or closed, the main assembly shutter 34 moves with the container shutter 16. Thus, if the two shutters 16 and 34 are designed so that the toner outlet 11*a* and the toner supply inlet 33 align with each other, as the container shutter 16 is opened, the toner can be supplied into the developing device 204 by a toner stirring-conveying apparatus 45. The main assembly shutter opening 34*d* and the space 34*c* are immediately adjacent to each other in the circumferential direction of the main assembly shutter 34, being bordered by the projection 34*b.*

(Packing Member)

The packing member 35 as a sealing member is an elastic member (FIGS. 13, 20–26). It assures that the toner outlet 11*a* is airtightly sealed by the container shutter 16. For example, it prevents the toner within the toner containing portion 11 from leaking due to the impact caused by the falling or the like of the toner supply container. For effectiveness, the packing member 35 is pasted to the outwardly facing surface of the toner containing portion 11 in a manner of surrounding the toner outlet 11*a*. More specifically, the material for the packing member 35 is rubbery material such as silicon rubber, urethane rubber, foamed polyethylene rubber, or the like, or sponge made of these rubbers. Preferably, it is slightly foamed polyurethane which is 20–70 deg. in hardness, no more than 10% in permanent compressive deformation, 60–300 μm in cell size, 0.15–0.50 g/ in density, and 5–50% in compression ratio.

The packing member 35 is shaped so that the top surface of the portion next to the longitudinal edges of the toner outlet 11*a* is slanted downward toward the toner outlet 11*a*.

The packing member 35 shaped as described above is fixed to the surfaces adjacent to the toner outlet 11*a* with the use of adhesive or the like.

(Sealing Member)

As the toner supply container 1 is installed into the toner supplying apparatus 100, the container shutter 16 fits into the indentation 34*c* (space between the two projections 34*b*) of the main assembly shutter 34. The indentation 34*c* extends across the main assembly shutter 34 in the longitudinal direction, and the surface 34*b*1 functions as the guide for the container shutter 16. After the container shutter 16 is fitted in the indentation 34*c* of the main assembly shutter 34, the plane of the inwardly facing surface of the projection 34*b*, i.e., the brim of the main assembly shutter opening 34*d*, and the plane of the inwardly facing surface of the container shutter 16 are at approximately the same level. Referring to FIGS. 20–26, the container shutter 16 is provided with a sealing member 41, which is on the surface on the container side. In order to cover the inwardly facing surface of the projection 34*b* next to the toner inlet 33 of the main assembly shutter 34, the sealing member 41 is extended downstream, in terms of the closing direction of the container shutter 16, beyond the container shutter 16. The sealing member 41 is a member for preventing the toner from entering the gap g between the container shutter 16 and the main assembly shutter 34. As long as this objective is accomplished, the material, shape, size, and method of attachment, of the sealing member 41 are optional.

As for the preferable structure for the sealing member 41 in this embodiment, a piece of 125 μm thick polyester sheet is pasted, as a sealing member, to the container shutter 16 with the use of double-sided adhesive tape (#5000NC: Nitto Denko Co., Ltd. FIGS. 29(*a*) and 29(*b*).

More specifically, since the sealing member 41 is structured to cover the projection 34*b* of the main assembly shutter 34 as described before, it is desired not to interfere with the installation or removal of the toner supply container 11 by hanging up or colliding. The main assembly shutter 34 is not necessarily smooth on the container facing surface. But, the sealing member 41 is required to perfectly conform to the container facing surface of the main assembly shutter 34. Because of requirements such as the above, the sealing member 41 is desired to be formed of flexible sheet or sheet formed of elastic material.

As for the method for attaching the sealing member 41, any of various known attaching means may be employed in addition to the aforementioned double-sided adhesive tape as long as it satisfies the requirement that the sealing member 41 does not peel off in spite of repetitive opening and closing of the container shutter 16 which occurs as the toner supply container 1 is repeatedly installed or removed.

It is most preferable that elastomer be used as the material for the sealing member 41, and the sealing member 41 be integrally formed with the container shutter 16 by two color injection molding. In such a case, it is desired that the elastomer for the sealing member 41 and the material for the container shutter 16 are compatibly selected. Also, the sealing member 41 and container shutter 16 may be formed of the same material. In such a case, they can be integrally formed with the use of a simple method.

(Function of Sealing Member)

Next, the function of the sealing member 41 will be described.

Figure 28:
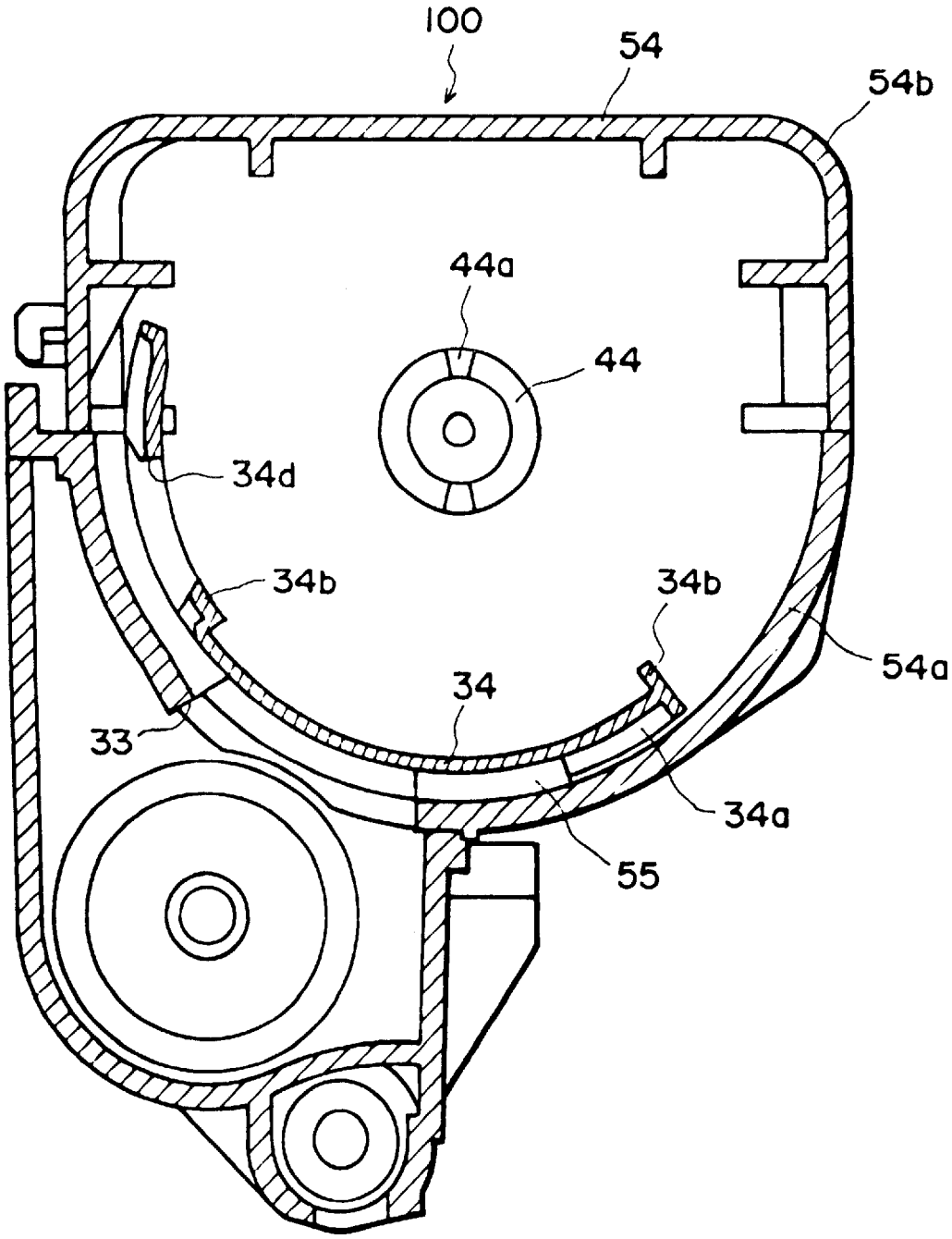
FIG. 28 is a vertical sectional view of the toner supplying apparatus, at a plane perpendicular to the longitudinal direction of the toner supplying apparatus, in which there is no toner supply container.

The state of the main assembly of the toner supplying apparatus 100 when the toner supply container 1 has been removed, that is, when the container shutter 16 is not in engagement with the main assembly shutter 34 is as shown in FIG. 28. In this state, the main assembly shutter 34 is positioned to seal the toner inlet 33 to prevent foreign substances such as dust from entering the toner supply container 1 through the toner inlet 33.

FIG. 21 shows the state in which the toner supply container 1 has been installed, and the toner is being replenished. In this state, the container shutter 16 has retreated from the toner outlet 11*a*, allowing a passage to be formed through the toner outlet 11*a*, main assembly shutter opening 34*d*, and toner inlet 33. Also in this state, the plane of the container facing surface of the container shutter 16 and the plane of the container facing surface of the projection 34*b* next to the opening 34*d* of the main assembly shutter 34 is at approximately the same level. Therefore, the sealing member 41 is in contact with the projection 34*b* of the main assembly shutter 34, keeping the toner passage airtight, and at the same time, preventing the toner from adhering to the surface of the projection 34*b* of the main assembly shutter 34. Also in this state, the toner having been stored in the toner supply container 1 is conveyed toward the toner stirring-conveying apparatus 45, i.e., a toner receiving apparatus, by the function of the toner conveying member 29 contained in the toner supply container 1 through the toner outlet 11*a*, opening 34*d*, and toner inlet 33 through which the toner passage has been established.

Figure 23:
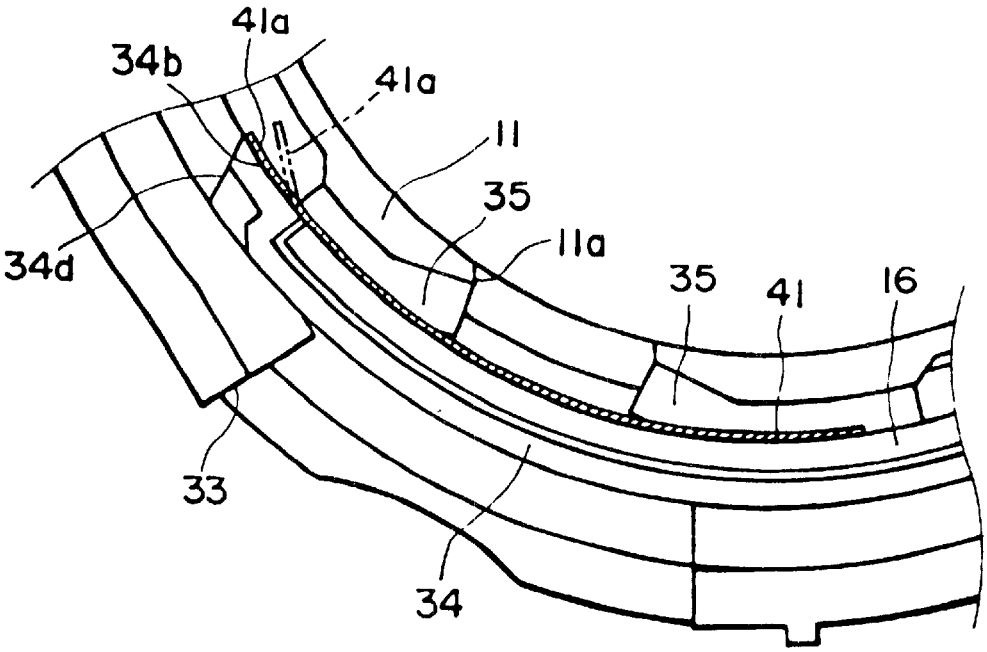
FIG. 23 is an enlarged view of an essential portion of FIG. 20.
Figure 24:
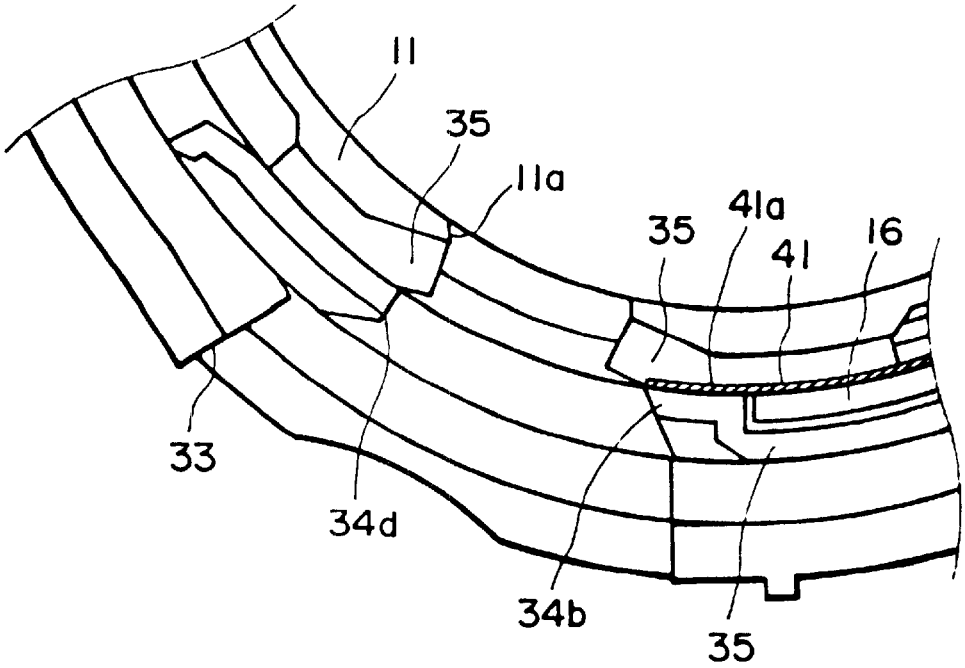
FIG. 24 is an enlarged view of an essential portion of FIG. 21.

Referring to FIGS. 23 and 24, which are enlarged drawings of the portions in FIGS. 20 and 21, respectively, even if the end portion of the sealing member 41 is pinched between the projection 34*b* of the main assembly shutter 34 and the packing member 35 while the shutters 16 and 34 are moved in the opening direction from the positions in FIG. 23 to the positions in FIG. 24, the airtightness of the toner passage at this location is not broken, because the sealing member 41 is formed of thin PET sheet. For assurance, the thickness of the sealing member 41 is desired to be no less than 50 μm and no more than 300 μm, preferably, no less than 70 μm and no more than 200 μm, and ideally, 125 μm. If the sealing member is excessively thick, it fails to properly seal the gap between the main assembly shutter 34 and toner supply container 1. On the other hand, if it is excessively thin, it fails to properly perform its primary function, that is, the function to prevent the toner from entering between the container shutter 16 and main assembly shutter 34. As a result, various problems occur while the toner supply container 1 is handled, in particular, while the toner supply container 1 is installed into, or removed from, the toner supplying apparatus 100. For example, the sealing member 41 is peeled back or wrinkled.

The requirement regarding the thickness of the sealing member 41 can be eliminated by the provision of the structure in which the sealing member 41 is retracted to a point where the sealing member 41 does not contact the packing member 35. However, such a structure makes the shutter stroke substantially longer, making it difficult to give a toner supplying apparatus and a toner supplying container a compact design.

Figure 25:
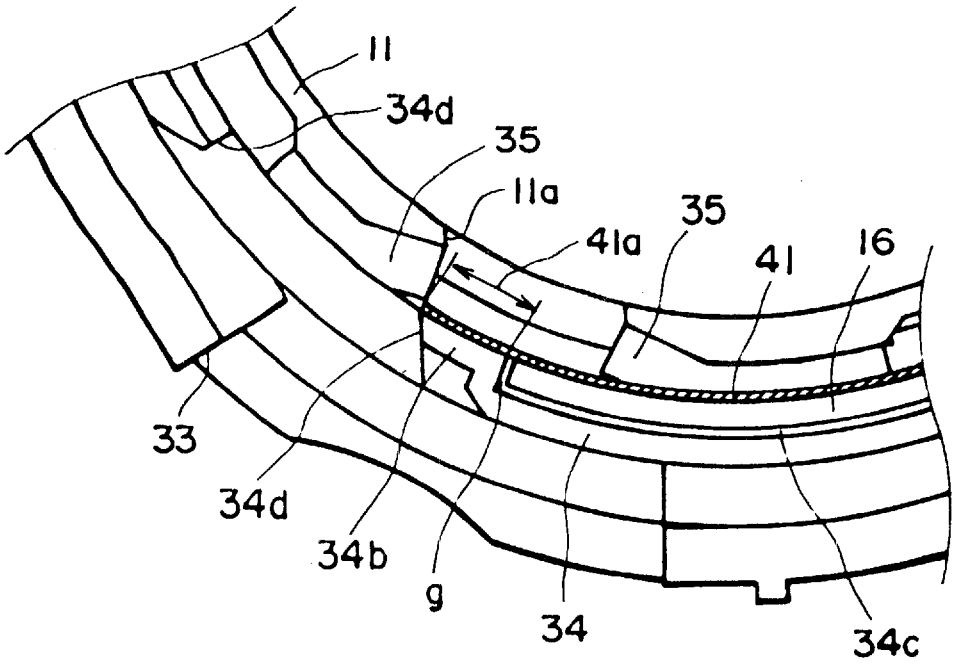
FIG. 25 is an enlarged view of an essential portion of FIG. 22.
Figure 26:
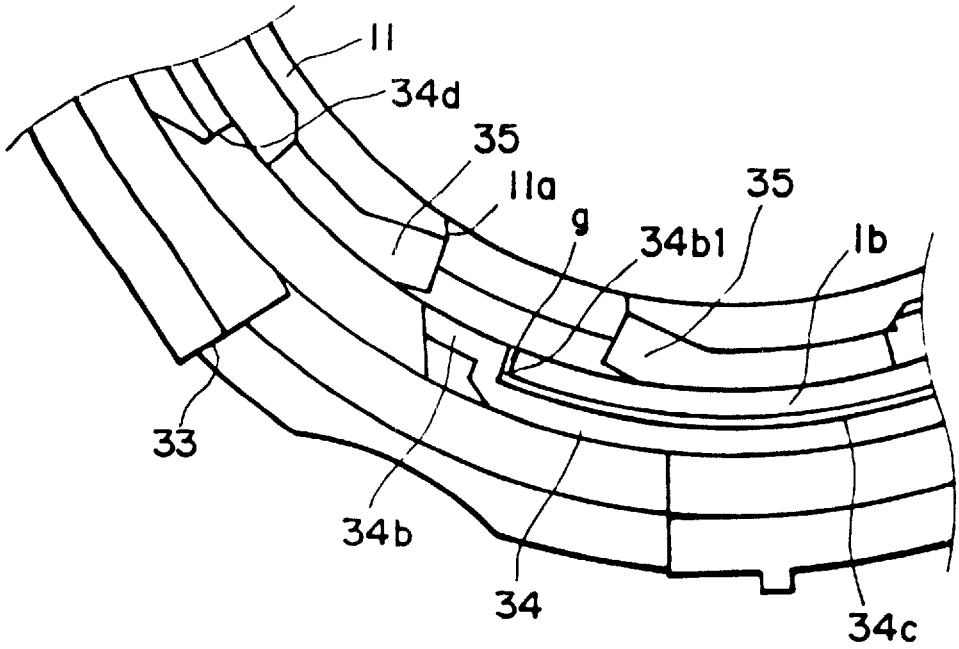
FIG. 26 is an enlarged view of an essential portion of the vertical sectional view of a toner supplying apparatus provided with no sealing member, at a plane perpendicular to the longitudinal direction of the toner supply container, and corresponds to FIG. 25.
Figure 27:
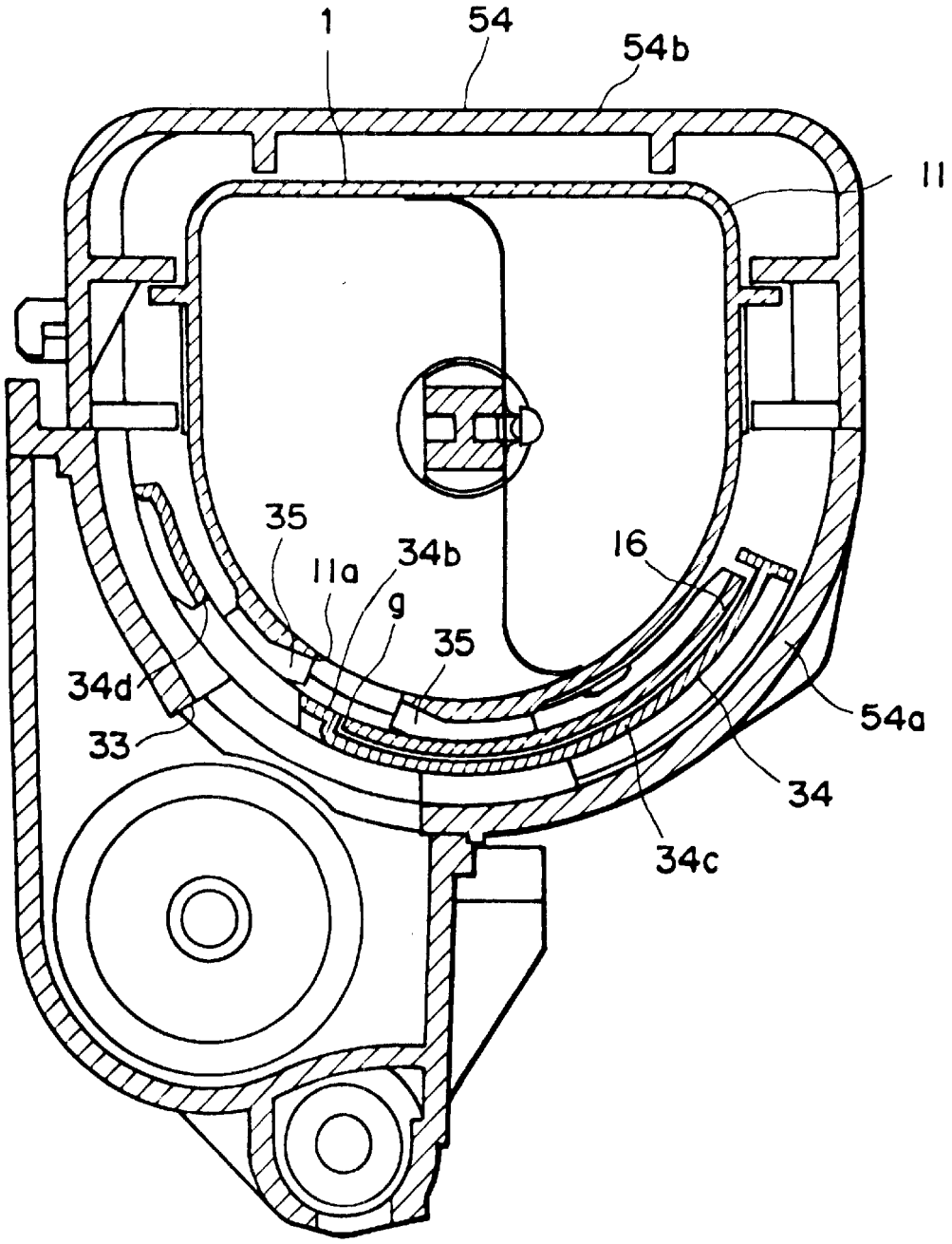
FIG. 27 is an enlarged view of an essential portion of the vertical sectional view of the toner supplying apparatus provided with no sealing member, at the plane perpendicular to the longitudinal direction of the toner supplying apparatus, and corresponds to FIG. 22.

Next, a state in which the toner supply container 1 is removed before a "no toner" light in the warning panel 124*a* is lit, and the function of the sealing member 41 in such a state, will be described. In this state, a substantial amount of toner is still stored in the toner supply container 1. In other words, any of the toner outlets 11*a* of the toner supply container 1, the main assembly shutter opening 34*d,* and the toner supply inlet 33, is filled with the toner. The first step to be taken to remove the toner supply container 1 in this state is to seal the open portions. As the container shutter 16 is moved in the closing direction, the main assembly shutter 34, which is in engagement with the container shutter 16, moves with the container shutter 16 in the direction to close the toner supply container 1. The toner at the main assembly shutter opening 34*d* moves undisturbed in the closing direction, and becomes separated from the toner in the toner supply container 1 and the toner in the toner stirring-conveying apparatus 45, as shown in FIG. 25. During this closing step, the gap G between the main assembly shutter 34 and container shutter 16 passes directly below the toner outlet 11*a* as shown in FIG. 25. Thus, if there were no sealing member 41 as shown in FIGS. 26 and 27, the toner within the toner supply container 1 would rush into the gap g. In reality, however, the sealing member 41 covers this gap g as shown in FIG. 25, preventing the toner from entering the gap g.

Also during this closing step, the sealing member 41 and container shutter 16 are under the contact pressure generated downward (in drawings) by the resiliency o the packing member 35. Therefore, the portion 41*a* of the sealing member 41, which extends beyond the edge of the sealing member 41, is also pressed upon the container facing surface of the main assembly shutter 34, not only gaining in sealing performance but also in preventing the toner from adhering to the surface of the projection 34*b* of the main assembly shutter 34.

The state in which main assembly shutter 34 and container shutter 16 have been completely closed is as shown in FIG. 23. In this state, the toner adhesion to the exterior surfaces of the container shutter 16 and toner containing portion 11 is prevented although the toner adheres to the surface of the extension portion 41*a* of the sealing member 41, on the side of the toner supply container 1. The amount of the toner which adhered to the inwardly facing surface of the aforementioned extension portion 41*a* of the sealing member 41 is extremely small, and also, the location at which the toner adheres to the extension portion 41*a* is in the small pocket created between itself and the toner containing portion 11. Therefore, it is very difficult for the toner to come out once it adheres to the extension portion 41*a;* it rarely scatters outward of the pocket.

For a reason which will be described later, the length by which the aforementioned extension portion 41*a* extends is desired to be approximately the same as the width of the projection 34*b* of the main assembly shutter 34. More specifically, it is desired to be set at a value no less than 2 mm and no more than 10 mm, preferably, no less than 4 mm and no more than 8 mm, and ideally, at 6 mm. If the extension portion 41*a* is excessively short, it is unsatisfactory in terms of effectiveness in preventing the toner invasion of the aforementioned gap g, and also, the aforementioned pocket which the sealing member 41 and toner containing portion 11 form is shallow, failing to retain the toner. In addition, it fails to prevent the toner adhesion to the surface of the projection 34*b* of the main assembly shutter 34.

On the other hand, if the extension portion 41*a* is excessively long, it interferes with the installation or removal of the toner supply container 1. For example, it collides with the various portions of the internal surface of the toner supplying apparatus 100, which is a problem. In addition, the pressure generated by the aforementioned packing member 35 fails to be transmitted to the farthest portion of the extension portion 41*a,* causing the sealing member 41 to lose in sealing performance. Obviously, the pressure can be transmitted to the farthest portion of the extension portion 41*a* of the sealing member 41 by increasing the rigidity of the sealing member 41. However, such a practice reduces the ability of the sealing member 41 to conform to the surface of the main assembly shutter 34, also causing the sealing member 41 to lose in sealing performance. Further, if the extension portion 41*a* is excessively long, it makes the main assembly shutter opening 34*d* too small, possibly interfering with the passage of the toner.

(Locking Member)

The toner cartridge is provided with a locking member 51 so that the handle 15 is locked to the toner containing portion 11 before the toner supply container 1 is installed into the main assembly 124 of an image forming apparatus, and after the toner supply container 1 has been removed from the apparatus main assembly 124 (FIGS. 16 and 17).

The locking member 51 is rotationally fitted around the first flange 12, more specifically, the locking member engagement portion 12*g* of the first flange portion, which is the portion immediately next to the end plate 12*b* of the first flange 12. It is also movable in the direction in which the toner supply container 1 is inserted into, or removed from, the toner supplying apparatus 100 (direction indicated by an arrow mark in FIG. 7, and also the opposite direction).

The locking member 51 comprises a cylindrical ring portion 51*a,* i.e., the portion which fits around the locking member engagement portion 12*g,* and is provided with a notch 51*b* which faces the aforementioned end plate 12*b*. The notch 51*b* is in engagement with the locking projection 12*h* with which the first flange 12 is provided. The locking member 51 integrally comprises an arm-like springy portion 51*c* which presses upon the end surface 15*i* of the handle 15. The first flange 12 is provided with a circumferential ridge 12*i* which is on the cylindrical portion 12*e,* and circles around the cylindrical portion 12*e*. Further, the handle 15 integrally comprises a stopper 15*j,* which is formed by outwardly bending a portion of the handle 15. The tip of the stopper 15*j* is kept in contact with the ridge 12*i* by the resiliency of the aforementioned springy portion 51*c,* to prevent the handle 15 from slipping off the cylindrical portion 12*e* of the first flange 12 (FIG. 12). Further, the locking member 51 is kept in contact with the end plate 12*b* of the first flange 12 by the resiliency of the springy portion 15*c*.

The springy portion 51*c* is gradually reduced in cross section toward its tip, being enabled to evenly bend across its entire length, to prevent the base portion of the springy portion 15*c* from turning white due to the concentration of the bending stress to the base portion. In other words, when the cross section of the springy portion 15*c* is rectangular, it is made gradually smaller in the width or thickness direction toward the tip. Therefore, the springy portion 51*c* gradually reduces in cross section from its base portion to its tip.

Figure 37:
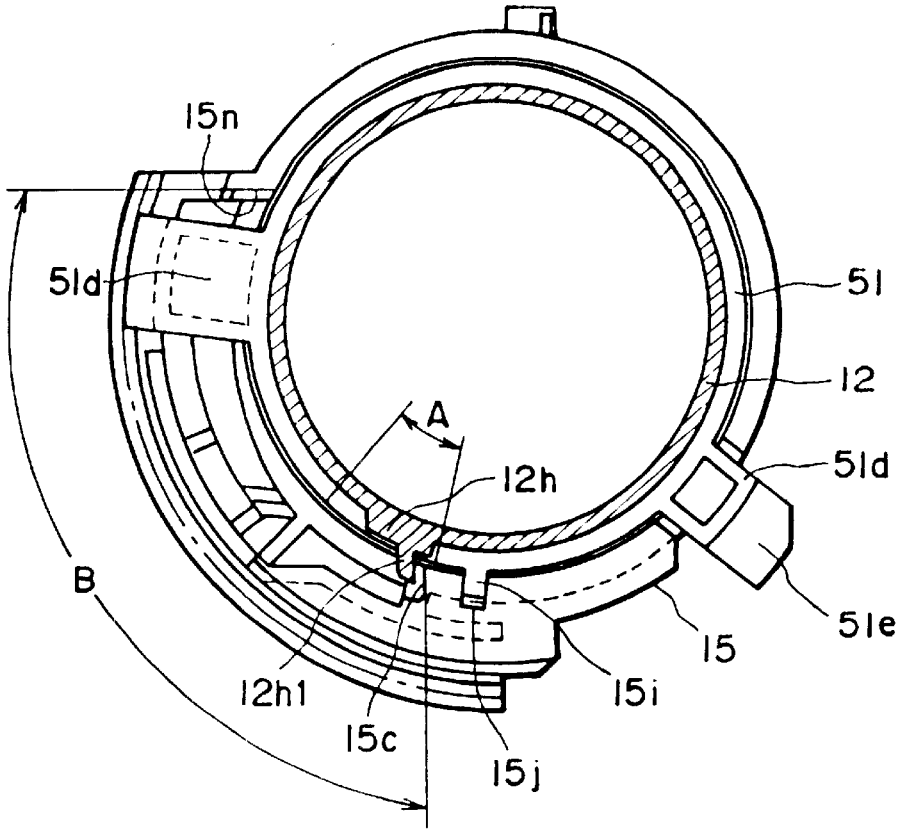
FIG. 37 is a vertical sectional view of the toner supplying apparatus, at a plane perpendicular to the longitudinal direction of the toner supply container, and shows the position of the handle locking member.

A pair of engagement ribs 15*d* provided on the outwardly facing surface of the ring member 51 are enabled to move in the installation-removal direction of the toner supply container 1 by being loosely fitted, one for one, in grooves 15*k* and 15*m* which are cut in the handle 15 in the installation-removal direction of the toner supply container 1. The engagement rib 51*i* of the locking member 51 is engaged in the groove 15*j* of the handle 15. Therefore, the handle 15 and locking member 51 are prevented from moving relative to each other in their circumferential direction, but are allowed to move relative to each other in their axial direction (FIGS. 36 and 37).

The length, in terms of the installation removal direction of the toner supply container 1, of the locking projection 12*h* provided on the first flange 12 is less than the length of the stroke of the engagement ribs 51*d* through the grooves 15*k* and 15*m,* one for one, in the installation-removal direction of the toner supply container 1. Further, the length, in terms of the installation-removal direction of the toner supply container 1, of the locking projection 12*h* is less than the length of the stroke of the engagement rib 51*i* of the locking member 51 through the groove 15*j* of the handle 15.

With the provision of the above structure, the notch 51*b* of the locking member 51 is kept engaged with the locking projection 12*h* of the first flange 12 by the resiliency of the springy portion 51*c* of the locking member 51. Therefore, whatever state the toner supply container 1 is in, the state in which it is being inserted into the toner supplying apparatus 100, the state in which it is being removed from the toner supplying apparatus 100, or the state in which it is out of the toner supplying apparatus 100, the handle 15 is not allowed to move in its circumferential direction relative to the toner containing portion 11. More specifically, in this embodiment, the handle is allowed to slip in its circumferential direction by six degrees, which is equivalent to the amount of the play between the projection 12*h* provided on the first flange 12 and the notch 51*b* of the locking portion 51. It should be noted here that the projection 12*h* of the first flange 12 is provided also as a means for properly aligning the handle 15 relative to the toner supplying apparatus 100 in terms of the circumferential direction of the handle 15 when installing the toner supply container 1 into the toner supplying apparatus 100. This subject will be described later.

The locking member 51 is provided with a latch 51*e,* which is a thin piece of projection and projects outward in the radial direction from the engagement rib 51*d* which is adjacent to the springy portion 51*c*. The latch 51*e* prevents the toner supply container 1 from coming out of the main assembly 54.

(Function of Locking Member)

Next, the function of the locking member 51 will be described. As the toner supply container 1 is inserted into the toner supplying apparatus 100 by engaging the guide portion 11*k* of the toner supply container 1 between the projections 54*d* of the toner supplying apparatus main assembly 54, the container shutter 16 and main assembly shutter 34 engage with each other. While the container shutter 16 engages with the main assembly shutter 34, the driving force receiving engaging portion 16*d* of the container shutter 16 partially meshes with the driving force transmitting engaging portion 21*g,* and immediately thereafter, the driving force transmitting engaging portion 15*a* of the handle 15 partially meshes with the driving force receiving engaging portion 21*a*. After the container shutter 16 partially engages with the main assembly shutter 34, the aforementioned extension portion 41*a* of the sealing member 41 rides onto the projection 34*b* past the entrance portion 34*e* of the main assembly shutter 34.

Figure 33:
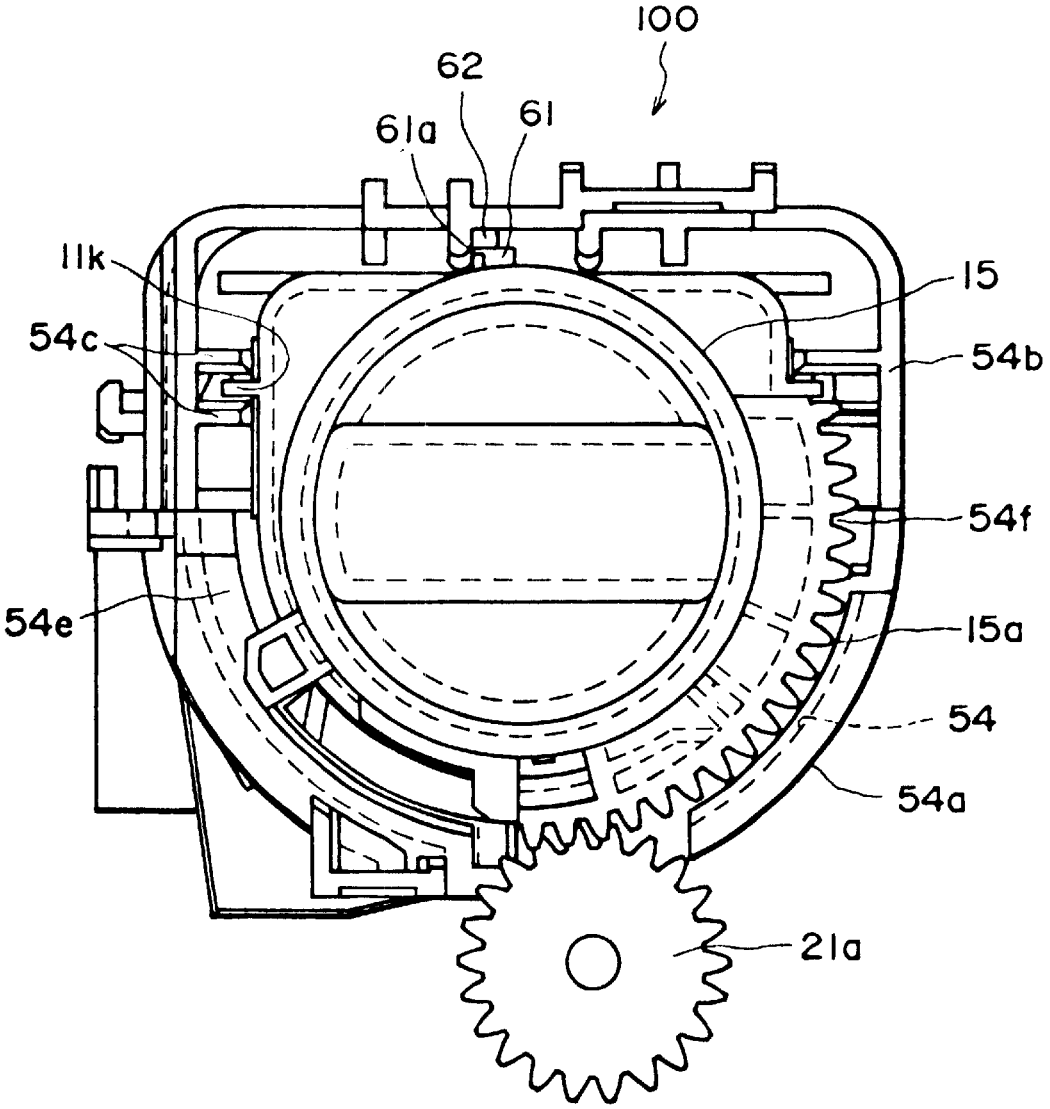
FIG. 33 illustrates mounting of a toner supply container to a toner supply device.
Figure 34:
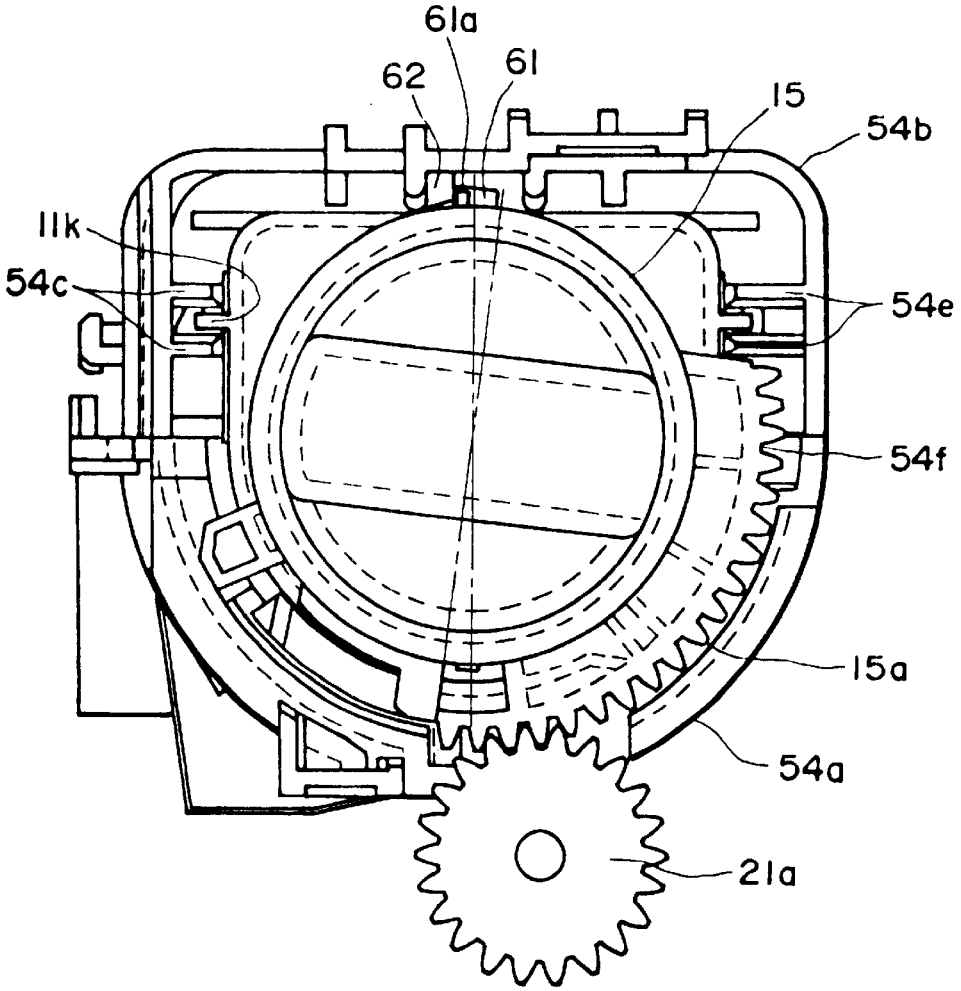
FIG. 34 is a front sectional view illustrating mounting of a toner supply container to a toner supply device.

Then, as the handle 15 is pushed in the installing direction, the projection 51*d*1 provided on the engagement rib 51*d* comes in contact with the striking surface 54*e* of the toner supplying apparatus main assembly 54, and at the same time, the latch 51*e* comes in contact with the contact surface 54*f,* as shown in FIG. 17 (FIGS. 36 and 33). Then, as the handle 15 is pushed in further, the handle 15, first flange 12, toner containing portion 11, second flange 13, and the like, advance together in the same direction indicated by the arrow mark in FIG. 16, and causes the locking projection 12*h* of the first flange 12 to move out of the notch 1*b* as shown in FIG. 17.

Figure 38:
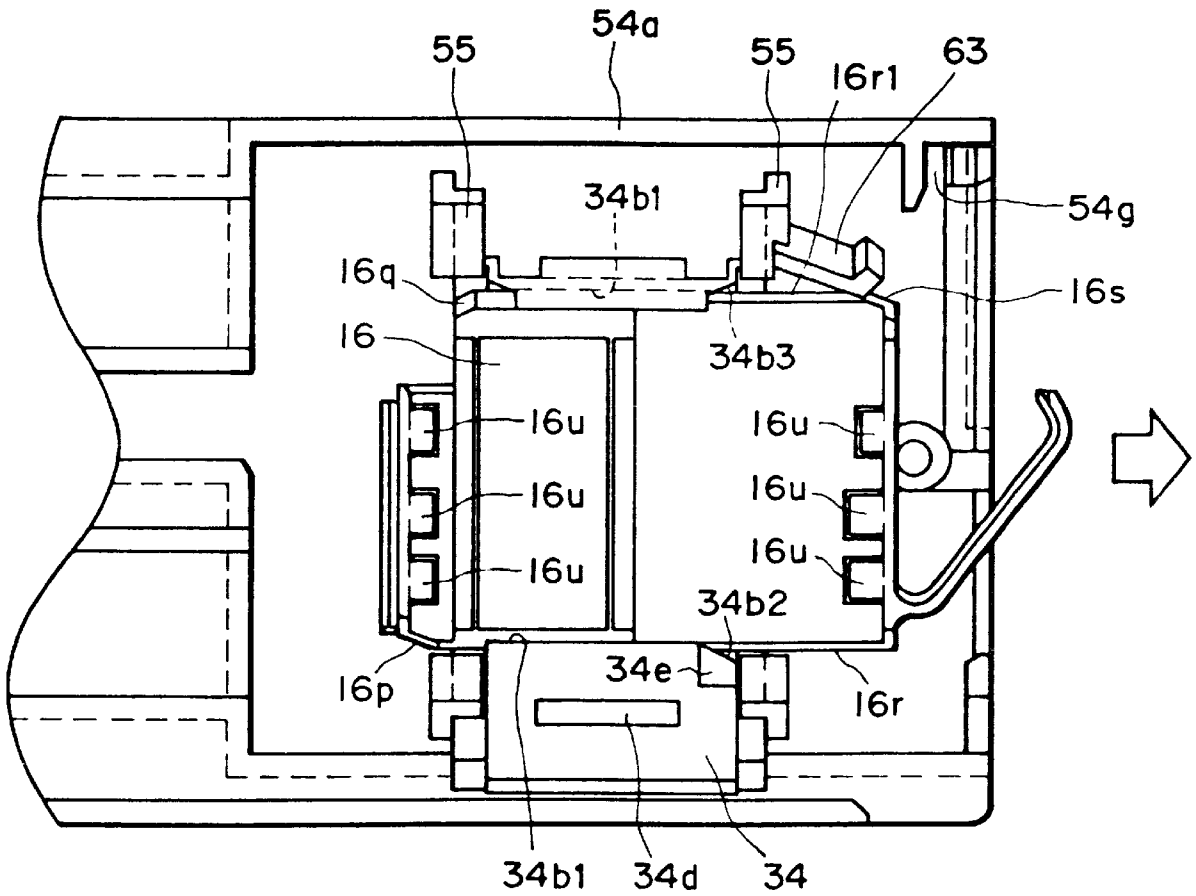
FIG. 38 is a horizontal sectional view of the toner supplying apparatus.
Figure 39:
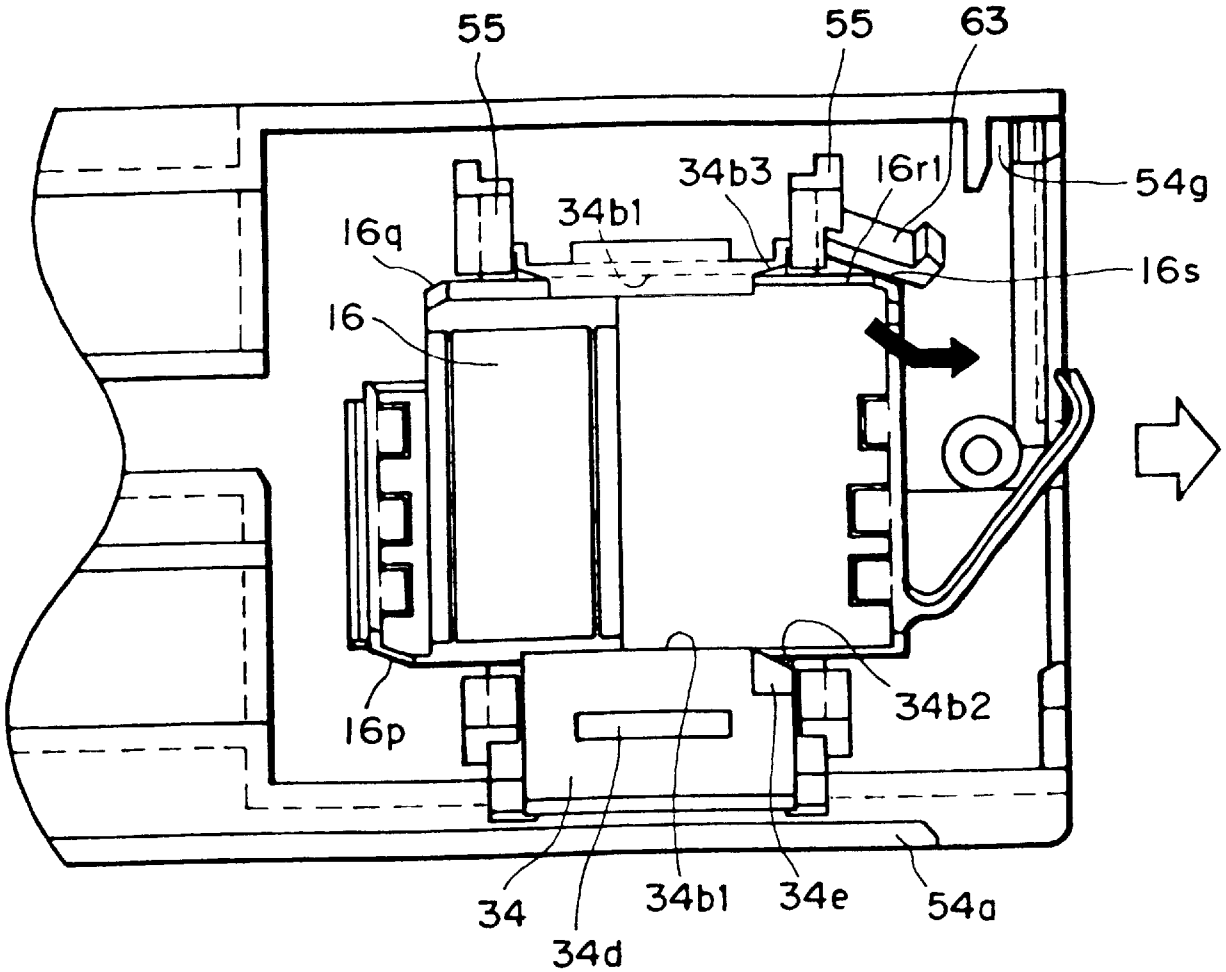
FIG. 39 is also a horizontal sectional view of the toner supplying apparatus.

Therefore, the handle 15 can be rotated clockwise as seen from the upstream side in terms of the toner supply container 1 installing direction (arrow direction in FIG. 17). Then, as the handle 15 is rotated, the locking member 51 rotates together with the handle 15, and immediately, the latch 51*e* engages into the groove 54*g* integrally provided in the strike surface 54*f* of the bottom portion 54*a* of the toner supplying apparatus main assembly 54 (FIGS. 38 and 39). This groove 54*g* extends in the circumferential direction on the cylindrical wall of the bottom portion 54*a* of the toner supplying apparatus main assembly 54, forming an arc. After engaging into the groove 54*g,* the latch 51*e* remains in the groove 54*g* when the toner outlet 11*a* and main assembly shutter 34 are opened or closed. Therefore, while the toner supplying operation is carried out after the installation of the toner supply container 1 into the toner supplying apparatus 100, the toner supply container 1 cannot be simply pulled out of the toner supplying apparatus 100. In other words, the toner supply container 1 can be removed from the toner supplying apparatus 100 only when the container shutter 16 and main assembly shutter 34 are closed, because the latch 51*e* is allowed to come out of the arc-like groove only when the container shutter 16 and main assembly shutter 34 are closed.

Regarding this locking mechanism, if the number of the lock releasing projection is only one, moment and/or deformation occurs to the locking member 51, preventing the locking member 51 from smoothly sliding. Further, even if the number of the lock releasing projection is plural, if they are unevenly distributed, the same problem occurs. Therefore, it is desired that a plurality of lock releasing projections are distributed in the circumferential direction with as even as possible intervals. In this embodiment, two projections are provided, being apart from each other by approximately 180 deg. In this embodiment, the latch 51*e* functions also as a lock releasing projection, the angle formed by the radial line connecting the projection 51*d*1 and the center of the locking member 51 and the radial line connecting the latch 51*e* and the center of the locking member 51 is approximately 150 deg.

Next, referring to FIG. 37, the lock releasing timing of the locking member 51 will be described. The locking projection 12*h* for regulating the angle the locking member rotates is provided with a projection 12*h*1, which projects from the outwardly facing surface of the locking projection 12*h* in the radial direction of the locking member 51, and is enabled to engage with the handle 15. The angle B the handle 15 rotates from the position at which the projection 12*h* is engaged in the notch 51*b* to the position at which the projection 12*h* 1 contacts one of the groove walls 15*n* of the groove 15*m* of the engagement rib, is approximately 90 deg. As stated before, the groove 15*m* is the groove in which the engagement rib 51*d* (on the side where the latch 51*e* is located) of the handle 15 slides. As for the relationship between the notch 51*b* of the locking member 51 and the locking projection 12*h,* the notch 51*b* is made wide enough in terms of its central angle A so that a play of 6 deg. is afforded for the handle 15 in terms of its circumferential direction.

In order to exchange the toner supply container 1 with a fresh one after the toner in the toner supply container 1 was depleted, the handle 15 must be turned to its original position by turning it in the direction opposite to the direction in which the handle 51 is turned during the installation of the toner supply container 1 (counterclockwise as seen from the upstream side in terms of the direction in which the toner supply container 1 is inserted into the toner supplying apparatus 100). With this action, the latch 51*e* becomes disengaged from the arc-shaped groove 51*e,* and the locking member 51 slides back, on the locking member engagement portion 12*g,* to its original position, i.e., the position at which the locking projection 12*h* remains engaged in the notch 51*b* of the ring portion 51*a* of the locking member 51, due to the resiliency of the springy portion 51*c.*

As stated before, because the locking member 51 is under the pressure generated by the springy portion 51*c* in the direction of the toner containing portion 11, it slides in the direction to cause the aforementioned locking projection 12*h* and the notch 51*b* of the locking member 51 to engage with each other, and lock the handle 51.

(Assembling Process of Toner Cartridge)

The description will be made as to assembling of the toner cartridge. Before assembling, the parts are cleaned by air blow, vacuum suction or the like to avoid foreign matter, fuzz or the like.

First, the toner container 11 and the first flange 12 are connected. This is done by ultrasonic welding, hot melt adhesive material, adhesive tape or the like.

Then, the feeding shaft 27 is fastened to the feeding blade 28. As described in the foregoing, penetrating the boss 27*b* of the feeding shaft 27 through the engaging hole 28*c* provided in the feeding blade 28 is enough.

The toner feeding member 29 now constituted by the feeding shaft 27 and the feeding blade 28 fastened thereto is assembled with the second flange 13 using the coupling 26*a.* At this time, a packing member (unshown) such as an oil seal, a felt seal or the like is used to prevent toner leakage at the portion where the coupling 26*a* and the second flange 13 are engaged. The assembly thus provided is mounted to the toner container 11. This is done also by ultrasonic welding, hot melt adhesive material, adhesive tape or the like. From the standpoint of high recycling efficiency, the use of adhesive tape 64 (FIG. 14) is preferable.

Subsequently, a packing member 35 is stuck to close the toner discharging opening 11*a.* A container shutter 16 to which a seal member 41 is stuck is mounted to cover the toner discharging opening 11*a.*

Then, the toner is filled into the toner filling opening 12*a,* and press-fitting the cap 14 into the toner filling opening 12*a.* The toner filling may be carried out manually, but it is preferable to use an auger type filling machine 65 as shown in FIG. 37. Then, the outer side of the toner supply container 1 is cleaned. The cleaning method may use air blow or vacuum suction, and then it is wiped by waist cloth or the like. The cleaning step may be omitted.

Then, a locking member 51 is mounted, and the handle 15 is mounted finally.

Thus, the toner supply container 1 may be assembled.

(Toner Supplying Operation)

Next, a toner supplying operation which employs a toner supply container 1 in this embodiment will be described in general terms.

(1) Installation of Toner Supply Container 1

First, the lid 121 with which the apparatus main assembly 124 is provided is opened by 90 deg. toward an operator. Then, the guide portion 11*k* of the toner supply container 1 is engaged into the groove 54*h* (FIG. 20) between the projections 54*c* of the toner supplying apparatus 100. Then, the toner supply container 1 is inserted into the toner supplying apparatus 100 from the side where the coupling 26*a* is provided. With this action, first, the container shutter 16 of the toner supply container 1 and the main assembly shutter 34 within the toner supplying apparatus 100 engage with each other. Next, the driving force transmitting engaging portion 21*g* and the driving force receiving engaging portion 16*d* of the container shutter 16 engage with each other. Lastly, the driving force receiving engaging portion 21*a* on the toner supplying apparatus 100 side and the driving force transmitting engaging portion 15*a* of the handle 15 engage with each other.

(2) Positioning of Toner Supply Container and Supplying of Toner

With the toner supply container 1 being in the toner supplying apparatus 100, as an operator manually rotates the handle 15 by 90 deg. in the clockwise direction, the rotational driving force, i.e., the force applied by the operator, is transmitted from the driving force transmitting engaging portion 15*a* of the handle 15, as a driving force transmitting portion, to the driving force transmitting member 21, through the driving force receiving engaging portion 21*a* of the toner supplying apparatus 100. Then, this force is further transmitted from the driving force transmitting engaging portion 21*g* to the driving force receiving engaging portion 16*d,* of the container shutter 16. By the driving force transmitted in the above described manner, the container shutter 16 is slid in the circumferential direction of the toner containing portion 11 while engaging with the shutter supporting member 11*e* of the toner containing portion 11. During this sliding movement of the container shutter 16, the main assembly shutter 34 moves with the container shutter 16. Therefore, the toner outlet 11*a* of the toner containing portion 11, the opening 34*d* of the main assembly shutter 34, and the toner inlet 33 in the toner supplying apparatus 100, are all opened at the same time. Then, toner supplying is started by rotating the toner conveying member 29 through the coupling 26*a*, which receives the driving force from the coupling 44 of the apparatus main assembly 124.

During the above described operation, the toner containing portion 11 does not rotate. Therefore, the toner supply container 1 does not rotate with the handle 15; it remains fixed in the toner supplying apparatus 100.

(3) Removal of Toner Supply Container

An operator rotates the handle 15 by 90 deg. in the counterclockwise direction. With this action, a driving force different in direction from the driving force applied during the installation (2) of the toner cartridge is transmitted in the same order as in the installation of the toner supply container, closing the toner outlet 11*a,* and the main assembly shutter 34 closes the opening 34*d* of the main assembly shutter 34 and the toner inlet 33, to complete the toner replenishment sequence.

The toner supply container 1 is installed into the toner supplying apparatus 100 from the coupling 26*a* side. This requires that the engaging portion 16*d* of the container shutter 16 passes by the engaging portion 21*a* of the apparatus main assembly 124, and engages with the engaging portion 21*g,* i.e., the inward one, of the apparatus main assembly 124. Therefore, the diameter of the theoretical circle which connects the tips of the teeth of the engaging portion 16*d* in the form of a segment gear is desired to be smaller than the diameter of the theoretical circle which connects the bases of the teeth of the engaging portion 15*a* in the form of a segment gear.

With the provision of the above described structure, a toner containing portion is not required to move during the toner supplying sequence. Therefore, there is no restriction regarding the shape of a toner containing portion. Therefore, a shape which offers the highest spatial efficiency to a toner containing portion may be employed as the shape for a toner containing portion. In addition, a shutter and a handle are made into two separate components. Therefore, it is unnecessary for a toner outlet to be next to a handle. Therefore, more latitude can be afforded in designing a toner supply container.

Further, in the case of the toner supply container in this embodiment, the driving force applied to the handle is transmitted to the driving force receiving engaging portion of the shutter through a plurality of engaging portions: the engaging portion of the handle, the engaging portion of the driving force transmitting member, and the engaging portion of the shutter. Therefore, it is possible to more freely design the engaging portion in terms of engagement ratio (gear ratio).

Thus, when the distance the shutter is slid to be opened or closed is long, the angle by which the handle must be rotated can be reduced by increasing the engagement ratio (gear ratio) of the handle, and when the torque required to open or close the shutter is high, the torque required to operate (rotate) the handle can be reduced by reducing the engagement ratio (gear ratio) of the handle.

Also in this embodiment, the angle by which the handle is rotated to open or close the shutter is made to be 90 deg., so that when installing the toner supply container into the toner supplying apparatus, the thick end 15*e* is vertically positioned, and after the toner is discharged by rotating the handle clockwise by 90 deg., the thick end 15*e* of the handle 15 is horizontally positioned. This arrangement makes it easier for an operator to operate the toner supply container, and also to recognize the state of the 20 toner supply container 1. For operational efficiency and convenience, the angle by which the handle 15 is rotated to open or close the shutter is desired to be in a range of 60–120 deg.

(Toner Stirring-conveying Apparatus)

The toner supplying apparatus 100 is provided with the toner stirring-conveying apparatus 45. Referring to FIGS. 20 and 21, the toner supplying apparatus 100 is also provided with the case 48, which is fixed to the toner supplying apparatus main assembly 54 in a manner to cover the toner inlet 33 from below. The case 48 is approximately the same as the toner supplying apparatus 100 in the longitudinal dimension. In the case 48, the stirring screws 46 and 47 are disposed, being supported by the case 48 so that they can be rotationally driven.

The stirring screws 46 and 47 are separated by a partition wall 48*a* which divides the internal space of the case 48 into two chambers 48A and 48B, which are connected to each other through the hole provided in the partition wall 48*a* on the side opposite to the toner inlet 33, and in which the stirring screws 46 and 47 are disposed, respectively, the stirring screw 46 being diagonally above the stirring screw 47. The case 48 is provided with a toner outlet 48*b*, which is located at the same longitudinal end as the toner inlet 33, and leads to the developing apparatus 201.

With the provision of the above structural arrangement, as the toner is supplied through the toner inlet 33, the rotating toner stirring screw 46 conveys the toner, while stirring, through the chamber 48A in the longitudinal direction from the toner inlet 33 side to the opposite side, causing the toner to fall into the chamber 48B through the opening (unillustrated) provided in the partition wall 48*a*. The toner stirring screw 47, i.e., the one at the bottom, conveys, while stirring, the toner in the direction opposite to the toner conveying direction of the toner stirring crew 46. As a result, the toner is supplied into the developing apparatus 201 through the toner outlet 48B.

(Precise Positioning Means)

If cost is spared in producing a toner supply container and components related thereto, in other words, if highly precise components are not used for the production of a toner supply container and the related components, it is inevitable that the drive train, i.e., the driving force transmitting juncture from the rotatable handle to the shutter, suffers from an excessive amount of play and/or deformation which results in, for example, the gear backlash or the like. With the presence of such a large amount of play and/or deformation, the output stroke of the drive train does not correspond to the input stroke one to one. Therefore, there occurs sometimes such a condition that after the shutter is opened, it fails to come back all the way to its original position. If the toner supply container, the shutter of which is in this condition, is removed once from the apparatus main assembly, and reinstalled into the apparatus main assembly, the distance between the final position of the shutter of the toner supply container after the closing stroke, and the original position becomes greater than that in the previous installation. In other words, the distance continues to increase with the repetition of the installation and removal.

In the case of the above described design, according to which the main assembly shutter and container shutter are integrally engaged with each other, shutter misalignment such as the one described above makes it impossible to remove the toner supply container from the apparatus main assembly, or to install a fresh toner supply container (shutter is at its original position) into the apparatus main assembly, which is a serious problem.

This problem can be solved by providing a toner supply container and the related structure of the apparatus main assembly with such a feature that requires that when installing a toner supply container, the handle is rotated in the opening direction of the shutter by a predetermined angle, in addition to the theoretically necessary angle, before the handle and shutter begin to engage with the driving train gears on the apparatus main assembly side, and when removing the toner supply container, the handle is rotated in the closing direction of the shutter by the aforementioned predetermined angle, in addition to the theoretically necessary angle. This feature compensates for the additional length of stroke which the gear backlash or the like resulting from the excessive play requires, assuring that the shutters are returned to their original positions.

Next, a means for providing the above described feature will be described in detail.

Figure 40:
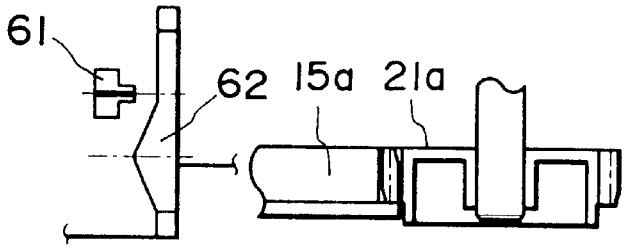
FIG. 40 is a schematic drawing which depicts the function of the means for always pre-rotating or rotating the rotational member to a predetermined position.
Figure 41:
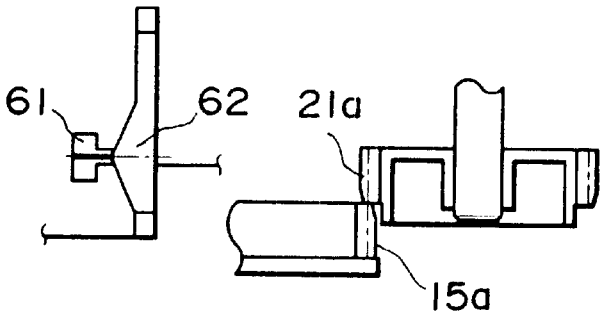
FIG. 41 is also a schematic drawing which depicts the function of the means for always pre-rotating or rotating the rotational member to the predetermined position.
Figure 42:
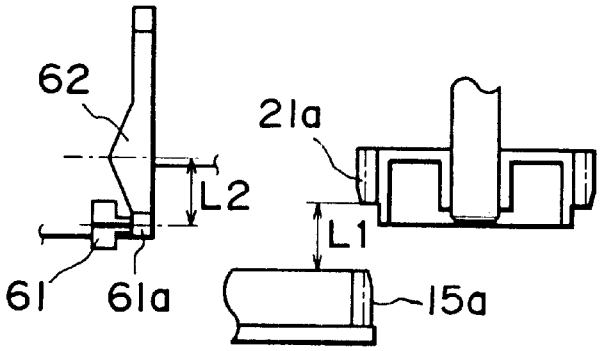
FIG. 42 is also a schematic drawing which depicts the function of the means for always pre-rotating or rotating the rotational member to the predetermined position.

Referring to FIGS. 10, 11, 33 and 34, the handle 15 is provided with a handle projection 61, as a contact portion, which is located on the outwardly facing surface of the handle 15. Referring to FIGS. 40–42, which are schematic plan views of the handle projection 61 and adjacent components as seen from above, the handle projection 61 is shaped like a cam follower, and its portion with a contact surface 61*a* is narrower than the base portion in terms of the vertical direction in FIGS. 40–42. It is positioned to come in contact with the main assembly projection 62 provided on the inwardly facing surface of the top plate of the bottom portion 54*b* of the toner supplying apparatus main assembly 54. The projections 61 and 62 work in combination as a follower and a cam, respectively.

The cam portion of the main assembly projection 62 is angled in profile. The lift of this cam surface is just enough to make the center angle of the cam portion of the main assembly projection 62, that is, the angle formed by the line connecting the highest point of the cam surface and the center of the toner supplying apparatus main assembly 54 (center of the semicylindrical bottom portion 54*a*), and the line connecting the base of the cam surface and the center of the toner supplying apparatus main assembly 54, large enough to compensate for the play in the rotational direction between the toner supply container 1 and toner supplying apparatus 100. This center angle is no less than 6 deg. In this embodiment, it is 6 deg.

Next, the handle projection 61 and main assembly projection 62 will be described in positional relationship and function. Referring to FIGS. 33 and 42, as the toner supply container 1 is inserted into the toner supplying apparatus 100, the handle projection 61 reaches a point at which it comes in contact with the main assembly projection 62, on the cam surface, at the point with no lift. In this state, the driving force transmitting engaging portion 15*a* of the handle 15 and the driving force receiving engaging portion 21*a* on the main assembly side are apart from each other by a distance L1, which is equal to a distance L2 by which the handle projection 61 in this state must be moved to receive the highest lift.

As the toner supply container 1 is further inserted into the toner supplying apparatus 100 from the point illustrated in FIGS. 33 and 42, the handle projection 61 slides on the main assembly projection 62 while rotating the handle 15. By the time the handle projection 61 slides to the cam crest of the main assembly projection 62, the handle 15 is rotated by 6 deg. The tooth tips of the engaging portion 15*a* of the handle 15 come in contact with the counterparts of the engaging portion 21*a* of the toner supplying apparatus 100 at the same time the handle projection 61 reaches the cam crest of the main assembly projection 62. The tooth tips of the engaging portion 16*d* of the container shutter 16 come in contact with the counterparts of the engaging portion 21*g* on the main assembly side slightly before the contact between the engaging portions 15*a* and 21*a* by their tooth tips. In other words, the engagement of the engaging portion 16*d* of the container shutter 16 with the engaging portion 21*g* on the main assembly side occurs slightly ahead of the engagement of the engaging portion 15*a* of the handle 15 with the engaging portion 21*a* of the toner supplying apparatus 100.

Referring to FIG. 40, as the toner supply container 1 is further inserted into the toner supplying apparatus 100, the driving force transmitting engaging portion 15*a* of the handle 15 and the driving force receiving engaging portion 21*a* of the toner supplying apparatus 100 mesh with each other. On the other hand, the driving force receiving engaging portion 16*d* of the container shutter 16 meshes with the driving force transmitting engaging portion 21*g* illustrated in FIG. 19, across the entire ranges of their teeth. Therefore, while the toner supply container 1 moves from the position illustrated in FIG. 41 to the position illustrated in FIG. 40, the handle 15 does not rotate, and the handle projection 61 remains at the floating position a shown in FIG. 40, which corresponds to the cam crest of the main assembly projection 62.

As the handle projection 61 is displaced by the main assembly projection 62 as described above, the handle 15 rotates by 6 deg. Therefore, a certain amount of play is provided between the mutually facing surfaces of the handle 15 and first flange 12. More specifically, referring to FIGS. 16 and 17, when the toner supply container 1 is not in the main assembly of the image forming apparatus, a play large enough to allow the handle 15 to rotate by 6 deg. is provided in the circumferential direction of the handle 15 between the side surfaces of the notch 51*b* of the locking member 51, and the locking projection 12*h* of the first flange 12, and also between the surfaces of the grooves 15*k* and 15*m,* and the corresponding engagement ribs 51*d* of first flange 12.

Further, in order to make the container shutter 16 engage with the main assembly shutter 34 at a predetermined position before the handle 15 is rotated by the handle projection 61 and main assembly projection 62, the bottom portion 54*a* of the toner supplying apparatus main assembly 54 is provided with a positioning projection 63, which is located on the inwardly facing surface of the bottom portion 54*a,* and against which the end surface of the container shutter 16, on the leading side in terms of the installing direction of the toner supply container 1, slides, as shown in FIGS. 38 and 39. This projection 63 has a cam surface which is angled in profile, and the position of the cam crest of this projection 63 corresponds to the timing with which one of the mutually facing surfaces 34*b*1 of the indentation of the main assembly shutter 34, in which the container shutter 16 fits, comes to a predetermined point.

As the toner supply container 1 is inserted into the toner supplying apparatus 100, the chamfer surface 16*q* of the container shutter 16 comes in contact with the projection 63. As a result, the container shutter 16 is controlled in its positional relationship relative to the main assembly shutter 34 in the circumferential direction of the toner supply container 1. Then, as the toner supply container 1 is further inserted into the toner supplying apparatus 100, the longitudinal edge 16*r*1 of the container shutter 16, connected to the chamfer surface 16*q,* slides against the projection 63 while the container shutter 16 fits into the indentation of the main assembly shutter 34. During this movement of the container shutter 16, the chamfer surface 16*p* of the container shutter 16, on the opposite side of the container shutter 16, comes in contact with the chamfered surface 34*b*2 located at the corner of the projection 34*b,* on the corresponding side, of the main assembly shutter 34, also controlling the container shutter 16 in its positional relationship relative to the main assembly shutter 34. As the toner supply container 1 is further inserted, the chamfered surface 16*q* engages with the chamfered surface 34*b*3 of the main assembly shutter 34, and thereafter, the container shutter 16 advances into the indentation (space) between the mutually facing surfaces 34*b*1 of the projections 34*b* of the main assembly shutter 34. Then, as the container shutter 16 advances into the indentation of the main assembly shutter 34 to a point illustrated in FIG. 38, the engaging portions 15*a* and 16*d* on the toner supply container side begin to mesh with the engaging portions 21*a* and 21*g* on the toner supplying apparatus 100 side. As the corresponding engaging portions mesh with each other by a predetermined margin in terms of the width direction of the gears, the positional relationship between the container shutter 16 and main assembly shutter 34 becomes as shown in FIG. 39. In this state, the chamfer surface 16*s* at the upstream end, in terms of the advancing direction of the container shutter 16 relative to the main assembly shutter 34 of the longitudinal edge 16*r* on the container shutter sides, has separated from the projection 63.

During the above described process, the resistance against the movement of the container shutter 16 for opening or closing the toner outlet of the toner containing portion 11 is large enough in comparison to the resistance against the opening or closing of the main assembly shutter 34, because the container shutter 16 is under the pressure generated by the packing member 35. Therefore, the projection 63 regulates the position of the container shutter 16, and the container surface 16 regulates the position of the main assembly shutter 34.

With the provision of the above described structure and its functions, the positions of the main assembly shutter 34 and container shutter 16 are always the same after their engagement. In this state, as a user rotates the handle 15 by 84 deg. in the clockwise direction as seen from the upstream side of the direction in which the toner supply container 1 is inserted in the toner supplying apparatus 100, both shutters 16 and 34 rotate 50 deg. in their opening direction; they fully open.

When removing the toner supply container 1 from the toner supplying apparatus 100, a user is required to rotate the handle 15 by 90 deg. in the counterclockwise direction, i.e., the direction opposite to the aforementioned direction. As the handle 15 is rotated, both shutters 16 and 34 rotate by 50 deg. in their closing direction to their original positions.

As described above, the relations among the rotational angle of the handle 15 during the opening of the shutters 15 and 34, the rotational angle of the handle 15 during the closing of the shutters 15 and 34, the rotational angles of the shutters 16 and 34 during the closing of the shutters 16 and 34, and the rotational angles of the shutters 16 and 34 during the closing of the shutters 16 and 34, do not exactly correspond. This discrepancy occurs because the toner supply container rotates relative to the toner supplying apparatus due to the aforementioned gear backlash, deformation or bending of the handle, shutters, and shafts, and the like. Therefore, the shutters can be returned to their original positions by causing the rotational member 15 to rotate by 6 deg. to compensate for the backlash and/or deformation before the handle is turned for installation.

Also when pulling the toner supply container 1 out of the toner supplying apparatus 100, the handle 15 is pre-rotated by 6 deg. in the opening direction, as when installing the toner supply container 1, by the engagement of the handle projection 16 and the main assembly projection 62, to prepare the toner supply container 1 for the next usage. Should an attempt be made to pull out the toner supply container 1 without rotating the handle 15 by 90 deg. in the counterclockwise direction (for example, rotating by only 80 deg.), it is possible that the container shutter 16 and main assembly shutter 34 might not return to their original positions. In the case of this embodiment, however, as the toner supply container 1 is pulled, the chamfered surface 16*s* of the container shutter 16 engages with the projection 63 of the toner supplying apparatus 100, and forces the container shutter 16 and main assembly shutter 34 back to their original positions. Therefore, the aforementioned inconvenience can be avoided.

(Recycling Process of the Toner Cartridge)

The toner cartridge according to this embodiment is used for image formation as described hereinbefore, and when the toner is used up, the process cartridge is collected back for recycling. The collected toner cartridge is recycled in the following process.

1) The Handle 15 is Dismounted from the Toner Container 11

This may be done by expanding the engaging portion by a proper tool.

At this time, the locking member 51 is removed.

2) The Cap 14 is Removed from the Flange 12

It may be pulled out manually, but a tool such as nipper may be used. However, when the cap 14 is to be reused, the cap 14 is removed manually or with a proper tool so as not to damage the cap 14.

3) The Container Shutter 16 is Dismounted from the Toner Container 11

This can be easily done by sliding the container shutter 16 in the opening direction.

4) The Second Flange 13 and the Toner Feeding Member 29 are Dismounted from the Toner Container 11

This can be done by peeling the adhesive tape 64 off the toner container 11 and/or the second flange 13. Since the toner feeding member 29 is supported by the second flange 13, the toner stirring member 29 can be dismounted from the toner container 11 by dismounting the second flange 13 from the toner container 11.

5) The Various Parts Thus Put Apart Are Cleaned

The air blow, vacuum suction or the like is usable for the cleaning. If necessary, they are wiped by waist cloth or the like.

6) The Toner Feeding Member 29 is Separated

Here, only the feeding blade 28 is dismounted. This can be done by gripping one end portion of the feeding blade 28 and pulling it in the direction of the axis of the feeding shaft 27. When the feeding blade 28 is neither folded, blanched, bent, nor deformed (defects preventing proper function of the feeding blade 28), it may be reused. However, it is preferable to exchange it with a new one from the standpoint of its functions.

7) The Feeding Blade 28 is Mounted to the Feeding Shaft 27

This is done by penetrating the bosses 27*b* of the feeding shaft 27 through the hole portions 28A of the feeding blade 28.

8) The toner Feeding Member 29 is Assembled with the Toner Container 11

This is done by fixing the second flange 13 now having the toner feeding member 29 fixed to the toner container 11. The fixing method is preferably the one using an adhesive tape 64 described hereinbefore from the standpoint of easiness in the recycling.

9) The Container Shutter 16 is Mounted to the Toner Container 11

The container shutter 16 is preferably reused from the standpoint of better recycling efficiency. However, a new molded container shutter 16 is usable. Or, only the seal member 41 on the container shutter 16 may be exchanged with a new one. The packing member 35 sealing the toner discharging outlet 11*a* may be reused or may be replaced.

10) The Toner is Supplied Through the Toner Filling Opening 12*a*, and the Cap 14 is Press-fitted into the Toner Filling Opening 12*a*

Figure 46:
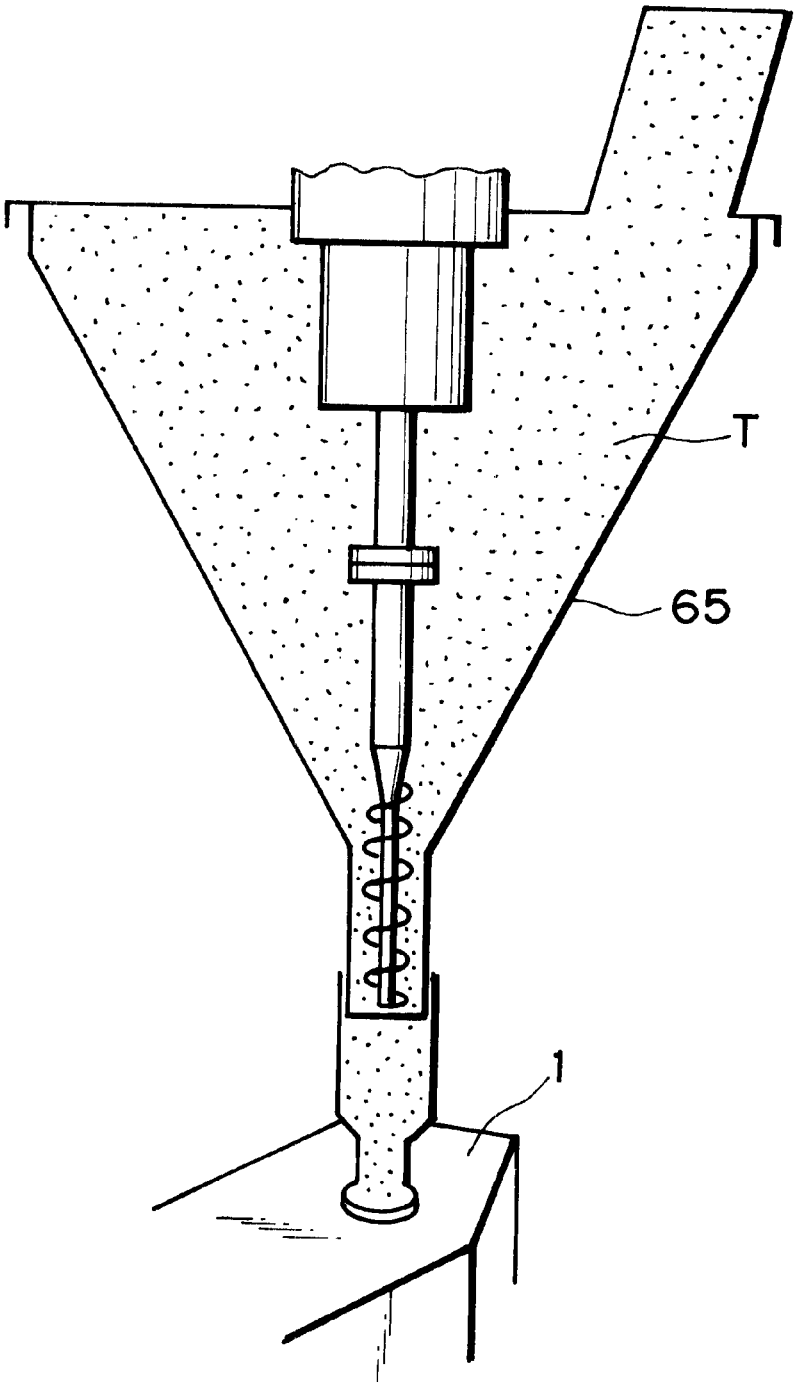
FIG. 46 is an illustration of filling of toner.

The toner filling may be carried out manually, but use of the auger type filling machine 65 shown in FIG. 46 is preferable. The amount of the filled toner is preferably the same as the new cartridge, but it may be larger or smaller. The cap 14 is preferably reused from the standpoint of better recycling efficiency as described hereinbefore. However, the cap 14 may be a new molded one. In such a case, the configuration of the cap may be different from the original one, if it can seal the filling port 12*a*.

11) The Outer Surface of the Toner Supply Container 1 is Cleaned

The cleaning method may use air blow or vacuum suction, and then, it is wiped by waist cloth or the like. The cleaning process may be omitted.

12) The Toner Leakage is Checked

This step is to make it sure that toner does not leak out of the toner supply container 1. The step may be omitted.

13) The Handle 15 is Mounted

The removed handle 15 may be reused, or a new handle may be used. The handle 15 is pushed so that in the retainer 15*j* of the handle 15 is assuredly hooked with the projected portion 12*i* of the first flange 12 (FIG. 16).

In this manner, the toner cartridge maybe recycled, by which the resources and energy can be saved, and the amount of the garbage can be reduced.

The feeding shaft from which the feeding blade has been removed does not have any defect, and therefore, it can be reused a number of times.

It has been confirmed that toner cartridge thus recycled is satisfactory with as good image quality as those of a new cartridge without coarse particles of toner. The present invention is not limited to the above-described toner cartilage, but is applicable to a container comprising a feeding member therein, to a toner accommodating portion of a process cartridge, to a developing device cleaner or the like.

While the invention has been described with reference to the structures disclosed herein, it is not confined to the details set forth and this application is intended to cover such modifications or changes as may come within the purpose of the improvements or the scope of the following claims.

What is claimed is:

1. A developer stirring member, provided in a developer container for accommodating a developer, for stirring the developer, said developer stirring member comprising:

a stirring blade stirring the developer;

a rotatable supporting member for supporting said stirring blade, said supporting member being provided with a plurality of projections;

wherein said stirring blade is provided with a plurality of openings for engagement with said projections, respectively; and wherein each of said openings is provided with a hole through which said projection is penetrated and is provided with a slit connected with said hole.

2. A developer stirring member according to claim 1, wherein said supporting member is provided with a shaft portion extended in a rotational axis direction of said supporting member.

3. A developer stirring member according to claim 1, wherein said stirring blade is made of film having a thickness of 50–500 $\mu$m.

4. A developer stirring member according to claim 3, wherein said stirring blade is made of polyester resin material.

5. A developer stirring member according to claim 1, wherein each of said openings is provided with an additional slit connected with said hole, wherein said slits are extended in a direction of a rotational axis of said supporting member from said hole, and wherein each of said slits is provided with an additional hole.

6. A developer stirring member according to claim 2, wherein said projection is provided with a large diameter portion and a small diameter portion between said large diameter portion and said shaft portion, wherein said small diameter portion is inserted in said openings so that said projections and said openings are locked together.

7. A developer stirring member according to claim 6, wherein a width of said hole [which] is smaller than a width of said small diameter portion, and said small diameter portion is inserted in said hole so that said projections and said openings are locked together with each other.

8. A developer stirring member according to claim 6, wherein said slits are extended from opposite sides of said hole.

9. A developer stirring member according to claim 7, wherein one-half of a difference between a width of said large diameter portion and a width of said hole is smaller than a height of said small diameter portion.

10. A developer stirring member according to claim 7, wherein one half of a difference between a width of said small diameter portion and a width of said hole is smaller than a height of said small diameter portion.

11. A developer stirring member according to claim 1, wherein said stirring blade is detachably fastened to said supporting member.

12. A developer stirring member according to claim 1, wherein said developer stirring member is effective to discharge the developer out of said developer container through an opening provided with said developer container.

13. An assembling method for a developer stirring member, provided in a developer container for accommodating a developer, for stirring the developer, said method comprising the steps of:

preparing a stirring blade for stirring said developer, said stirring blade is provided with a plurality of openings;

preparing a rotatable supporting member for supporting said stirring blade, said supporting member is provided with a plurality of projections;

locking said projections with said openings, wherein each of said openings is provided with a hole and a slit connected with said hole, and wherein said locking step includes a step of penetrating said projection through said hole.

14. A method according to claim 13, wherein said supporting member is provided with a shaft portion extended in a rotational axis direction of said supporting member, wherein said projection is provided with a large diameter portion and a small diameter portion between said large diameter portion and said shaft portion, and wherein said small diameter portion is inserted in said openings so that said projections and said openings are locked together.

15. A method according to claim 13, wherein said stirring blade is detachably mountable to said supporting member.

16. A method according to claim 13, wherein said assembling method is used to recycle said developer stirring member.

17. A method according to claim 16, wherein said assembling method is used to recycling said developer container.

18. An assembling method for a developer stirring member, provided in a developer container for accommodating a developer, for stirring the developer, said method comprising the steps of:

preparing a stirring blade for stirring said developer, said stirring blade being provided with a plurality of openings;

preparing a rotatable supporting member for supporting said stirring blade, said supporting member is provided with a plurality of projections;

locking said projections with said openings, wherein said supporting member is provided with a shaft portion extended in a rotational axis direction of said supporting member, wherein said projection is provided with a large diameter portion and a small diameter portion between said large diameter portion and said shaft portion, wherein said small diameter portion is inserted in said openings so that said projections and said openings are locked together.

19. A method according to claim 18, wherein a length of said openings is larger than a width of said large diameter portion.

20. A method according to claim 18, wherein one-half of a difference between a width of said large diameter portion and a width of said hole portion is smaller than a height of said small diameter portion.

21. A method according to claim 18, wherein one half of a difference between a width of said small diameter portion and a width of said hole portion is smaller than a height of said small diameter portion.

22. A recycling method for a developer stirring member, provided in a developer container for accommodating a developer, for stirring the developer, wherein said developer stirring member includes a stirring blade for stirring the developer and a rotatable supporting member for supporting said stirring blade, wherein said stirring blade is detachably mounted on the supporting member, said method comprising the steps of:

dismounting said stirring blade from said supporting member;

mounting, after said dismounting process, a new stirring blade for stirring the developer to said supporting member, wherein said supporting member is provided with a shaft portion extended in a rotational axis direction of said supporting member and a plurality of projections arranged in the rotational axis direction, and wherein said stirring blade is provided with a plurality of holes for engagement with said projections and slits extended from said holes in opposite directions.

23. A method according to claim 22, wherein said dismounting step includes pulling one end portion of said stirring blade in the rotational axis direction.

24. A developer stirring member, provided in a developer container for accommodating a developer, for stirring the developer, said developer stirring member comprising:

a stirring blade for stirring the developer;

a rotatable supporting member for supporting said stirring blade, said supporting member being provided with a plurality of projections and provided with a shaft portion extended in a rotational direction of said supporting member, wherein said stirring blade is provided with a plurality of openings for engagement with said projections, respectively, wherein said projections are provided with a large diameter portion and a small diameter portion between said large diameter portion and said shaft portion, and wherein said small diameter portion is inserted in said openings so that said projections and said openings are locked together.

25. A developer stirring member according to claim 24, wherein said stirring blade is made of film having a thickness of 50–500 $\mu$m.

26. A developer stirring member according to claim 25, wherein said stirring blade is made of polyester resin material.

27. A developer stirring member according to claim 24, wherein each of said openings is provided with an additional slit connected with said hole, wherein said slits are extended in a direction of a rotational axis of said supporting member from said hole, and wherein each of said slits is provided with an additional hole.

28. A developer stirring member according to claim 24, wherein a width of said hole is smaller than a width of said small diameter portion, and said small diameter portion is inserted in said hole so that projections and said openings are locked together with each other.

29. A developer stirring member according to claim 24, wherein slits are extended from opposite sides of said hole.

30. A developer stirring member according to claim 28, wherein one-half of a difference between a width of said large diameter portion and a width of said hole is smaller than a height of said small diameter portion.

31. A developer stirring member according to claim 28, wherein one half of a difference between a width of said small diameter portion and a width of said hole is smaller than a height of said small diameter portion.

32. A developer stirring member according to claim 24, wherein said stirring blade is detachably fastened to said supporting member.

33. A developer stirring member according to claim 24, wherein said developer stirring member is effective to discharge the developer out of said developer container through an opening provided with said developer container.

34. A developer stirring member, provided in a developer container for accommodating a developer, for stirring the developer, said developer stirring member comprising:

a stirring blade for stirring the developer;

a rotatable supporting member for supporting said stirring blade, wherein said stirring blade is mounted to said rotatable supporting member by only mechanical clamping such that said stirring blade is easily removed from said supporting member for recycling.

35. An assembling method for a developer stirring member, provided in a developer container for accommodating a developer, for stirring the developer, said method comprising the steps of:

preparing a stirring blade for stirring said developer;

preparing a rotatable supporting member for supporting said stirring blade, wherein said stirring blade is mounted to said rotatable supporting member by only mechanical clamping such that said stirring blade is easily removed from said supporting member for recycling.

36. A method according to claim 18, wherein said assembling method is used to recycle said developer stirring member.

37. A method according to claim 36, wherein said assembling method is used to recycling said developer container.

38. An assembling method according to claim 18, wherein a diameter or a width of said hole is smaller than a diameter or a width of said small diameter portion.

39. An assembling method according to claim 13, wherein said slits are extended from opposite sides of said hole.

* * * * *

UNITED STATES PATENT AND TRADEMARK OFFICE

CERTIFICATE OF CORRECTION

PATENT NO. : 6,470,163 B1
DATED : October 22, 2002
INVENTOR(S) : Hironori Minagawa It is certified that error appears in the above-identified patent and that said Letters Patent is hereby corrected as shown below:

Column 4,
Line 57, “f” should read -- of --.

Column 5,
Line 9, “above described” should read -- above-described --.

Column 7,
Line 52, “relates” should read -- relate --.

Column 11,
Line 2, “semicylindrical” should read -- semi-cylindrical --.

Column 18,
Line 2, “semicircular” should read -- semi-circular --.

Column 21,
Line 20, “were” should read -- was --.

Column 24,
Line 33, “one, moment” should read -- one, a moment --.

Column 26,
Lines 27, 40 and 66, “above described” should read -- above-described --.

Column 28,
Line 40, “above described” should read -- above-described --.

Column 29,
Line 4, “semicylindrical” should read -- semi-cylindrical --; and
Line 56, “a” should read -- as --.

Column 31,
Line 3, “above described” should read -- above-described --.

Column 32,
Line 61, “it” should be deleted.

UNITED STATES PATENT AND TRADEMARK OFFICE

CERTIFICATE OF CORRECTION

PATENT NO. : 6,470,163 B1
DATED : October 22, 2002
INVENTOR(S) : Hironori Minagawa It is certified that error appears in the above-identified patent and that said Letters Patent is hereby corrected as shown below:

Column 33,
Line 1, “maybe” should read -- may be --;
Line 23, “stirring” should read -- for stirring -- and
Line 57, “[which]” should be deleted.

Column 34,
Line 40, “recycling” should read -- recycle --.

Column 36,
Line 5, “projections” should read -- said projections --; and
Line 49, “recycling” should read -- recycle --.

Signed and Sealed this

Eighteenth Day of March, 2003

JAMES E. ROGAN
*Director of the United States Patent and Trademark Office*